US012655360B2

(12) United States Patent
Wang et al.

(10) Patent No.: US 12,655,360 B2
(45) Date of Patent: Jun. 16, 2026

(54) METHOD AND APPARATUS FOR DESULFURIZATION AND SEPARATION OF CATALYTICALLY CRACKED LIGHT PRODUCT

(71) Applicants: CHINA PETROLEUM & CHEMICAL CORPORATION, Beijing (CN); RESEARCH INSTITUTE OF PETROLEUM PROCESSING, SINOPEC, Beijing (CN)

(72) Inventors: Wenshou Wang, Beijing (CN); Anguo Mao, Beijing (CN); Zhigang Zhang, Beijing (CN); Xianlong Liu, Beijing (CN); Li Xu, Beijing (CN); Yuliang Liu, Beijing (CN)

(73) Assignees: CHINA PETROLEUM & CHEMICAL CORPORATION, Beijing (CN); RESEARCH INSTITUTE OF PETROLEUM PROCESSING, SINOPEC, Beijing (CN)

( * ) Notice: Subject to any disclaimer, the term of this patent is extended or adjusted under 35 U.S.C. 154(b) by 158 days.

(21) Appl. No.: 17/755,541

(22) PCT Filed: Oct. 30, 2020

(86) PCT No.: PCT/CN2020/125166
§ 371 (c)(1),
(2) Date: Apr. 30, 2022

(87) PCT Pub. No.: WO2021/083314
PCT Pub. Date: May 6, 2021

(65) Prior Publication Data

US 2022/0380689 A1 Dec. 1, 2022

(30) Foreign Application Priority Data

Oct. 31, 2019 (CN) ..... 201911049459.X
Oct. 31, 2019 (CN) ..... 201911049466.X
(Continued)

(51) Int. Cl.
*C10G 67/02* (2006.01)
*C10G 69/04* (2006.01)
(Continued)

(52) U.S. Cl.
CPC ..... *C10G 67/02* (2013.01); *C10G 69/04* (2013.01); *C10G 70/046* (2013.01); *C10G 70/06* (2013.01);
(Continued)

(58) Field of Classification Search
CPC ..... C10G 67/02; C10G 69/04; C10G 70/046; C10G 70/06; C10G 2300/104;
(Continued)

(56) References Cited

U.S. PATENT DOCUMENTS 2,881,128 A * 4/1959 Bednars ..... C10G 61/04 208/93
5,360,533 A * 11/1994 Tagamolila ..... C10G 11/18 208/103
(Continued)

FOREIGN PATENT DOCUMENTS

CN 102839011 A 12/2012
CN 103031149 A * 4/2013
(Continued)

*Primary Examiner* — Michelle Stein
(74) *Attorney, Agent, or Firm* — NKL LAW; Allen Xue

(57) ABSTRACT

A method for the desulfurization and separation of a catalytic cracking light product includes the steps of: 1) contacting a catalytic cracking light product with a desulfurization adsorbent in an adsorption desulfurization reaction unit
(Continued)

in the presence of hydrogen for desulfurization, and optionally carrying out gas-liquid separation on the resulting desulfurization product, to obtain a desulfurized rich gas and a desulfurized crude gasoline, wherein the catalytic cracking light product is an overhead oil-gas fraction from a catalytic cracking fractionator, or a rich gas and a crude gasoline from a catalytic cracking fractionator; and 2) separately sending the desulfurized rich gas and the desulfurized crude gasoline obtained in the step 1) to a catalytic cracking absorption stabilization system for separation, to obtain a desulfurized dry gas, a desulfurized liquefied gas and a desulfurized stabilized gasoline.

11 Claims, 8 Drawing Sheets

(30) Foreign Application Priority Data

| | | |
|---|---|---|
| Oct. 31, 2019 | (CN) | 201911049476.3 |
| Oct. 31, 2019 | (CN) | 201911049610.X |
| Oct. 31, 2019 | (CN) | 201911049630.7 |
| Oct. 31, 2019 | (CN) | 201911049636.4 |

(51) Int. Cl.
*C10G 70/04* (2006.01)
*C10G 70/06* (2006.01)

(52) U.S. Cl.
CPC ..... *C10G 2300/104* (2013.01); *C10G 2300/1044* (2013.01); *C10G 2300/202* (2013.01); *C10G 2300/70* (2013.01); *C10G 2400/02* (2013.01); *C10G 2400/26* (2013.01)

(58) Field of Classification Search
CPC ..... C10G 2300/1044; C10G 2300/202; C10G 2300/70; C10G 2400/02; C10G 2400/26; C10G 11/18; C10G 45/02; C10G 7/02; C10G 49/16; C10G 55/06; C10G 67/00; C10G 67/06; C10G 53/08; C10G 49/22; C10G 11/00; C10G 45/20; C10G 67/04; C10G 2300/4006; C10G 2300/4012; C10G 2300/4018; C10G 2300/4081; B01D 2253/1124; B01D 2257/304; B01D 53/52; B01D 53/83
See application file for complete search history.

(56) References Cited

U.S. PATENT DOCUMENTS

| | | | | |
|---|---|---|---|---|
| 5,843,300 | A | 12/1998 | Zinnen et al. | |
| 7,547,386 | B1 | 6/2009 | Thakkar et al. | |
| 2003/0075485 | A1* | 4/2003 | Ghijsen | C10G 70/04 208/341 |
| 2010/0170394 | A1* | 7/2010 | Dodwell | B01J 20/06 95/135 |
| 2014/0371497 | A1 | 12/2014 | Gosling et al. | |
| 2018/0086989 | A1 | 3/2018 | Gomez et al. | |

FOREIGN PATENT DOCUMENTS

| | | | | | |
|---|---|---|---|---|---|
| CN | 103031150 | A | | 4/2013 | |
| CN | 103773432 | A | | 5/2014 | |
| CN | 103031143 | B | * | 12/2014 | |
| CN | 104560123 | A | | 4/2015 | |
| CN | 103773432 | B | * | 11/2015 | |
| CN | 106281442 | A | | 1/2017 | |
| CN | 106701177 | A | | 5/2017 | |
| CN | 107159096 | A | | 9/2017 | |
| CN | 107353934 | A | * | 11/2017 | C10G 67/14 |
| CN | 109722302 | A | * | 5/2019 | |
| EP | 3299441 | B1 | * | 1/2019 | B01D 19/0005 |
| JP | 2018053246 | A | | 4/2018 | |

* cited by examiner

METHOD AND APPARATUS FOR DESULFURIZATION AND SEPARATION OF CATALYTICALLY CRACKED LIGHT PRODUCT

CROSS REFERENCE TO RELATED APPLICATIONS

This application is a U.S. national stage entry of PCT international application no. PCT/CN2020/125166, filed on Oct. 30, 2020, which claims priority from Chinese patent application No. 201911049476.3, titled "method and apparatus for desulfurization and separation of catalytically cracked light product", filed on Oct. 31, 2019, and Chinese patent application No. 201911049636.4, titled "method for desulfurization and separation of catalytically cracked light product", filed on Oct. 31, 2019, and Chinese patent application No. 201911049459.X, titled "method and apparatus for desulfurization and separation of catalytically cracked light product", filed on Oct. 31, 2019, Chinese patent application No. 201911049466.X, titled "method and apparatus for desulfurization of catalytically cracked light product", filed on Oct. 31, 2019, Chinese patent application No. 201911049630.7, titled "method and apparatus for desulfurization of catalytically cracked light product", filed on Oct. 31, 2019, and Chinese patent application No. 201911049610.X, titled "method for desulfurization of catalytically cracked light product, method and apparatus for producing low-sulfur light oil product by catalytic cracking", filed on Oct. 31, 2019, the contents of which are incorporated herein by reference in their entireties.

TECHNICAL FIELD

The present application relates to the field of petrochemical industry, particularly to a method for desulfurization of hydrocarbon oils, more particularly to method and apparatus for desulfurization and separation of catalytically cracked light product.

BACKGROUND ART

Catalytic cracking units of refineries are the main sources of light olefins, liquefied gas and gasoline, and in existing catalytic cracking processes, the reaction product from a catalytic cracking unit is fractionated to obtain components such as rich gas, crude gasoline, light cycle oil, heavy gas oil, slurry oil and the like. The rich gas is passed through an absorption-desorption tower and a reabsorber to obtain a dry gas product, which can be used as a refinery fuel gas after being desulfurized. The crude gasoline can be separated in an absorption stabilizer to obtain liquefied gas and stabilized catalytic cracking gasoline, the catalytic cracking gasoline is output as a product after desulfurization, and the liquefied gas can be output as a product after desulfurization, or used as a starting material to provide high-value components such as propylene, butylene and the like for other devices.

All of dry gas, liquefied gas and catalytic cracking gasoline must be desulfurized, under increasingly stringent environmental regulations and downstream process requirements. At present, the desulfurization processes of dry gas, liquefied gas and catalytic gasoline are carried out separately due to the limitation of desulfurization techniques, and a large amount of waste liquid, waste residues and the like are generated in the process of alkali cleaning desulfurization and the like commonly used for dry gas and liquefied gas. In addition, existing liquefied gas desulfurization processes have the problem of excessively high sulfur content caused by insufficient desulfurization degree, which limits their applications.

Adsorption desulfurization process for hydrocarbon oils is a process for desulfurizing light hydrocarbon oils by adsorption in the presence of hydrogen, which has the characteristics of high desulfurization degree, low hydrogen consumption, and the like, and can be used to produce fuel oil with a sulfur content below 30 μg/g. However, when used for treating catalytic cracking light products, the process has the problems of low liquid yield of the catalytic cracking products and large octane number loss of gasoline.

SUMMARY OF THE INVENTION

In view of the problems in the prior art, an object of the present application is to provide a method and an apparatus for the desulfurization and separation of a catalytic cracking light product, which can be used to produce desulfurized dry gas, liquefied gas and stabilized catalytic cracking gasoline with high yield and quality.

To achieve the above object, in an aspect, the present application provides a method for the desulfurization and separation of a catalytic cracking light product, comprising the steps of:

1) contacting a catalytic cracking light product with a desulfurization adsorbent in an adsorption desulfurization reaction unit in the presence of hydrogen for desulfurization, and optionally carrying out gas-liquid separation on the resulting desulfurization product, to obtain a desulfurized rich gas and a desulfurized crude gasoline, wherein the catalytic cracking light product is an overhead oil-gas fraction from a catalytic cracking fractionator, or a rich gas and a crude gasoline from a catalytic cracking fractionator; and
2) separately sending the desulfurized rich gas and the desulfurized crude gasoline obtained in the step 1) to a catalytic cracking absorption stabilization system for separation, to obtain a desulfurized dry gas, a desulfurized liquefied gas and a desulfurized stabilized gasoline.

preferably, the catalytic cracking absorption stabilization system comprises an absorber, a reabsorber, a desorber and a stabilizer, and the step 2) further comprises:

2a) introducing the desulfurized rich gas into the absorber from the bottom, and contacting it with the desulfurized crude gasoline introduced into the absorber from the top in a countercurrent manner for mass transfer, to obtain an overhead stream and a bottom product;
2b) introducing the overhead stream of the absorber into the reabsorber from the bottom, and contacting it with a light cycle oil from the catalytic cracking fractionator introduced into the reabsorber from the top in a countercurrent manner for mass transfer, to obtain the desulfurized dry gas at the top of the reabsorber and an enriched light cycle oil at the bottom of the reabsorber, and optionally recycling the enriched light cycle oil to the catalytic cracking fractionator;
2c) desorbing the bottom product of the absorber in the desorber to obtain an overhead gas and a bottom product, and optionally recycling the overhead gas to the absorber; and
2d) sending the bottom product of the desorber to the stabilizer, and fractionating it in the stabilizer to obtain the desulfurized liquefied gas and the desulfurized stabilized gasoline.

In another aspect, the present application provides a process for producing a low-sulfur light oil product by catalytic cracking, comprising the steps of:

i) contacting a catalytic cracking feedstock with a catalytic cracking catalyst for reaction under catalytic cracking conditions;

ii) carrying out gas-solid separation on the reaction product obtained in the step i) to obtain a reaction oil gas and a spent catalyst;

iii) fractionating the reaction oil gas obtained in the step ii) in a catalytic cracking fractionator to obtain a catalytic cracking light product, a light cycle oil, a diesel oil and an oil slurry;

iv) desulfurizing and separating the catalytic cracking light product from the catalytic cracking fractionator by using the method for the desulfurization and separation of catalytic cracking light product according to the present application to obtain a desulfurized dry gas, a desulfurized liquefied gas and a desulfurized stabilized gasoline; and v) optionally, regenerating the spent catalyst obtained in the step ii) and then recycling the regenerated catalyst to a riser reactor for reuse.

In another aspect, the present application provides an apparatus for the desulfurization and separation of a catalytic cracking light product, comprising an adsorption desulfurization unit and an absorption stabilization unit communicated in sequence;

the absorption stabilization unit comprises an absorber, a desorber, a reabsorber and a stabilizer communicated in sequence; and the adsorption desulfurization unit comprises a fluidized bed desulfurization reaction unit, an adsorbent regenerator and a lock hopper connected between them that is used for conducting pressure changing and atmosphere conversion, the fluidized bed desulfurization reaction unit is in communication with a catalytic cracking fractionator to receive a catalytic cracking light product from the catalytic cracking fractionator, and an oil-gas outlet of the fluidized bed desulfurization reaction unit is in communication with the absorber of the absorption stabilization unit or communicated with the absorber of the absorption stabilization unit through a gas-liquid separation tank.

Compared with the prior art, the method and the apparatus for the desulfurization and separation of catalytic cracking light product of the present application have one or more of the following benefits:

1) a catalytic cracking light product, such as an overhead oil-gas fraction from a catalytic cracking fractionator or a rich gas and a crude gasoline from a catalytic cracking fractionator, is subjected firstly to adsorption desulfurization and then to absorption stabilization, so that the loss of gasoline yield encountered by conventional methods can be reduced to a maximum extent.

2) the rich gas and the crude gasoline from the catalytic cracking fractionator are subjected to adsorption desulfurization, and the loss of light olefins in the rich gas is low. In the adsorption desulfurization reactor, hydrogen in the rich gas serves as a hydrogen supply to participate in the reaction, so that the hydrogen consumption can be saved. After adsorption desulfurization, the rich gas and the crude gasoline are passed through an absorption stabilization system to obtain desulfurized dry gas, liquefied gas and stabilized gasoline, of which the sulfur content can be 10 ppm or less, or even 1 ppm or less.

3) The device for desulfurizing dry gas, liquefied gas and the like required by traditional refineries is eliminated, and the problems of waste liquid, waste residue and the like possibly encountered by traditional desulfurization processes are avoided.

4) when two desulfurization reactors are used for treating the crude gasoline and the rich gas respectively, the two desulfurization reactors can be operated relatively independently, and olefin saturation during the desulfurization of the rich gas is reduced.

5) in a preferred embodiment, the crude gasoline and the desulfurization adsorbent flow upwards concurrently in a first fluidized bed desulfurization reactor, so that a long reaction time can be obtained to ensure a complete removal of sulfides like thiophenes that are difficult to be removed; the rich gas is countercurrently contacted with the desulfurization adsorbent in a second fluidized bed desulfurization reactor for adsorption desulfurization, so that the contact time of the olefin in the rich gas and the adsorbent can be reduced, and the saturation of the light olefin is reduced.

BRIEF DESCRIPTION OF THE DRAWINGS

The drawings, forming a part of the present description, are provided to help the understanding of the present application, and should not be considered to be limiting. The present application can be interpreted with reference to the drawings in combination with the detailed description hereinbelow. In the drawings:

FIG. 1Eb is a schematic flow diagram of another preferred embodiment of an adsorption desulfurization unit according to a fifth type of embodiments of the present application.

DETAILED DESCRIPTION OF THE INVENTION

Figure 1A:
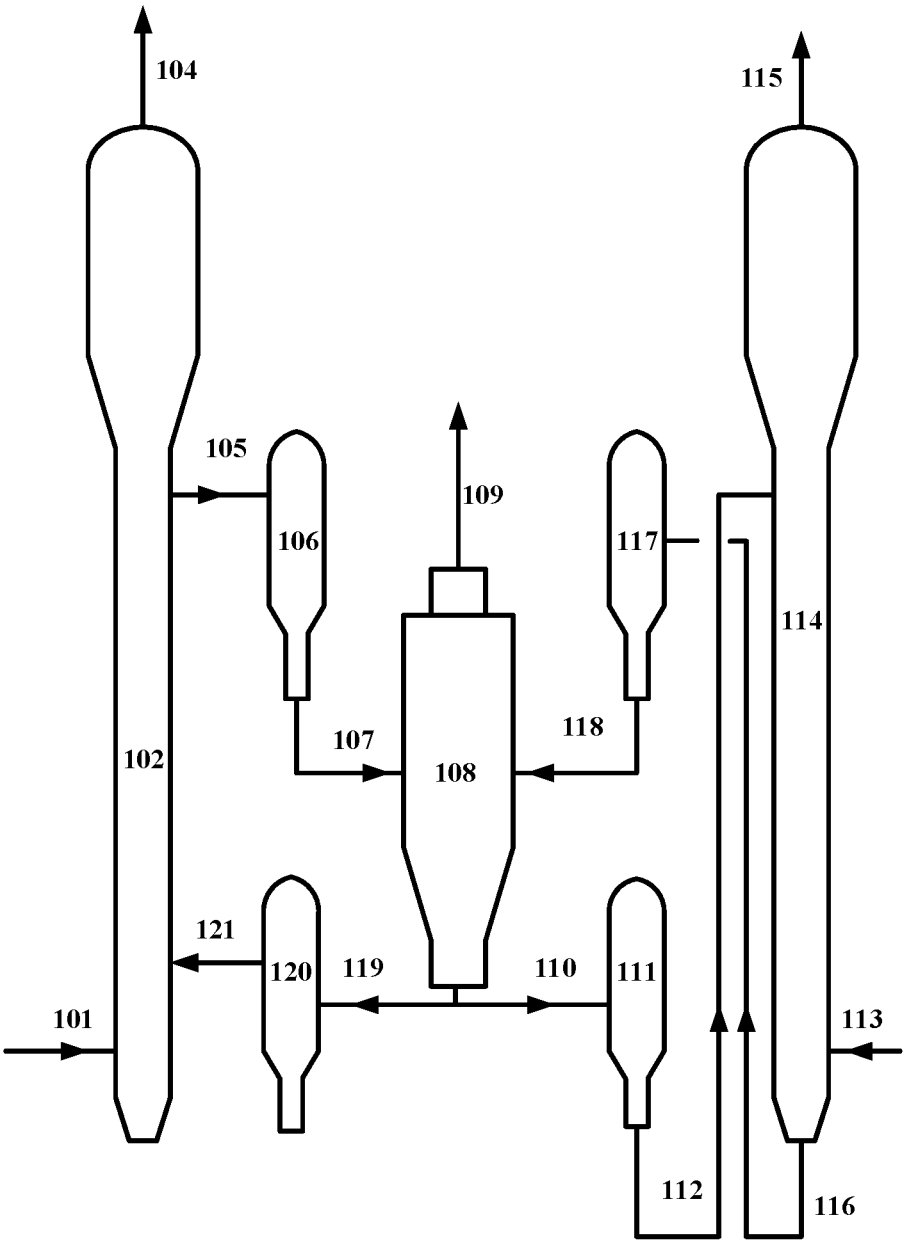
FIG. 1A is a schematic flow diagram of a preferred embodiment of an adsorption desulfurization unit according to a first type of embodiments of the present application.

The present application will be further described hereinafter in detail with reference to specific embodiments thereof and the accompanying drawings. It should be noted that the specific embodiments of the present application are provided for illustration purpose only, and are not intended to be limiting in any manner.

Any specific numerical value, including the endpoints of a numerical range, described in the context of the present application is not restricted to the exact value thereof, but should be interpreted to further encompass all values close to said exact value, for example all values within ±5% of said exact value. Moreover, regarding any numerical range described herein, arbitrary combinations can be made between the endpoints of the range, between each endpoint and any specific value within the range, or between any two specific values within the range, to provide one or more new numerical range(s), where said new numerical range(s) should also be deemed to have been specifically described in the present application.

Unless otherwise stated, the terms used herein have the same meaning as commonly understood by those skilled in the art; and if the terms are defined herein and their definitions are different from the ordinary understanding in the art, the definition provided herein shall prevail.

In the present application, the term "rich gas" refers to a gas fraction obtained from a catalytic cracking fractionator, which mainly comprises C1-C4 hydrocarbon components, as well as a small amount of C5 hydrocarbon components and a very small amount of C6 components, and may also comprise other components such as nitrogen, carbon dioxide, carbon monoxide, hydrogen, and hydrogen sulfide. Its sulfur content is 30-50000 μg/g, for example 50 μg/g or higher.

In the present application, "crude gasoline" refers to a fraction from a catalytic cracking fractionator having a distillation range of 30-210° C., which mainly comprises C4-C12 hydrocarbon components. Its sulfur content is 30-50000 μg/g, for example 50 μg/g or higher.

In the present application, "overhead oil-gas fraction" refers to a fraction obtained from the top of a catalytic cracking fractionator having a distillation range covering both the rich gas and the crude gasoline, which mainly comprises C1-C12 hydrocarbon components, and may also comprise other components such as nitrogen, carbon dioxide, carbon monoxide, hydrogen and hydrogen sulfide. Its sulfur content is 30-50000 μg/g, such as 50 μg/g or higher.

According to the present application, the "bottom" of a reactor or vessel refers to a part of the reactor or vessel from 0% to 10% of the height thereof from bottom to top, the "lower part" of a reactor or vessel refers to a part of the reactor or vessel from 0% to 50% of the height thereof from bottom to top, the "upper part" of a reactor or vessel refers to a part of the reactor or vessel from 50% to 100% of the height thereof from bottom to top, and the "top" of a reactor or vessel refers to a part of the reactor or vessel from 90% to 100% of the height thereof from bottom to top.

In the context of the present application, in addition to those matters explicitly stated, any matter or matters not mentioned are considered to be the same as those known in the art without any change. Moreover, any of the embodiments described herein can be freely combined with another one or more embodiments described herein, and the technical solutions or ideas thus obtained are considered as part of the original disclosure or original description of the present application, and should not be considered to be a new matter that has not been disclosed or anticipated herein, unless it is clear to those skilled in the art that such a combination is obviously unreasonable.

All of the patent and non-patent documents cited herein, including but not limited to textbooks and journal articles, are hereby incorporated by reference in their entireties.

As noted above, in a first aspect, the present application provides a method for the desulfurization and separation of a catalytic cracking light product, comprising the steps of:

1) contacting a catalytic cracking light product with a desulfurization adsorbent in an adsorption desulfurization reaction unit in the presence of hydrogen for desulfurization, and optionally carrying out gas-liquid separation on the resulting desulfurization product, to obtain a desulfurized rich gas and a desulfurized crude gasoline, wherein the catalytic cracking light product is an overhead oil-gas fraction from a catalytic cracking fractionator, or a rich gas and a crude gasoline from a catalytic cracking fractionator; and 2) separately sending the desulfurized rich gas and the desulfurized crude gasoline obtained in the step 1) to a catalytic cracking absorption stabilization system for separation, to obtain a desulfurized dry gas, a desulfurized liquefied gas and a desulfurized stabilized gasoline.

preferably, the catalytic cracking absorption stabilization system comprises an absorber, a reabsorber, a desorber and a stabilizer, and the step 2) further comprises:

2a) introducing the desulfurized rich gas into the absorber from the bottom, and contacting it with the desulfurized crude gasoline introduced into the absorber from the top in a countercurrent manner for mass transfer, to obtain an overhead stream and a bottom product;

2b) introducing the overhead stream of the absorber into the reabsorber from the bottom, and contacting it with a light cycle oil from the catalytic cracking fractionator introduced into the reabsorber from the top in a countercurrent manner for mass transfer, to obtain the desulfurized dry gas at the top of the reabsorber and an enriched light cycle oil at the bottom of the reabsorber, and optionally recycling the enriched light cycle oil to the catalytic cracking fractionator;

2c) desorbing the bottom product of the absorber in the desorber to obtain an overhead gas and a bottom product, and optionally recycling the overhead gas to the absorber; and 2d) sending the bottom product of the desorber to the stabilizer, and fractionating it in the stabilizer to obtain the desulfurized liquefied gas and the desulfurized stabilized gasoline.

Further preferably, the operating conditions of the absorber include: a pressure of 0.2-3.0 MPa, preferably 0.5-1.6 MPa, a temperature of 20-100° C., preferably 30-70° C.; the operating conditions of the desorber include: a pressure of 0.1-3.0 MPa, preferably 0.5-2.5 MPa, a temperature of 20-250° C., preferably 50-200° C.; the operating conditions of the reabsorber preferably include: a pressure of 0.1-3.0 MPa, preferably 0.5-2.5 MPa, a temperature of 20-100° C., preferably 30-70° C.; and the operating conditions of the stabilizer preferably include: a pressure of 0.1-3.0 MPa, preferably 0.5-2.5 MPa, and a temperature of 20-250° C., preferably 50-200° C.

First Type of Embodiments:

In a first type of embodiments of the method according to the present application, the catalytic cracking light product is an overhead oil-gas fraction from a catalytic cracking fractionator, and the step 1) further comprises:

1a) introducing the overhead oil-gas fraction from the catalytic cracking fractionator into a fluidized bed desulfurization reactor from the bottom, and contacting it with a desulfurization adsorbent introduced into the reactor from the bottom in the presence of hydrogen for desulfurization reaction;

1b) carrying out gas-solid separation on the reaction stream obtained at the upper part of the fluidized bed desulfurization reactor to obtain a reaction oil gas and a sulfur-loaded adsorbent;

1c) carrying out gas-liquid separation on the reaction oil gas obtained in the step 1b) to obtain the desulfurized rich gas and the desulfurized crude gasoline; and 1d) sending the sulfur-loaded adsorbent obtained in the step 1b) into an adsorbent regenerator for regeneration by calcining in the presence of an oxygen-containing gas, and recycling the regenerated desulfurization adsorbent to the fluidized bed desulfurization reactor after reduction.

In some preferred embodiments, the overhead oil-gas fraction from the catalytic cracking fractionator is introduced into an adsorption desulfurization reaction unit, and contacted with a desulfurization adsorbent in the presence of hydrogen for desulfurization to obtain a reaction oil gas, which is passed to a gas-liquid separation tank for separation to obtain the desulfurized rich gas and the desulfurized crude gasoline; the desulfurized rich gas is introduced into an absorber from the bottom and contacted with the desulfurized crude gasoline introduced into the absorber from the top for mass transfer, the overhead stream of the absorber is introduced into a reabsorber from the bottom and contacted with a light cycle oil from a catalytic cracking fractionator in a countercurrent manner for mass transfer, the desulfurized dry gas is obtained from the top of the reabsorber, and the enriched light cycle oil obtained at the bottom of the reabsorber is recycled to the catalytic cracking fractionator; and the bottom product of the absorber is sent to a stabilizer after passing through a desorber, fractionated in the stabilizer to obtain the desulfurized liquefied gas and the desulfurized stabilized gasoline, and the overhead gas of the desorber is recycled to the absorber.

In a further preferred embodiment, after the overhead oil-gas fraction of the catalytic cracking fractionator is preheated to a required temperature, the overhead oil-gas fraction is introduced into the fluidized bed desulfurization reactor from the bottom, and contacted with a desulfurization adsorbent in the reactor for desulfurization while flowing from bottom to top, the reacted spent adsorbent with high sulfur loading is separated from the oil gas and then is introduced into the fluidized bed regenerator to contact with oxygen for regeneration, and the regenerated adsorbent is recycled to the desulfurization reactor for reuse after reduction. The desulfurized product mixture is passed through a gas-liquid separator to obtain the desulfurized rich gas and the desulfurized crude gasoline, the desulfurized rich gas and the desulfurized crude gasoline and/or a part of stabilized gasoline are passed to an absorber, the overhead gas product of the absorber is absorbed using a light cycle oil from a catalytic cracking fractionator and separated in a reabsorber, the desulfurized dry gas is obtained at the top of the reabsorber, an enriched light cycle oil is obtained at the bottom of the reabsorber, and the enriched light cycle oil is recycled to the catalytic cracking fractionator. The bottom product of the absorber is sent to a stabilizer after passing through a desorber, fractionated in the stabilizer to obtain the desulfurized liquefied gas and the desulfurized stabilized catalytic cracking gasoline, and the overhead gas of the desorber is mixed with the desulfurized rich gas and then passed to the absorber.

In a further preferred embodiment, the overhead oil-gas fraction of the catalytic cracking fractionator is heated to 100-500° C., the heated overhead oil-gas fraction of the catalytic cracking fractionator is used as the hydrocarbon oil feedstock of the fluidized bed desulfurization reactor, the hydrocarbon oil feedstock or a mixture of the hydrocarbon oil feedstock and a hydrogen donor is introduced into the fluidized bed reactor from the bottom, and the sulfur-containing hydrocarbon oil feedstock is contacted with the desulfurization adsorbent for adsorption desulfurization reaction under the reaction conditions including a temperature of 200-550° C., preferably 300-500° C., a pressure of 0.5-5 MPa, preferably 1.0-3.5 MPa, a weight hourly space velocity of 0.1-100 $h^{-1}$, preferably 1-10 $h^{-1}$, and a volume ratio of the hydrogen donor to the gasoline feedstock of 0.01-1000, preferably 0.05-500.

Preferably, the mixture of the hydrocarbon oil feedstock and the hydrogen donor is uniformly distributed in the reactor through a feeding distribution plate, and is well contacted with the desulfurization adsorbent in the reactor. The desulfurization adsorbent is introduced into the fluidized bed desulfurization reactor from the bottom thereof.

Preferably, a gas-solid separator is provided in the settling separation section at the top of the fluidized bed desulfurization reactor, the reaction oil gas and the desulfurization adsorbent are subjected to gas-solid separation, and the separated sulfur-loaded spent adsorbent (also called a "sulfur-loaded catalyst") is stripped to remove hydrocarbons adsorbed, and then is sent to the adsorbent regenerator. The regenerated desulfurization adsorbent is sent to an adsorbent reducer for reduction, and the reduced desulfurization adsorbent is introduced into the fluidized bed desulfurization reactor from the bottom thereof to realize a continuous cycle of adsorption desulfurization reaction, adsorbent regeneration, adsorbent reduction and adsorption desulfurization reaction.

The hydrocarbon oil product obtained after the reaction is sent to a gas-liquid separation tank after heat exchange to obtain the desulfurized rich gas and the desulfurized crude gasoline. The operating pressure of the gas-liquid separation tank is 0.2-4.0 MPa, preferably 0.5-3.0 MPa, and the operating temperature is 20-300° C., preferably 50-200° C.

FIG. 1A is a schematic flow diagram of a preferred embodiment of an adsorption desulfurization unit according to a first type of embodiments of the present application. As shown in FIG. 1A, the adsorption desulfurization unit comprises a fluidized bed desulfurization reactor 102, a reactor receiver 106, a lock hopper 108 for isolating the reaction-regeneration system, a regenerator feed tank 111, an adsorbent regenerator 114, and a regenerator receiver 117, which are communicated in sequence, wherein the regenerator receiver 117 is communicated with an adsorbent reducer 120 through the lock hopper 108 and a pipeline 119, and the adsorbent reducer 120 is communicated with the bottom of the fluidized bed desulfurization reactor 102.

The preheated overhead oil-gas fraction from the catalytic cracking fractionator and hydrogen gas are introduced into the bottom of the fluidized bed desulfurization reactor 102 through a pipeline 101, contacted with a desulfurization adsorbent in the fluidized bed desulfurization reactor 102 for adsorption desulfurization reaction, and the adsorbent partially loaded with sulfur moves upwards along with the reaction material. After the reaction, the reaction oil gas and the adsorbent are passed to a settling separation section at the top of the reactor 102 for oil-adsorbent separation, the resulting reaction oil gas is a mixture of the desulfurized rich gas, the desulfurized crude gasoline and hydrogen, and is sent to a gas-liquid separation tank (not shown) through a pipeline 104, and the desulfurized rich gas and the desulfurized crude gasoline are obtained through condensation gas-liquid separation and are sent to a subsequent product separation and stabilization system for treatment.

The spent adsorbent is transferred from the upper part of the fluidized bed desulfurization reactor 102 to a reactor receiver 106 through an adsorbent transferring horizontal pipe 105, and sent to a lock hopper 108 through a pipeline 107 after being stripped in the reactor receiver 106, purged with nitrogen and then is changed to a low-pressure inactive atmosphere from a high-pressure hydrogen environment in the lock hopper, and the purged gas is sent to a combustion furnace through a pipeline 109 for burning. The spent adsorbent is passed via a pipeline 110 to a regenerator feed tank 111 where it is lifted by a lift gas and passed via a pipeline 112 to an adsorbent regenerator 114. An oxygen-containing gas is introduced into the adsorbent regenerator from the bottom through a pipeline 113, the spent adsorbent is contacted with the oxygen-containing gas in the adsorbent regenerator 114 for sulfur burning and carbon burning to obtain a regenerated adsorbent, the sulfur-containing flue gas is separated from the regenerated adsorbent at the top of the adsorbent regenerator and then is sent to a sulfur production system or is subjected to alkali cleaning to remove SOx through a pipeline 115, the regenerated adsorbent is passed from the adsorbent regenerator to a regenerator receiver 117 through a pipeline 116, lifted by nitrogen and sent to the lock hopper 108 through a pipeline 118, stripped and purged with hydrogen, and then changed to a high-pressure hydrogen environment after a pressure increasing in the lock hopper 108, introduced into a reducer 120 through a pipeline 119 for reduction, and the reduced regenerated adsorbent is introduced into the fluidized bed desulfurization reactor 102 through a pipeline 121, so that a continuous adsorption desulfurization reaction is realized.

Second Type of Embodiments:

According to a second type of embodiments of the method according to the present application, the catalytic cracking light product is a rich gas and a crude gasoline from a catalytic cracking fractionator, and the step 1) further comprises:

1a) introducing the crude gasoline from the catalytic cracking fractionator into a fluidized bed desulfurization reactor from the bottom, and contacting it with a desulfurization adsorbent introduced into the reactor from the bottom in the presence of hydrogen for desulfurization reaction;

1b) introducing the rich gas from the catalytic cracking fractionator into the fluidized bed desulfurization reactor at a position of 30-80%, preferably 40-70%, of the height thereof from bottom to top, and mixing it with the stream in the reactor for desulfurization reaction;

1c) carrying out gas-solid separation on the reaction stream obtained at the upper part of the fluidized bed desulfurization reactor to obtain a reaction oil gas and a sulfur-loaded adsorbent;

1d) carrying out gas-liquid separation on the reaction oil gas obtained in the step 1c) to obtain the desulfurized rich gas and the desulfurized crude gasoline, wherein preferably, the operating conditions of the gas-liquid separation include: a pressure of 0.2-4.0 MPa, preferably 0.5-3.0 MPa, and a temperature of 20-300° C., preferably 50-200° C.; and 1e) sending the sulfur-loaded adsorbent obtained in the step 1c) to an adsorbent regenerator for regeneration by calcining in the presence of an oxygen-containing gas, and the regenerated desulfurization adsorbent is recycled to the fluidized bed desulfurization reactor after reduction, preferably, the sulfur content in the rich gas and in the crude gasoline from the catalytic cracking fractionator are each independently greater than 30 μg/g, particularly greater than 50 μg/g.

In some preferred embodiments, the crude gasoline from the catalytic cracking fractionator is introduced into the fluidized bed desulfurization reactor from the bottom, and is contacted with a desulfurization adsorbent for desulfurization in the presence of hydrogen while flowing upwards, the rich gas is introduced into the fluidized bed desulfurization reactor at a position of 30-80% of the height thereof from bottom to top, is mixed with the reaction stream and then is contacted with the desulfurization adsorbent for reaction, and the reaction oil gas obtained by gas-solid separation at the top of the reactor is introduced into a gas-liquid separation tank for separation to obtain the desulfurized rich gas and the desulfurized crude gasoline; the sulfur-loaded adsorbent is calcined and regenerated in an adsorbent regenerator, and the regenerated desulfurization adsorbent is recycled to the fluidized bed desulfurization reactor for reuse after reduction; the desulfurized rich gas is introduced into an absorber from the bottom and contacted with the desulfurized crude gasoline introduced into the absorber from the top for mass transfer, the overhead stream of the absorber is introduced into a reabsorber from the bottom and contacted with a light cycle oil from a catalytic cracking fractionator in a countercurrent manner for mass transfer, the desulfurized dry gas is obtained from the top of the reabsorber, and the enriched light cycle oil obtained at the bottom of the reabsorber is recycled to the catalytic cracking fractionator; and the bottom product of the absorber is sent to a stabilizer after passing through a desorber, fractionated in the stabilizer to obtain the desulfurized liquefied gas and the desulfurized stabilized gasoline, and the overhead gas of the desorber is recycled to the absorber.

In a further preferred embodiment, the crude gasoline from the catalytic cracking fractionator is preheated to a required temperature, introduced into the fluidized bed desulfurization reactor from the bottom, and contacted with the desulfurization adsorbent in the reactor for desulfurization while flowing from bottom to top, the rich gas is introduced into the fluidized bed desulfurization reactor from the middle upper part, mixed with the reaction stream and contacted with the desulfurization adsorbent for reaction, and subjected to gas-solid separation at the top of the fluidized bed desulfurization reactor. The separated spent adsorbent with high sulfur loading is introduced into an adsorbent regenerator to contact with oxygen for regeneration, and the regenerated adsorbent is recycled to the desulfurization reactor for reuse after reduction. The reaction oil gas obtained by gas-solid separation is passed through a gas-liquid separator to obtain the desulfurized rich gas and the desulfurized crude gasoline, the desulfurized rich gas is introduced into an absorber from the bottom and contacted with the desulfurized crude gasoline introduced into the absorber from the top for mass transfer, the overhead gas product of the absorber is absorbed using a light cycle oil from a catalytic cracking fractionator and separated in a reabsorber, the desulfurized dry gas is obtained at the top of the reabsorber, an enriched light cycle oil is obtained at the bottom of the reabsorber, and the enriched light cycle oil is recycled to the catalytic cracking fractionator. The bottom product of the absorber is sent to a stabilizer after passing through a desorber, fractionated in the stabilizer to obtain the desulfurized liquefied gas and the desulfurized stabilized catalytic cracking gasoline, and the overhead gas of the desorber is mixed with the desulfurized rich gas and then passed to the absorber.

In a still further preferred embodiment, the crude gasoline from the catalytic cracking fractionator is heated to 100-500° C., and is introduced into the fluidized bed adsorption desulfurization reactor from the bottom together with a hydrogen donor. The rich gas from the catalytic cracking fractionator is preheated to a temperature of 150-450° C., and is introduced into the fluidized bed desulfurization reactor at a position of 30-80% of the height thereof from bottom to top.

The fluidized bed desulfurization reactor is preferably a dense-phase bed reactor, and the height of the adsorbent bed layer through which the rich gas passes is controlled to be 10-60% of the total height of the adsorbent bed layer in the fluidized bed desulfurization reactor.

The operating conditions of the fluidized bed desulfurization reactor preferably include: a temperature of 200-550° C., preferably 300-500° C., a pressure of 0.5-5 MPa, preferably 1.0-3.5 MPa, a weight hourly space velocity of 0.1-100 $h^{-1}$, preferably 1-10 $h^{-1}$, and a volume ratio of the hydrogen donor to the gasoline feedstock of 0.01-1000, preferably 0.05-500. In the presence of hydrogen, the reaction oil gas containing crude gasoline and rich gas is contacted with a desulfurization adsorbent for adsorption desulfurization reaction. After the desulfurization adsorbent is separated from the reaction oil gas, the sulfur-loaded spent adsorbent is stripped to remove adsorbed hydrocarbons, and then sent to the adsorbent regenerator. The regenerated desulfurization adsorbent is sent to an adsorbent reducer for reduction, and the reduced desulfurization adsorbent is introduced into the fluidized bed desulfurization reactor from the bottom thereof to realize a continuous cycle of adsorption desulfurization reaction, adsorbent regeneration, adsorbent reduction and adsorption desulfurization reaction.

Preferably, at the bottom of the fluidized bed adsorption desulfurization reactor, the mixture of the crude gasoline and the hydrogen donor is uniformly distributed in the reactor through a feeding distribution plate and is well contacted with the desulfurization adsorbent in the reactor. The desulfurization adsorbent is introduced into the fluidized bed reactor from the bottom thereof.

The reaction oil gas obtained after gas-solid separation is sent to a gas-liquid separation tank after heat exchange to obtain the desulfurized rich gas and the desulfurized crude gasoline. The operating pressure of the gas-liquid separation tank is 0.2-4.0 MPa, preferably 0.5-3.0 MPa, and the operating temperature is 20-300° C., preferably 50-200° C.

Figure 1B:
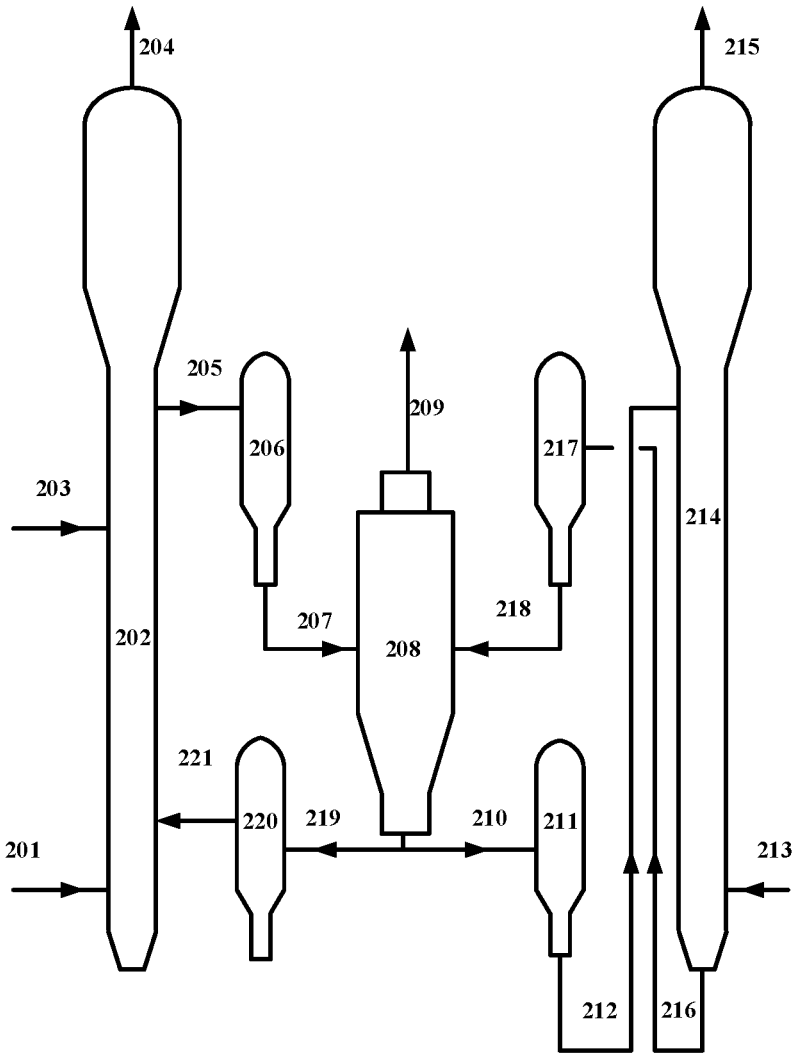
FIG. 1B is a schematic flow diagram of a preferred embodiment of an adsorption desulfurization unit according to a second type of embodiments of the present application.

FIG. 1B is a schematic flow diagram of a preferred embodiment of an adsorption desulfurization unit according to a second type of embodiments of the present application. As shown in FIG. 1B, the adsorption desulfurization unit comprises a fluidized bed desulfurization reactor 202, a reactor receiver 206, a lock hopper 208 for isolating the reaction-regeneration system, a regenerator feed tank 211, an adsorbent regenerator 214 and a regenerator receiver 217, which are communicated in sequence, wherein the lock hopper 208 is communicated with an adsorbent reducer 220 through a pipeline 219, and the adsorbent reducer 220 is communicated with the bottom of the fluidized bed desulfurization reactor 202.

The preheated crude gasoline and hydrogen are introduced into the bottom of the fluidized bed desulfurization reactor 202 through a pipeline 201, contacted with a desulfurization adsorbent in the fluidized bed desulfurization reactor 202 for desulfurization reaction, and the adsorbent partially loaded with sulfur moves upwards along with the reaction material. The preheated rich gas is introduced into the fluidized bed desulfurization reactor at a position of 30-80% of the height thereof from bottom to top of the fluidized bed desulfurization reactor 202 through a pipeline 203, and mixed with the reaction oil gas and the desulfurization adsorbent for desulfurization reaction, the reaction oil gas and adsorbent after reaction are passed to a settling separation section at the top of the fluidized bed desulfurization reactor 202 for oil-adsorbent separation, the resulting reaction oil gas is a mixture of the desulfurized rich gas, the desulfurized crude gasoline and hydrogen, and is sent to a gas-liquid separation tank (not shown) through a pipeline 204, and the desulfurized rich gas and the desulfurized crude gasoline obtained by condensation gas-liquid separation are sent to a subsequent product separation and stabilization system for treatment.

The spent adsorbent is transferred from the upper part of the fluidized bed desulfurization reactor 202 to a reactor receiver 206 through an adsorbent transferring horizontal pipe 205, and sent to a lock hopper 208 through a pipeline 207 after being stripped in the reactor receiver 206, purged with nitrogen and then is changed to a low-pressure inactive atmosphere from a high-pressure hydrogen environment in the lock hopper, and the purged gas is sent to a combustion furnace through a pipeline 209 for burning. The spent adsorbent is sent via a pipeline 210 to a regenerator feed tank 211 and is lifted by a lift gas and passed via a pipeline 212 to an adsorbent regenerator 214. An oxygen-containing gas is introduced into the adsorbent regenerator from the bottom through a pipeline 213, the spent adsorbent is contacted with the oxygen-containing gas in the adsorbent regenerator 214 for sulfur burning and carbon burning to obtain a regenerated adsorbent, the sulfur-containing flue gas is separated from the regenerated adsorbent at the top of the adsorbent regenerator and then is sent to a sulfur production system or is subjected to alkali cleaning to remove SOx through a pipeline 215, the regenerated adsorbent is passed from the adsorbent regenerator to a regenerator receiver 217 through a pipeline 216, lifted by nitrogen and sent to the lock hopper 208 through a pipeline 218, stripped and purged with hydrogen, and then changed to a high-pressure hydrogen environment after a pressure increasing in the lock hopper 208, introduced into the reducer 220 for reduction through a pipeline 219, and the reduced regenerated adsorbent is introduced into the fluidized bed desulfurization reactor 202 through a pipeline 221, so that a continuous adsorption desulfurization reaction is realized.

Third Type of Embodiments:

According to a third type of embodiments of the method according to the present application, the catalytic cracking light product is a rich gas and a crude gasoline from a catalytic cracking fractionator, and the step 1) further comprises:

1a) introducing the crude gasoline from the catalytic cracking fractionator into a first fluidized bed desulfurization reactor from the bottom, and contacting it with a desulfurization adsorbent introduced into the reactor from the bottom in the presence of hydrogen for desulfurization reaction;

1b) carrying out gas-solid separation on the reaction stream obtained at the upper part of the first fluidized bed desulfurization reactor to obtain the desulfurized crude gasoline and a desulfurization adsorbent partially loaded with sulfur, and sending the desulfurization adsorbent partially loaded with sulfur into a second fluidized bed desulfurization reactor;

1c) introducing the rich gas from the catalytic cracking fractionator into the second fluidized bed desulfurization reactor from the bottom, and contacting it with the desulfurization adsorbent partially loaded with sulfur introduced into the reactor from the bottom for desulfurization reaction;

1d) carrying out gas-solid separation on the reaction stream obtained at the upper part of the second fluidized bed desulfurization reactor to obtain the desulfurized rich gas and a sulfur-loaded adsorbent; and 1e) sending the sulfur-loaded adsorbent obtained in the step 1d) to an adsorbent regenerator for regeneration by calcining in the presence of an oxygen-containing gas, and recycling the regenerated desulfurization adsorbent to the first fluidized bed desulfurization reactor after reduction.

In some preferred embodiments, the crude gasoline from the catalytic cracking fractionator is introduced into the first fluidized bed desulfurization reactor from the bottom, contacted with the desulfurization adsorbent in the presence of hydrogen for desulfurization while flowing upwards; and subjected to gas-solid separation in a settling zone at the upper part, the separated desulfurization adsorbent partially loaded with sulfur is introduced into a second fluidized bed desulfurization reactor, and the separated reaction oil gas is the desulfurized crude gasoline; the rich gas from the catalytic cracking fractionator is introduced into the second fluidized bed desulfurization reactor from the bottom, contacted with the desulfurization adsorbent for desulfurization while flowing upwards, and subjected to gas-solid separation in a settling zone at the upper part, the separated reaction oil gas is the desulfurized rich gas, the separated sulfur-loaded adsorbent is passed to an adsorbent regenerator for regeneration by calcining using an oxygen-containing gas, and the regenerated desulfurization adsorbent is recycled to the bottom of the first fluidized bed desulfurization reactor after reduction; and the desulfurized rich gas and the desulfurized crude gasoline are separately sent to an absorption stabilization system for separation, to obtain the desulfurized dry gas, the desulfurized liquefied gas and the desulfurized stabilized gasoline.

In a still further preferred embodiment, the crude gasoline from the catalytic cracking fractionator or a mixture of the crude gasoline and a hydrogen donor is preheated to a temperature of 100-500° C., preferably 300-450° C. The heated crude gasoline is used as a feedstock of the first fluidized bed desulfurization reactor, and introduced into the first fluidized bed desulfurization reactor from the bottom, a desulfurization adsorbent is introduced into the first fluidized bed desulfurization reactor from the bottom, and the feedstock is contacted with the desulfurization adsorbent for adsorption desulfurization reaction. The reaction stream flows from bottom to top, and the reaction oil gas and the desulfurization adsorbent are separated by gas-solid separation in a settling zone with an enlarged pipe diameter at the upper part of the first fluidized bed desulfurization reactor, and the settling zone may be further provided with a gas-solid separation equipment such as a cyclone separator or a filter. The separated reaction oil gas is the desulfurized crude gasoline, the separated desulfurization adsorbent partially loaded with sulfur is passed to an adsorbent transferring tank, and the desulfurization adsorbent is subjected to a system pressure changing in the adsorbent transferring tank and then is introduced into a second fluidized bed desulfurization reactor.

The desulfurization adsorbent partially loaded with sulfur is introduced into the second fluidized bed desulfurizing reactor and contacted with the rich gas or a mixture of the rich gas and a hydrogen donor preheated to a required temperature for desulfurization reaction, and sulfur in the rich gas is transferred to the desulfurization adsorbent, and the reaction oil gas and the desulfurization adsorbent are separated by gas-solid separation in a settling zone with an enlarged pipe diameter at the upper part of the second fluidized bed desulfurization reactor. The separated reaction oil gas is the desulfurized rich gas, the separated desulfurization adsorbent with high sulfur loading is introduced into an adsorbent regenerator and contacted with an oxygen-containing gas for regeneration, and the regenerated desulfurization adsorbent is recycled to the first fluidized bed desulfurization reactor for reuse after reduction.

The desulfurized rich gas is introduced into an absorber from the bottom, the desulfurized crude gasoline or the crude gasoline and a part of the stabilized gasoline are introduced into the absorber from the top and contacted with the rich gas in a countercurrent manner, the overhead gas product of the absorber is absorbed using the light cycle oil from the catalytic cracking fractionator and separated in a reabsorber, the desulfurized dry gas is obtained at the top of the reabsorber, an enriched light cycle oil is obtained at the bottom of the reabsorber, and the enriched light cycle oil is recycled to the catalytic cracking fractionator. The bottom product of the absorber is sent to a stabilizer after passing through a desorber, fractionated in the stabilizer to obtain the desulfurized liquefied gas and the desulfurized stabilized catalytic cracking gasoline, and the overhead gas of the desorber is mixed with the desulfurized rich gas and then passed to the absorber.

Preferably, the crude gasoline from the catalytic cracking fractionator, or a mixture of the crude gasoline and a hydrogen donor is introduced into the first fluidized bed desulfurization reactor from the bottom, and the mixture of the crude gasoline and the hydrogen donor is uniformly distributed in the reactor through a feeding distribution plate and is well contacted with the desulfurization adsorbent in the reactor.

In a further preferred embodiment, in the first fluidized bed desulfurization reactor, the sulfur-containing crude gasoline is contacted with the desulfurization adsorbent for adsorption desulfurization reaction under the reaction conditions including a temperature of 200-550° C., preferably 300-500° C., a pressure of 0.5-5 MPa, preferably 1.0-3.5 MPa, a weight hourly space velocity of 0.1-100 $h^{-1}$, preferably 1-10 $h^{-1}$, and a volume ratio of the hydrogen donor to the gasoline feedstock of 0.01-1000, preferably 0.05-500, so as to transfer the sulfur to the desulfurization adsorbent.

After the desulfurization adsorbent is separated from the reaction oil gas, the sulfur-loaded spent adsorbent is introduced into an adsorbent transferring tank, and then transferred to a second desulfurization regenerator after pressure changing.

The rich gas from the catalytic cracking fractionator, or the rich gas and a hydrogen donor are heated to a temperature of 100-500° C., preferably 200-450° C. The heated rich gas or the heated mixture of the rich gas and the hydrogen donor is introduced into the second fluidized bed desulfurization reactor from the bottom, and the sulfur-containing rich gas is contacted with the adsorbent partially loaded with sulfur from the first reactor for adsorption desulfurization reaction under the reaction conditions including a temperature of 300-550° C., preferably 350-500° C., an absolute pressure of 0.1-3 MPa, preferably 0.2-2.5 MPa, a weight hourly space velocity of 1-100 $h^{-1}$, preferably 2-20 $h^{-1}$, and a volume ratio of the hydrogen donor or hydrogen to the rich gas feedstock of 0.01-500, preferably 0.05-300. Preferably, the operating pressure of the second fluidized bed desulfurization reactor is 0.5-2.0 MPa lower than that of the first fluidized bed desulfurization reactor.

The rich gas from the catalytic cracking fractionator or the mixture of the rich gas and the hydrogen donor is uniformly distributed in the second fluidized bed desulfurization reactor through a feeding distribution plate and is well contacted with the desulfurization adsorbent in the second fluidized bed desulfurization reactor.

After the sulfur-loaded desulfurization adsorbent is separated from the reaction oil gas in a settling section with an enlarged pipe diameter at the upper part of the second fluidized bed desulfurization reactor, the sulfur-loaded spent adsorbent is stripped to remove adsorbed hydrocarbons, lifted and then sent to a fluidized bed regenerator. The regenerated desulfurization adsorbent is sent to an adsorbent reducer for reduction, and the reduced desulfurization adsorbent is passed to the first fluidized bed desulfurization reactor from the bottom for reuse, so that a continuous cycle of adsorption desulfurization reaction, adsorbent regeneration, adsorbent reduction and adsorption desulfurization reaction is realized.

The reaction oil gas separated from the first fluidized bed desulfurization reactor is the desulfurized crude gasoline, and the reaction oil gas separated from the second fluidized bed desulfurization reactor is desulfurized rich gas.

Figure 1C:
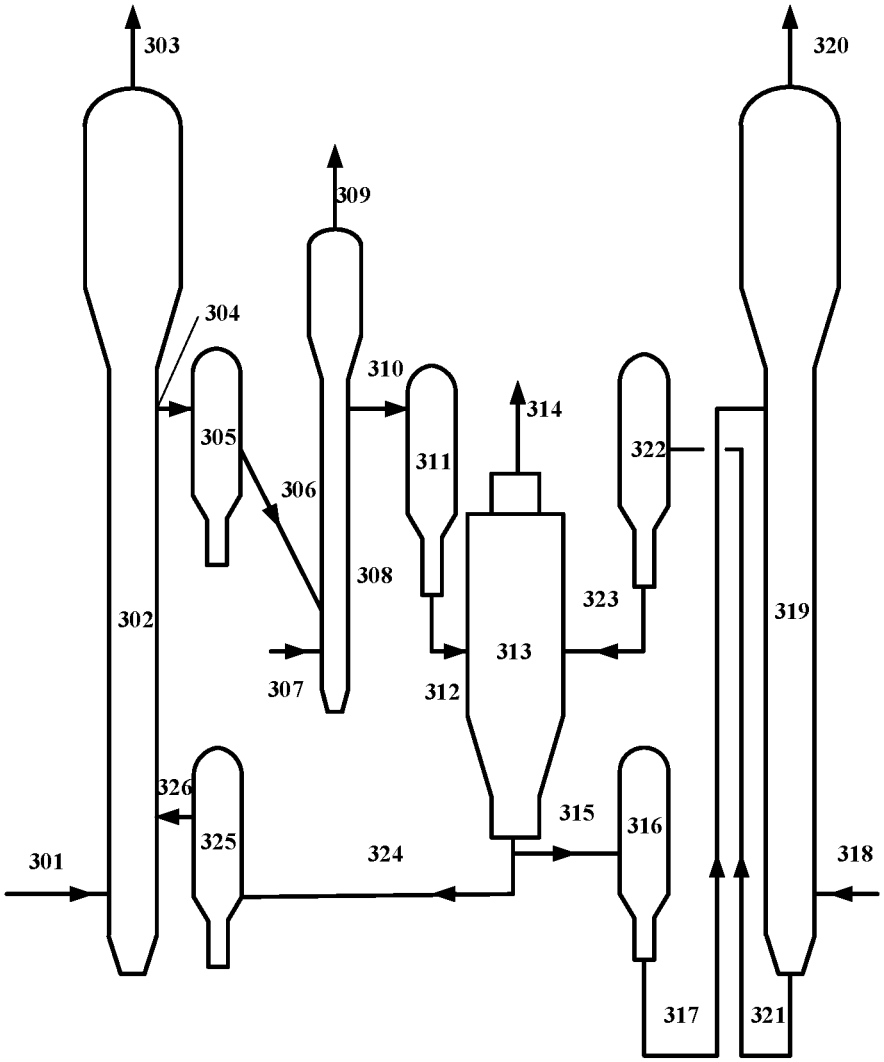
FIG. 1C is a schematic flow diagram of a preferred embodiment of an adsorption desulfurization unit according to a third type of embodiments of the present application.

FIG. 1C is a schematic flow diagram of a preferred embodiment of an adsorption desulfurization unit according to the third type of embodiments of the present application. As shown in FIG. 1C, the adsorption desulfurization unit comprises a first fluidized bed desulfurization reactor 302, an adsorbent transferring tank 305, a second fluidized bed desulfurization reactor 308, a reactor receiver 311, a lock hopper 313 for isolating the reaction-regeneration system, a regenerator feed tank 316, an adsorbent regenerator 319, and a regenerator receiver 322, which are communicated in sequence, wherein the regenerator receiver 322 is communicated with an adsorbent reducer 325 through the lock hopper 313, and the adsorbent reducer 325 is communicated with the bottom of the first fluidized bed desulfurization reactor 302 through a pipeline 326, to provide desulfurization adsorbent for the first fluidized bed desulfurization reactor.

The preheated crude gasoline from the catalytic cracking fractionator and hydrogen are introduced into the first fluidized bed desulfurization reactor 302 from the bottom through a pipeline 301, contacted with a desulfurization adsorbent in the first fluidized bed desulfurization reactor 302 for desulfurization reaction, and the adsorbent partially loaded with sulfur moves upwards along with the reaction material. After the reaction, the reaction oil gas and the adsorbent are passed to a settling separation section at the top of the first fluidized bed desulfurization reactor 302 for oil-adsorbent separation, and the separated reaction oil gas is a mixture of desulfurized crude gasoline and hydrogen and is sent to a subsequent product separation and stabilization system for treatment through a pipeline 303. The separated desulfurization adsorbent partially loaded with sulfur is transferred from the first fluidized bed desulfurization reactor to the adsorbent transferring tank 305 through a pipeline 304, and then transferred to the bottom of the second fluidized bed desulfurization reactor 308 from the adsorbent transferring tank 305 through a pipeline 306, a mixture of the rich gas from the catalytic cracking fractionator and hydrogen is introduced into the second fluidized bed desulfurization reactor 308 from the bottom through a pipeline 307, and is contacted with the desulfurization adsorbent for adsorption desulfurization reaction, sulfur in the rich gas is transferred to the desulfurization adsorbent, the reaction mixture is subjected to gas-solid separation in a settling zone at the upper part of the second fluidized bed desulfurization reactor 308, and the separated desulfurized rich gas is sent to a subsequent product separation and stabilization system through a pipeline 309 for treatment. The separated sulfur-loaded adsorbent is sent to a reactor receiver 311 through an adsorbent transferring horizontal pipe 310 at the upper part of the second fluidized bed desulfurization reactor 308, and sent to the lock hopper 313 through a pipeline 312 after being stripped in the reactor receiver 311, purged with nitrogen and then is changed to a low-pressure inactive atmosphere from a high-pressure hydrogen environment in the lock hopper, and the purged gas is sent to a combustion furnace for burning through a pipeline 314. The sulfur-loaded adsorbent is passed via a pipeline 315 to a regenerator feed tank 316, where it is lifted by a lift gas and passed via a pipeline 317 to an adsorbent regenerator 319. An oxygen-containing gas is introduced into the adsorbent regenerator from the bottom through a pipeline 318, the spent adsorbent is contacted with the oxygen-containing gas in the adsorbent regenerator 319 for sulfur burning and carbon burning to obtain a regenerated adsorbent, the sulfur-containing flue gas is separated from the regenerated adsorbent at the top of the adsorbent regenerator and then is sent to a sulfur production system or is subjected to alkali cleaning to remove SOx through a pipeline 320, the regenerated adsorbent is passed from the adsorbent regenerator to a regenerator receiver 322 through a pipeline 321, lifted by nitrogen and sent to the lock hopper 313 through a pipeline 323, stripped and purged with hydrogen, and then changed to a high-pressure hydrogen environment after a pressure increasing in the lock hopper 313, and then introduced into the adsorbent reducer 325 through a pipeline 324 for reduction, and the reduced regenerated adsorbent is introduced into the first fluidized bed desulfurization reactor 302 through a pipeline 326, so that a continuous adsorption desulfurization reaction is realized.

Fourth Type of Embodiments:

According to a fourth type of embodiments of the present application, the catalytic cracking light product is a rich gas and a crude gasoline from a catalytic cracking fractionator, and the step 1) further comprises:

1a) introducing the crude gasoline from the catalytic cracking fractionator into a first fluidized bed desulfurization reactor from the bottom, and contacting it with a desulfurization adsorbent introduced into the reactor from the bottom in the presence of hydrogen for desulfurization reaction;

1b) carrying out gas-solid separation on the reaction stream obtained at the upper part of the first fluidized bed desulfurization reactor to obtain a first reaction oil gas and a desulfurization adsorbent partially loaded with sulfur, and sending the desulfurization adsorbent partially loaded with sulfur into a second fluidized bed desulfurization reactor;

1c) introducing the rich gas from the catalytic cracking fractionator into the second fluidized bed desulfurization reactor from the bottom, and contacting it with the desulfurization adsorbent partially loaded with sulfur introduced into the reactor from the bottom for desulfurization reaction;

1d) carrying out gas-solid separation on the reaction stream obtained from the upper part of the second fluidized bed desulfurization reactor to obtain a second reaction oil gas and a sulfur-loaded adsorbent, and recycling the second reaction oil gas to the first fluidized bed desulfurization reactor, preferably to the upper part of the first fluidized bed desulfurization reactor;

1e) carrying out gas-liquid separation on the first reaction oil gas obtained in the step 1b) to obtain the desulfurized rich gas and the desulfurized crude gasoline; and 1f) sending the sulfur-loaded adsorbent obtained in the step 1d) to an adsorbent regenerator for regeneration by calcining in the presence of an oxygen-containing gas, and recycling the regenerated desulfurization adsorbent to the fluidized bed desulfurization reactor after reduction.

In a preferred embodiment, the crude gasoline from the catalytic cracking fractionator and a hydrogen donor are introduced into the bottom of the first fluidized bed desulfurization reactor, contacted with the desulfurization adsorbent for desulfurization while flowing upwards; the desulfurization adsorbent partially loaded with sulfur obtained by gas-solid separation at the top of the reactor is introduced into the second fluidized bed desulfurization reactor; the rich gas from the catalytic cracking fractionator and a hydrogen donor are introduced into the bottom of the second fluidized bed desulfurization reactor, contacted with the desulfurization adsorbent for desulfurization, and the reaction oil gas separated from the desulfurization adsorbent after reaction is recycled to the upper part of the first fluidized bed desulfurization reactor; and the reaction oil gas obtained by gas-solid separation in the first fluidized bed desulfurization reactor is subjected to gas-liquid separation to obtain the desulfurized rich gas and the desulfurized crude gasoline. The desulfurized rich gas is introduced into an absorber from the bottom and contacted with the desulfurized crude gasoline introduced into the absorber from the top for mass transfer, the overhead stream of the absorber is introduced into a reabsorber from the bottom and contacted with a light cycle oil from a catalytic cracking fractionator in a countercurrent manner for mass transfer, the desulfurized dry gas is obtained from the top of the reabsorber, and the enriched light cycle oil obtained at the bottom of the reabsorber is recycled to the catalytic cracking fractionator; and the bottom product of the absorber is sent to a stabilizer after passing through a desorber, fractionated in the stabilizer to obtain the desulfurized liquefied gas and the desulfurized stabilized gasoline, and the overhead gas of the desorber is recycled to the absorber.

In a further preferred embodiment, a mixture of the crude gasoline from the catalytic cracking fractionator and the hydrogen donor is preheated to a required temperature, introduced into the first fluidized bed desulfurization reactor from the bottom, and contacted with the desulfurization adsorbent in the first fluidized bed desulfurization reactor for desulfurization while flowing from bottom to top. The reaction mixture is subjected to gas-solid separation at the top of the first fluidized bed desulfurization reactor, the resulting desulfurization adsorbent partially loaded with sulfur is introduced into the second fluidized bed desulfurization reactor, contacted with the rich gas and/or a mixture of the rich gas and the hydrogen donor preheated to a required temperature that is introduced into the reactor from the bottom for desulfurization reaction, the desulfurized rich gas is recycled to the upper part of the first fluidized bed desulfurization reactor from the second fluidized bed desulfurization reactor, the spent adsorbent obtained after the reaction in the second fluidized bed desulfurization reactor is separated from the reaction oil gas, changed to a low-pressure oxygen atmosphere from a high-pressure hydrogen environment in the locking hopper, and then introduced into an adsorbent regenerator for regeneration by calcining in the presence of an oxygen-containing gas, and the regenerated desulfurization adsorbent is recycled to the bottom of the first fluidized bed desulfurization reactor for reuse after reduction.

The reaction oil gas obtained by the separation at the top of the first fluidized bed desulfurization reactor is introduced into a gas-liquid separation tank, and separated by condensation and cooling to obtain the desulfurized rich gas and the desulfurized crude gasoline, the desulfurized rich gas is introduced into an absorber from the bottom and contacted with the crude gasoline and/or a part of stabilized gasoline introduced into the absorber from the top in a countercurrent manner, the overhead gas product of the absorber is introduced into a reabsorber and absorbed using a light cycle oil from a catalytic cracking fractionator and separated therein, the desulfurized dry gas is obtained at the top of the reabsorber, an enriched light cycle oil is obtained at the bottom of the reabsorber, and the enriched light cycle oil is recycled to the catalytic cracking fractionator. The bottom product of the absorber is sent to a stabilizer after passing through a desorber, fractionated in the stabilizer to obtain the desulfurized liquefied gas and the desulfurized stabilized gasoline, and the overhead gas of the desorber is mixed with the desulfurized rich gas and then passed to the absorber.

In a still further preferred embodiment, the crude gasoline obtained from the catalytic cracking fractionator is heated to 100-500° C. The heated crude gasoline is used as a feedstock of the first fluidized bed desulfurization reactor, the crude gasoline, preferably a mixture of the crude gasoline and a hydrogen donor is introduced into the first fluidized bed desulfurization reactor from the bottom, and the mixture of the crude gasoline and the hydrogen donor is uniformly distributed in the reactor through a feeding distribution plate and is well contacted with a desulfurization adsorbent in the reactor.

The desulfurization adsorbent is introduced to the first fluidized bed desulfurization reactor from the bottom, which is preferably a dense bed reactor.

Preferably, the sulfur-containing crude gasoline is contacted with the desulfurization adsorbent for adsorption desulfurization reaction in the presence of hydrogen and under the reaction conditions including a temperature of 200-550° C., preferably 300-500° C., a pressure of 0.5-5 MPa, preferably 1.0-3.5 MPa, a weight hourly space velocity of 0.1-100 $h^{-1}$, preferably 1-10 $h^{-1}$ and a volume ratio of the hydrogen donor to the gasoline feedstock of 0.01-1000, preferably 0.05-500.

In the first fluidized bed desulfurization reactor, after the desulfurization adsorbent is separated from the reaction oil gas, the sulfur-loaded spent adsorbent is passed to the second fluidized bed desulfurization reactor.

The rich gas from the catalytic cracking fractionator and/or the hydrogen donor is heated to 100-500° C., and the sulfur content of the rich gas is 30 μg/g or higher, particularly 50 μg/g or higher. The heated rich gas and/or mixture thereof with the hydrogen donor is introduced into the second fluidized bed reactor from the bottom thereof, and the sulfur-containing rich gas is contacted with the adsorbent partially loaded with sulfur from the first reactor for adsorption desulfurization reaction under the reaction conditions including a temperature of 300-550° C., preferably 350-500° C., an absolute pressure of 0.5-5 MPa, preferably 1.0-3.5 MPa, a weight hourly space velocity of 0.1-100 $h^{-1}$, preferably 2-20 $h^{-1}$, and a volume ratio of the hydrogen donor or hydrogen to the rich gas feedstock of 0.01-500, preferably 0.05-300.

The mixture of the rich gas and/or the hydrogen donor is uniformly distributed in the second fluidized bed desulfurization reactor through a feeding distribution plate and is well contacted with the desulfurization adsorbent in the second fluidized bed desulfurization reactor.

After the sulfur-loaded desulfurization adsorbent in the second fluidized bed desulfurization reactor is separated from the reaction oil gas, the spent adsorbent is stripped to remove adsorbed hydrocarbons, and then lifted and sent to the adsorbent regenerator. The regenerated desulfurization adsorbent is sent to an adsorbent reducer for reduction, and the reduced desulfurization adsorbent is passed to the first fluidized bed desulfurization reactor from the bottom for reuse, so that a continuous cycle of adsorption desulfurization reaction, adsorbent regeneration, adsorbent reduction and adsorption desulfurization reaction is realized.

The reaction oil gas obtained by the separation in the first fluidized bed desulfurization reactor is passed to a gas-liquid separation tank after heat exchange to obtain the desulfurized rich gas and the desulfurized crude gasoline. The operating pressure of the gas-liquid separation tank is 0.2-4.0 MPa, preferably 0.5-3.0 MPa, and the operating temperature is 20-300° C., preferably 50-200° C.

Figure 1D:
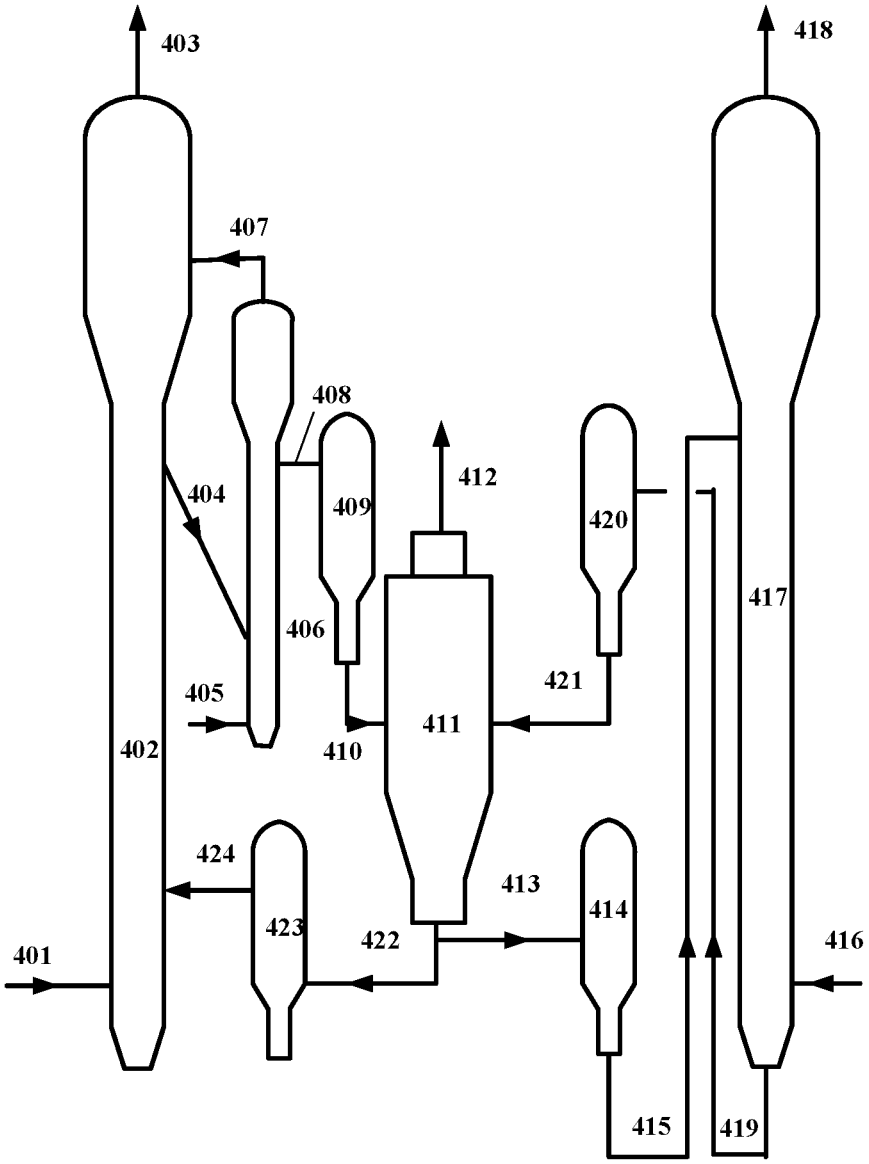
FIG. 1D is a schematic flow diagram of a preferred embodiment of an adsorption desulfurization unit according to a fourth type of embodiments of the present application.

FIG. 1D is a schematic flow diagram of a preferred embodiment of an adsorption desulfurization unit according to a fourth type of embodiments of the present application. As shown in FIG. 1D, the adsorption desulfurization unit comprises a first fluidized bed desulfurization reactor 402, a second fluidized bed desulfurization reactor 406, a reactor receiver 409, a lock hopper 411 for isolating the reaction-regeneration system, a regenerator feed tank 414, an adsorbent regenerator 417 and a regenerator receiver 420, which are communicated in sequence, wherein the regenerator receiver 420 is communicated with an adsorbent reducer 423 through the lock hopper 411, and the adsorbent reducer 423 is communicated with the bottom of the first fluidized bed desulfurization reactor 402 to provide a desulfurization adsorbent to the first fluidized bed desulfurization reactor 402.

The preheated crude gasoline from the catalytic cracking fractionator and hydrogen are introduced into the bottom of the first fluidized bed desulfurization reactor 402 through a pipeline 401, contacted with a desulfurization adsorbent in the first fluidized bed desulfurization reactor 402 for desulfurization reaction, and the adsorbent partially loaded with sulfur moves upwards along with the reaction material. After the reaction, the reaction oil gas and the adsorbent are passed to a settling separation section at the top of the first fluidized bed desulfurization reactor 402 for oil-adsorbent separation, the resulting reaction oil gas is a mixture of desulfurized rich gas, desulfurized crude gasoline and hydrogen, the mixture is sent to a gas-liquid separation tank (not shown) through a pipeline 403, and the desulfurized rich gas and the desulfurized crude gasoline obtained by condensation gas-liquid separation are sent to a subsequent product separation and stabilization system for treatment. The desulfurization adsorbent partially loaded with sulfur is transferred from the first fluidized bed desulfurization reactor to the bottom of the second fluidized bed desulfurization reactor 406 through a pipeline 404, a mixture of the rich gas from the catalytic cracking fractionator and hydrogen is introduced into the second fluidized bed desulfurization reactor 406 from the bottom through a pipeline 405 and contacted with the desulfurization adsorbent for adsorption desulfurization reaction, the reaction mixture is subjected to gas-solid separation in a settling zone at the upper part of the second fluidized bed desulfurization reactor, the desulfurized rich gas obtained after separation is sent to the first fluidized bed desulfurization reactor 402 through a pipeline 407, the separated sulfur-loaded adsorbent is sent to a reactor receiver 409 through an adsorbent transferring horizontal pipe 408 at the upper part of the second fluidized bed desulfurization reactor, and sent to a lock hopper 411 through a pipeline 410 after being stripped in the reactor receiver 409, purged with nitrogen and is changed to a low-pressure inactive atmosphere from a high-pressure hydrogen environment in the lock hopper, and the purged gas is sent to a combustion furnace through a pipeline 412 for burning. The sulfur-loaded adsorbent is passed via a pipeline 413 to a regenerator feed tank 414 and the sulfur-loaded adsorbent is lifted by a lift gas and passed via a pipeline 415 to an adsorbent regenerator 417. An oxygen-containing gas is introduced into the adsorbent regenerator from the bottom through a pipeline 416, the spent adsorbent is contacted with the oxygen-containing gas in the adsorbent regenerator 417 for sulfur burning and carbon burning to obtain a regenerated adsorbent, the sulfur-containing flue gas is separated from the regenerated adsorbent at the top of the adsorbent regenerator and then is sent to a sulfur production system or is subjected to alkali cleaning to remove SOx through a pipeline 418, the regenerated adsorbent is passed from the adsorbent regenerator to a regenerator receiver 420 through a pipeline 419, lifted by nitrogen and sent to the lock hopper 411 through a pipeline 421, stripped and purged with hydrogen, and then changed to a high-pressure hydrogen environment after a pressure increasing in the lock hopper 411, and then introduced into the adsorbent reducer 423 for reduction through a pipeline 422, and the reduced regenerated adsorbent is introduced into the first fluidized bed desulfurization reactor 402 through a pipeline 424, so that a continuous adsorption desulfurization reaction is realized.

Fifth Type of Embodiments:

According to a fifth type of embodiments of the method according to the present application, the catalytic cracking light product is a rich gas and a crude gasoline from a catalytic cracking fractionator, and the step 1) further comprises:

1a) introducing the crude gasoline from the catalytic cracking fractionator into a first fluidized bed desulfurization reactor from the bottom, and contacting it with a desulfurization adsorbent introduced into the reactor from the bottom in the presence of hydrogen for desulfurization reaction;

1b) withdrawing a part of the desulfurization adsorbent from the middle-lower part of the first fluidized bed desulfurization reactor and passing it to the bottom of a second fluidized bed desulfurization reactor, contacting it with the rich gas from the catalytic cracking fractionator introduced into the reactor from the bottom for desulfurization reaction, and recycling the reaction stream obtained from the upper part of the second fluidized bed desulfurization reactor to the first fluidized bed desulfurization reactor, preferably to the upper part of the first fluidized bed desulfurization reactor;

1c) carrying out gas-solid separation on the reaction stream obtained at the upper part of the first fluidized bed desulfurization reactor to obtain a reaction oil gas and a sulfur-loaded adsorbent;

1d) carrying out gas-liquid separation on the reaction oil gas obtained in the step 1c) to obtain the desulfurized rich gas and the desulfurized crude gasoline; and 1e) sending the sulfur-loaded adsorbent obtained in the step 1c) to an adsorbent regenerator for regeneration by calcining in the presence of an oxygen-containing gas, and recycling the regenerated desulfurization adsorbent to the first fluidized bed desulfurization reactor after reduction.

In a preferred embodiment, the crude gasoline from the catalytic cracking fractionator is introduced into the first fluidized bed desulfurization reactor from the bottom, contacted with the desulfurization adsorbent for desulfurization while flowing upwards; a part of the desulfurization adsorbent is introduced into the second fluidized bed desulfurization reactor under the control of a slide valve, and contacted with the rich gas from the catalytic cracking fractionator preheated to a required temperature for desulfurization reaction, the reacted rich gas and the desulfurization adsorbent are returned to the upper part of the first fluidized bed desulfurization reactor, and subjected to gas-solid separation in a settling zone at the upper part of the first fluidized bed desulfurization reactor; the separated spent adsorbent is regenerated in an adsorbent regenerator by calcining in the presence of an oxygen-containing gas, and the regenerated desulfurization adsorbent is recycled to the bottom of the first fluidized bed desulfurization reactor for reuse after reduction; and the separated reaction oil gas is separated into the desulfurized rich gas and the desulfurized crude gasoline in a gas-liquid separation tank, which are separately sent to an absorption stabilization system for further separation to obtain the desulfurized dry gas, the desulfurized liquefied gas and the desulfurized stabilized gasoline.

In another preferred embodiment, a settling zone and a gas-solid separator are provided at the upper part of the second fluidized bed desulfurization reactor, the reaction oil gas and the desulfurization adsorbent in the second fluidized bed desulfurization reactor are subjected to gas-solid separation, the separated desulfurization adsorbent is recycled to the upper part of the first fluidized bed desulfurization reactor, and the separated reaction oil gas is directly sent to the absorption stabilization system for further separation. The reaction oil gas obtained by gas-solid separation at the top of the first fluidized bed desulfurization reactor is the desulfurized crude gasoline.

In a still further preferred embodiment, the crude gasoline from the catalytic cracking fractionator, or a mixture of the crude gasoline and a hydrogen donor, is preheated to 100-500° C., preferably 200-450° C. The heated crude gasoline is used as a feedstock of the first fluidized bed desulfurization reactor, and introduced into the first fluidized bed desulfurization reactor from the bottom, a desulfurization adsorbent is introduced into the first fluidized bed desulfurization reactor from the bottom, and the reaction oil gas is contacted with the desulfurization adsorbent for adsorption desulfurization reaction. The reaction stream flows from bottom to top, and at a position of 20-60% of the height from bottom to top of the first fluidized bed desulfurization reactor, a part of the desulfurization adsorbent partially loaded with sulfur is withdrawn and then introduced into the second fluidized bed desulfurization reactor under the control of a slide valve, contacted with the rich gas from the catalytic cracking fractionator or a mixture of the rich gas and a hydrogen donor preheated to a required temperature that is introduced into the reactor from the bottom for desulfurization reaction, the reacted rich gas and the desulfurization adsorbent are returned to the upper part of the first fluidized bed desulfurization reactor, the reaction oil gas and the desulfurization adsorbent are separated in a settling zone with an enlarged pipe diameter at the upper part of the first fluidized bed desulfurization reactor, and the settling zone may be further provided with a gas-solid separation equipment such as a cyclone separator or a filter. The separated reaction oil gas is sent to a gas-liquid separation tank for separation into desulfurized crude gasoline and desulfurized rich gas. The separated spent adsorbent with high sulfur loading is introduced into an adsorbent regenerator to contact with oxygen for regeneration, and the regenerated adsorbent is recycled to the first fluidized bed desulfurization reactor for reuse after reduction.

In another further preferred embodiment, the reaction oil gas and the desulfurization adsorbent are subjected to gas-solid separation in a settling zone with an enlarged pipe diameter at the upper part of the second fluidized bed desulfurization reactor, and the settling zone may be further provided with a gas-solid separation equipment such as a cyclone separator or a filter. The separated desulfurization adsorbent is recycled to the upper part of the first fluidized bed desulfurization reactor, and the separated reaction oil gas is the desulfurized rich gas, which is directly sent to the absorption stabilization system for further separation. The reaction oil gas obtained by gas-solid separation at the top of the first fluidized bed desulfurization reactor is the desulfurized crude gasoline.

In a particularly preferred embodiment, the crude gasoline, or a mixture of the crude gasoline and a hydrogen donor, is introduced into the first fluidized bed desulfurization reactor from the bottom, the mixture of the crude gasoline and the hydrogen donor is uniformly distributed in the reactor through a feeding distribution plate, and is well contacted with the desulfurization adsorbent in the reactor. The sulfur-containing crude gasoline is contacted with the desulfurization adsorbent for adsorption desulfurization reaction under the reaction conditions including a temperature of 200-550° C., preferably 300-500° C., a pressure of 0.5-5 MPa, preferably 1.0-3.5 MPa, a weight hourly space velocity of 0.1-100 $h^{-1}$, preferably 1-10 $h^{-1}$ and a volume ratio of the hydrogen donor to the gasoline feedstock of 0.01-1000, preferably 0.05-500.

In the first fluidized bed desulfurization reactor, the desulfurization adsorbent partially loaded with sulfur is passed to the second fluidized bed desulfurization reactor under the control of a slide valve, and is contacted with the rich gas or a mixture of the rich gas and a hydrogen donor introduced into the reactor from the bottom for desulfurization reaction.

The sulfur content of the rich gas is 30 μg/g or higher, particularly 50 μg/g or higher. The preheating temperature of the rich gas or the rich gas and the hydrogen donor is 100-500° C., preferably 250-450° C. The rich gas or the mixture of the rich gas and the hydrogen donor is uniformly distributed in the second fluidized bed desulfurization reactor through a feeding distribution plate and is well contacted with the desulfurization adsorbent in the second fluidized bed desulfurization reactor.

The mixture of the heated rich gas and/or the hydrogen donor is introduced into the second fluidized bed desulfurization reactor from the bottom thereof, and the sulfur-containing rich gas is contacted with the adsorbent partially loaded with sulfur from the first reactor for adsorption desulfurization reaction under the reaction conditions including a temperature of 250-550° C., preferably 350-500° C., a pressure of 0.5-5 MPa, preferably 1.0-3.5 MPa, a weight hourly space velocity of 0.1-100 $h^{-1}$, preferably 1-20 $h^{-1}$ and a hydrogen-to-oil molar ratio of 0.01-1000, preferably 0.05-300.

After the spent desulfurization adsorbent in the first fluidized bed desulfurization reactor is separated from the reaction oil gas, the sulfur-loaded spent adsorbent is stripped to remove adsorbed hydrocarbons, and then lifted and sent to a fluidized bed regenerator. The regenerated desulfurization adsorbent is sent to an adsorbent reducer for reduction, and the reduced desulfurization adsorbent is passed to the first fluidized bed desulfurization reactor from the bottom for reuse, so that a continuous cycle of adsorption desulfurization reaction, adsorbent regeneration, adsorbent reduction and adsorption desulfurization reaction is realized.

And when the oil gas and the desulfurization adsorbent in the second fluidized bed desulfurization reactor are returned to the upper part of the first fluidized bed desulfurization reactor, the reaction oil gas separated from the first fluidized bed desulfurization reactor is sent to a gas-liquid separation tank after heat exchange to obtain the desulfurized rich gas and the desulfurized crude gasoline. The operating pressure of the gas-liquid separation tank is 0.2-4.0 MPa, preferably 0.5-3.0 MPa, and the operating temperature is 20-300° C., preferably 50-200° C.

When the upper part of the second fluidized bed desulfurization reactor is provided with a settling section with an enlarged pipe diameter and a gas-solid separation equipment, the reaction oil gas and the desulfurization adsorbent in the second fluidized bed desulfurization reactor are subjected to gas-solid separation at the top of the reactor, the separated reaction oil gas is the desulfurized rich gas, and the separated desulfurization adsorbent is recycled to the upper part of the first fluidized bed desulfurization reactor.

Figure 1E:
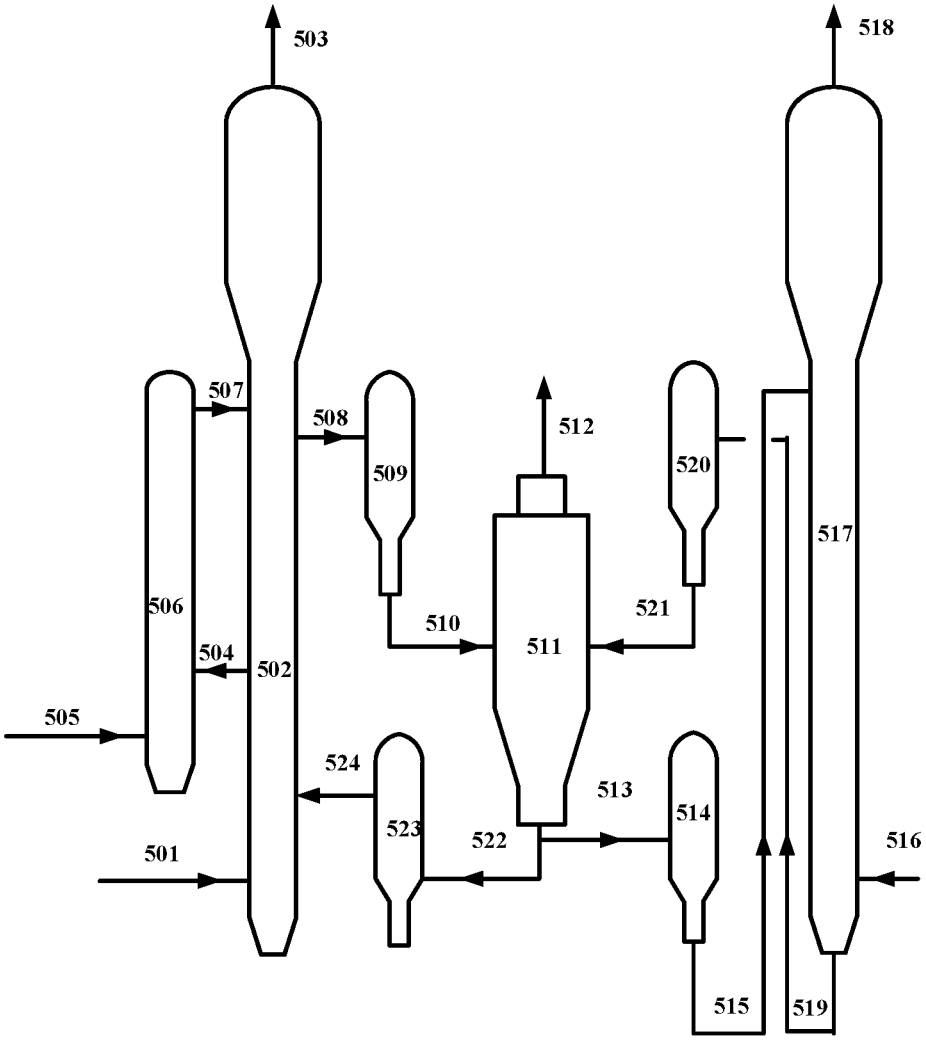
FIG. 1Ea is a schematic flow diagram of a preferred embodiment of an adsorption desulfurization unit according to a fifth type of embodiments of the present application.
Figure 1E:
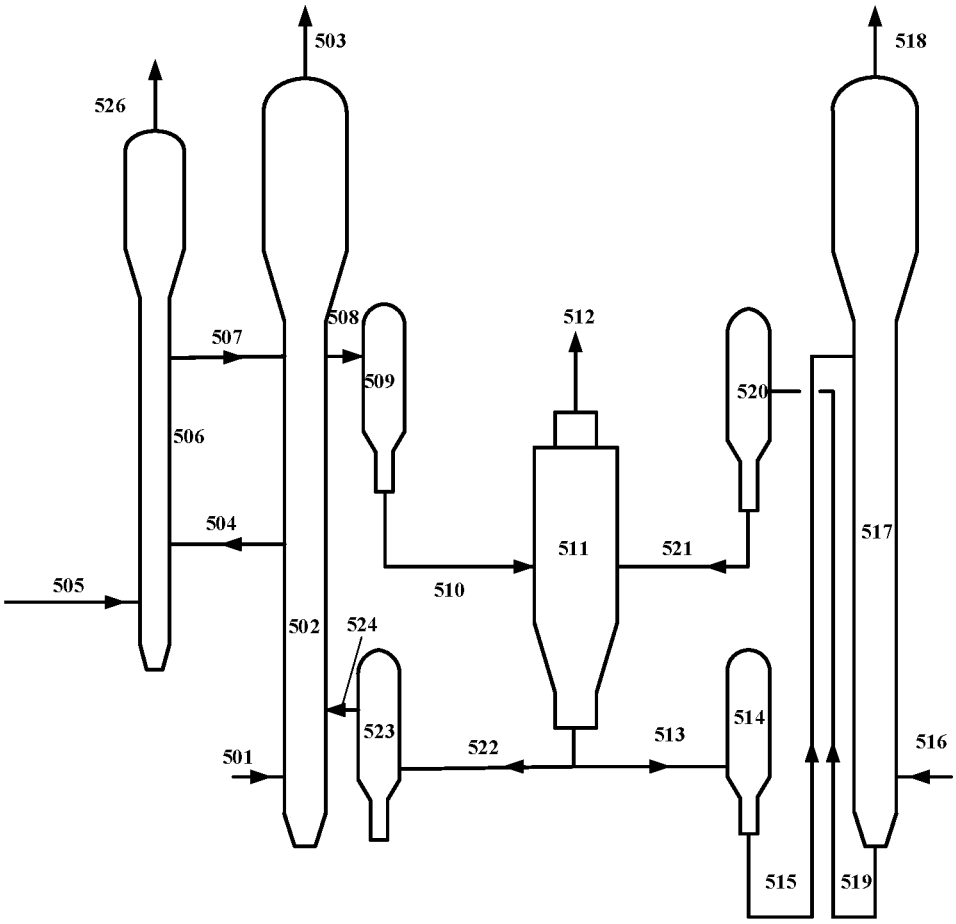

FIG. 1Ea is a schematic flow diagram of a preferred embodiment of an adsorption desulfurization unit according to a fifth type of embodiments of the present application. As shown in FIG. 1Ea, the adsorption desulfurization unit comprises a first fluidized bed desulfurization reactor 502, a reactor receiver 509, a lock hopper 511 for isolating the reaction-regeneration system, a regenerator feed tank 514 and an adsorbent regenerator 517, which are communicated in sequence, wherein the adsorbent regenerator 517 is communicated sequentially with a regenerator receiver 520, the lock hopper 511 and an adsorbent reducer 523; the adsorbent reducer 523 is communicated with the bottom of the first fluidized bed desulfurization reactor 502 to provide a desulfurization adsorbent thereto. The middle-lower part of the first fluidized bed desulfurization reactor 502 is in communication with the bottom of the second fluidized bed desulfurization reactor 506, and the top of the second fluidized bed desulfurization reactor is in communication with the upper part of the first fluidized bed desulfurization reactor 502.

The preheated crude gasoline from the catalytic cracking fractionator and hydrogen are introduced into the bottom of the first fluidized bed desulfurization reactor 502 through a pipeline 501, contacted with a desulfurization adsorbent in the first fluidized bed desulfurization reactor 502 for desulfurization reaction, and the adsorbent partially loaded with sulfur moves upwards along with the reaction material. At a position of 20-60% of the height from bottom to top of the first fluidized bed desulfurization reactor 502, a part of the desulfurization adsorbent is withdrawn and then passed to the second fluidized bed desulfurization reactor 506 through a pipeline 504 under the control of a slide valve, and contacted with the rich gas and/or a mixture thereof with the hydrogen donor preheated to a required temperature that is introduced into the reactor from the bottom through a pipeline 505 for desulfurization reaction.

The reacted rich gas and the desulfurization adsorbent are returned to the upper part of the first fluidized bed desulfurization reactor 502, the reaction oil gas and the adsorbent in the first fluidized bed desulfurization reactor 502 are passed to a settling separation section at the top of the reactor for oil-adsorbent separation, the resulting reaction oil gas is a mixture of the desulfurized rich gas, the desulfurized crude oil gas and hydrogen, the mixture is sent to a gas-liquid separation tank (not shown) through a pipeline 503, and the desulfurized rich gas and the desulfurized crude gasoline obtained by condensation gas-liquid separation are sent to a subsequent product separation and stabilization system for treatment. The sulfur-loaded desulfurization adsorbent is sent to a reactor receiver 509 from the first fluidized bed desulfurization reactor through an adsorbent transferring horizontal pipe 508, and then sent to a lock hopper 511 through a pipeline 510 after being stripped in the reactor receiver 509, purged with nitrogen and then is changed to a low-pressure inactive atmosphere from a high-pressure hydrogen environment in the lock hopper, and the purged gas is sent to a combustion furnace for burning through a pipeline 512. The sulfur-loaded adsorbent is passed via a pipeline 513 to a regenerator feed tank 514, where it is lifted by a lift gas and passed via a pipeline 515 to an adsorbent regenerator 517. An oxygen-containing gas is introduced into the adsorbent regenerator from the bottom through a pipeline 516, the spent adsorbent is contacted with the oxygen-containing gas in the adsorbent regenerator 517 for sulfur burning and carbon burning to obtain a regenerated adsorbent, the sulfur-containing flue gas is separated from the regenerated adsorbent at the top of the adsorbent regenerator and then is sent to a sulfur production system or is subjected to alkali cleaning to remove SOx through a pipeline 518, the regenerated adsorbent is passed from the adsorbent regenerator to a regenerator receiver 520 through a pipeline 519, lifted by nitrogen and sent to the lock hopper 511 through a pipeline 521, stripped and purged with hydrogen and then changed to a high-pressure hydrogen environment after a pressure increasing in the lock hopper 511, introduced into a reducer 523 through a pipeline 522 for reduction, and the reduced regenerated adsorbent is introduced into the first fluidized bed desulfurization reactor 502 through a pipeline 524, so that a continuous adsorption desulfurization reaction is realized.

FIG. 1Eb is a schematic flow diagram of another preferred embodiment of an adsorption desulfurization unit according to a fifth type of embodiments of the present application. As shown in FIG. 1Eb, a settling section with an enlarged pipe diameter is provided at the upper part of the second fluidized bed desulfurization reactor 506, a gas-solid separator is provided in the settling section, the reaction oil gas and the desulfurization adsorbent in the second fluidized bed desulfurization reactor 506 are subjected to gas-solid separation at the upper part thereof, and the resulting desulfurized rich gas is sent to a subsequent product separation and stabilization system through a pipeline 526 for treatment; the separated desulfurization adsorbent is returned to the upper part of the first fluidized bed desulfurization reactor 502. The reaction oil gas separated from the top of the first fluidized bed desulfurization reactor 502 is a mixture of desulfurized crude gasoline and hydrogen, and is sent to a subsequent product separation and stabilization system for treatment through a pipeline 503.

Sixth Type of Embodiments:

According to a sixth type of embodiments of the method according to the present application, the catalytic cracking light product is a rich gas and a crude gasoline from a catalytic cracking fractionator, and the step 1) further comprises:

1a) introducing the crude gasoline from the catalytic cracking fractionator into a first fluidized bed desulfurization reactor from the bottom, and contacting it with a desulfurization adsorbent introduced into the reactor from the bottom in the presence of hydrogen for desulfurization reaction;

1b) carrying out gas-solid separation on the reaction stream obtained at the upper part of the first fluidized bed desulfurization reactor to obtain the desulfurized crude gasoline and a sulfur-loaded adsorbent, and sending a part of the resulting sulfur-loaded adsorbent to the upper part of a second fluidized bed desulfurization reactor;

1c) introducing the rich gas from the catalytic cracking fractionator into the second fluidized bed desulfurization reactor from the bottom, contacting it with the sulfur-loaded adsorbent introduced into the reactor from the upper part thereof in a countercurrent manner for desulfurization reaction, to obtain the desulfurized rich gas at the top of the second fluidized bed desulfurization reactor, and withdrawing the reacted sulfur-loaded adsorbent from the bottom of the second fluidized bed desulfurization reactor and recycling it to the first fluidized bed desulfurization reactor; and 1e) sending the rest of the sulfur-loaded adsorbent obtained in the step 1b) to an adsorbent regenerator for regeneration by calcining in the presence of an oxygen-containing gas, and recycling the regenerated desulfurization adsorbent to the first fluidized bed desulfurization reactor after reduction.

In a preferred embodiment, the crude gasoline from the catalytic cracking fractionator is introduced into the first fluidized bed desulfurization reactor from the bottom, and contacted with the desulfurization adsorbent in the presence of hydrogen for desulfurization while flowing upwards in a cocurrent manner; and the reaction oil gas and the desulfurization adsorbent are subjected to gas-solid separation in a settling zone at the upper part of the first fluidized bed desulfurization reactor, a part of the sulfur-loaded adsorbent is introduced into the upper part of the second fluidized bed desulfurization reactor from the top of an adsorbent bed layer through a slide valve, another part of the sulfur-loaded adsorbent is regenerated in an adsorbent regenerator by calcining, and the regenerated desulfurization adsorbent is recycled to the bottom of the first fluidized bed desulfurization reactor for reuse after reduction; the rich gas from the catalytic cracking fractionator is introduced into the second fluidized bed desulfurization reactor from the bottom, and contacted with the desulfurization adsorbent in a countercurrent manner for adsorption desulfurization reaction, and the desulfurization adsorbent is recycled to the first fluidized bed desulfurization reactor from the bottom of the second fluidized bed desulfurization reactor after the reaction; and the desulfurized crude gasoline obtained from the top of the first fluidized bed desulfurization reactor and the desulfurized rich gas obtained from the top of the second fluidized bed desulfurization reactor are separately sent to an absorption stabilization unit for further separation to obtain the desulfurized dry gas, the desulfurized liquefied gas and the desulfurized stabilized gasoline.

In a further preferred embodiment, a mixture of the crude gasoline from the catalytic cracking fractionator and a hydrogen donor is preheated to 100-500° C., preferably 200-450° C. The heated crude gasoline is used as a feedstock of the first fluidized bed desulfurization reactor, and introduced into the reactor from the bottom thereof, a desulfurization adsorbent is introduced into the first fluidized bed desulfurization reactor from the bottom, the reaction oil gas is contacted with the desulfurization adsorbent for adsorption desulfurization reaction, while the reaction stream flowing upwards in a concurrent manner, the reaction oil gas and the desulfurization adsorbent are subjected to gas-solid separation in a settling zone at the upper part of the first fluidized bed desulfurization reactor, a part of the separated sulfur-loaded adsorbent is passed to the second fluidized bed desulfurization reactor under the control of a slide valve, another part of the sulfur-loaded adsorbent is regenerated in an adsorbent regenerator by calcining in the presence of an oxygen-containing gas, and the regenerated desulfurization adsorbent is recycled to the bottom of the first fluidized bed desulfurization reactor for reuse after reduction. The reaction oil gas obtained by the separation in the first fluidized bed desulfurization reactor is a mixture of desulfurized crude gasoline and hydrogen and is sent to a subsequent absorption stabilization unit for further separation.

In a still further preferred embodiment, the crude gasoline, or a mixture of the crude gasoline and a hydrogen donor, is introduced into the first fluidized bed desulfurization reactor from the bottom, the mixture of the crude gasoline and the hydrogen donor is uniformly distributed in the reactor through a feeding distribution plate, and is well contacted with the desulfurization adsorbent in the reactor. The reaction oil gas and the desulfurization adsorbent are subjected to gas-solid separation in a settling zone with an enlarged pipe diameter at the upper part of the first fluidized bed desulfurization reactor, wherein the settling zone may be further provided with a gas-solid separation equipment such as a cyclone separator or a filter. The desulfurization adsorbent is introduced into the second fluidized bed reactor from the upper part, and contacted with the rich gas or a mixture of the rich gas and a hydrogen donor preheated to a required temperature that is introduced into the reactor from the bottom in a countercurrent manner for desulfurization reaction, and the reaction oil gas and the desulfurization adsorbent are subjected to gas-solid separation in a settling zone at the upper part of the second fluidized bed desulfurization reactor, wherein a gas-solid separation equipment such as a filter and the like is preferably provided in the settling zone. The separated reaction oil gas is the desulfurized rich gas, and is introduced into an absorption stabilization system for further separation.

Particularly preferably, the first fluidized bed desulfurization reactor is communicated at a position of 50-90% of the height from bottom to top thereof with the second fluidized bed desulfurization reactor at a position of 80-90% of the height from bottom to top thereof.

Particularly preferably, the feeding gas velocity of the first fluidized bed desulfurization reactor is 0.25-10 m/s, and the feeding gas velocity of the second fluidized bed desulfurization reactor is 0.05-1.5 m/s.

In a particularly preferred embodiment, the first fluidized bed desulfurization reactor is operated at conditions including a temperature of 200-550° C., preferably 300-500° C., a pressure of 0.5-5 MPa, preferably 1.0-3.5 MPa, and a weight hourly space velocity of 0.1-100 $h^{-1}$, preferably 1-10 $h^{-1}$. Preferably, in the presence of hydrogen, the sulfur-containing crude gasoline is contacted with the desulfurization adsorbent for adsorption desulfurization reaction at a volume ratio of the hydrogen donor to the gasoline feedstock of 0.01-1000, preferably 0.05-500.

In a particularly preferred embodiment, the rich gas from the catalytic cracking fractionator, or a mixture of the rich gas and a hydrogen donor, is heated to 100-500° C., preferably 250-450° C. The heated rich gas or the heated mixture of the rich gas and the hydrogen donor is introduced into the second fluidized bed desulfurization reactor from the bottom, and the rich gas is contacted with the sulfur-loaded adsorbent flowing from top to bottom in a countercurrent manner for adsorption desulfurization reaction under the reaction conditions including a temperature of 200-550° C., preferably 300-500° C., a pressure of 0.5-5 MPa, preferably 1.0-3.5 MPa, a weight hourly space velocity of 0.1-100 $h^{-1}$, preferably 1-10 $h^{-1}$, and a volume ratio of the hydrogen donor or hydrogen to the rich gas feedstock of 0.01-1000, preferably 0.05-500.

The mixture of the rich gas and/or the hydrogen donor is uniformly distributed in the second fluidized bed desulfurization reactor through a feeding distribution plate and is well contacted with the desulfurization adsorbent in the second fluidized bed desulfurization reactor.

The sulfur-loaded adsorbent in the second fluidized bed desulfurization reactor is recycled after the reaction to the first fluidized bed desulfurization reactor from the bottom. After the sulfur-loaded adsorbent is separated from the reaction oil gas at the upper part of the first fluidized bed desulfurization reactor, the spent adsorbent is stripped to remove adsorbed hydrocarbons, and then lifted and sent to the adsorbent regenerator. The regenerated desulfurization adsorbent is sent to an adsorbent reducer for reduction, and the reduced desulfurization adsorbent is passed to the first fluidized bed desulfurization reactor from the bottom for reuse, so that a continuous cycle of adsorption desulfurization reaction, adsorbent regeneration, adsorbent reduction and adsorption desulfurization reaction is realized.

The reaction oil gas obtained from the top of the first fluidized bed desulfurization reactor is a mixture of desulfurized crude gasoline and hydrogen, and the desulfurized rich gas is obtained from the top of the second fluidized bed desulfurization reactor.

Figure 1F:
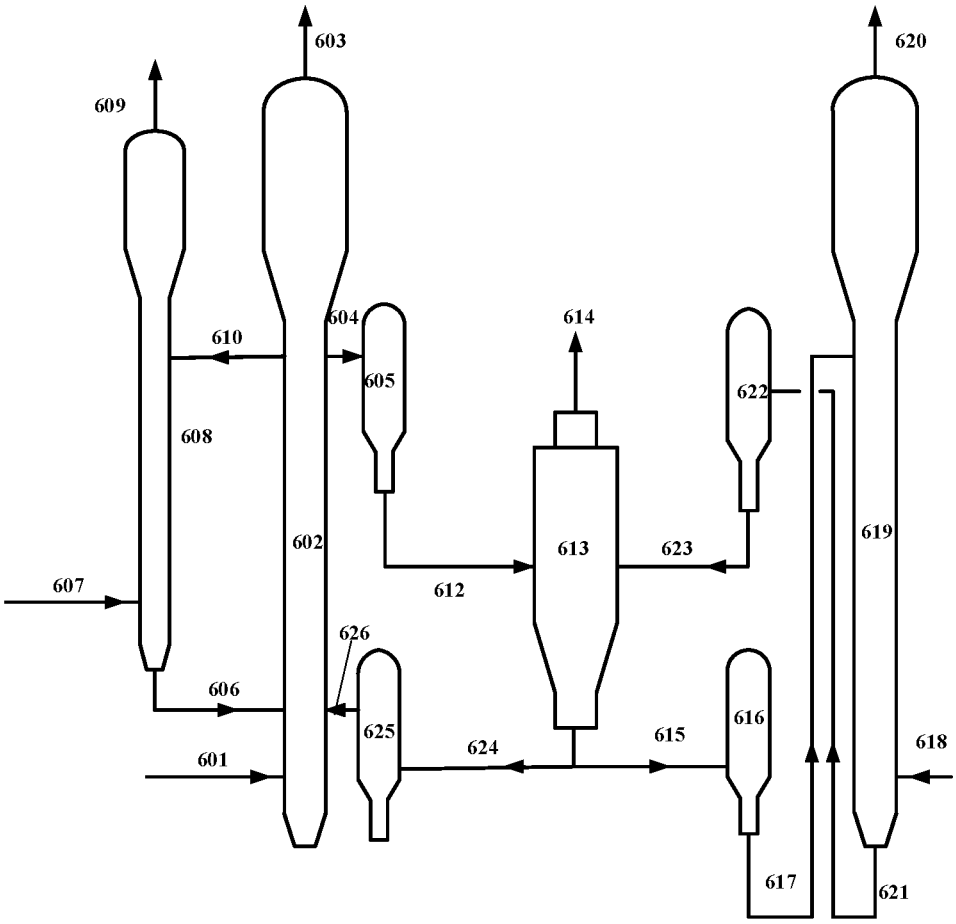
FIG. 1F is a schematic flow diagram of a preferred embodiment of an adsorption desulfurization unit according to a sixth type of embodiments of the present application.

FIG. 1F is a schematic flow diagram of a preferred embodiment of an adsorption desulfurization unit according to a sixth type of embodiments of the present application. As shown in FIG. 1F, the adsorption desulfurization unit comprises: a first fluidized bed desulfurization reactor 602, a reactor receiver 605, a lock hopper 613 for isolating the reaction-regeneration system, a regenerator feed tank 616 and an adsorbent regenerator 619, which are communicated in sequence, wherein the adsorbent regenerator 619 is communicated sequentially with a regenerator receiver 622, the lock hopper 613 and an adsorbent reducer 625, and the adsorbent reducer 625 is communicated with the bottom of the first fluidized bed desulfurization reactor 602 to provide a desulfurization adsorbent to the reactor; wherein the upper part of the first fluidized bed desulfurization reactor 602 is in communication with the upper part of the second fluidized bed desulfurization reactor 608, and the bottom of the second fluidized bed desulfurization reactor 608 is in communication with the bottom of the first fluidized bed desulfurization reactor 602.

The preheated crude gasoline from the catalytic cracking fractionator and hydrogen are introduced into the bottom of the first fluidized bed desulfurization reactor 602 through a pipeline 601, contacted with the desulfurization adsorbent in the first fluidized bed desulfurization reactor 602 for desulfurization reaction, and the adsorbent partially loaded with sulfur moves upwards along with the reaction material. At a position of 50-90% of the height from bottom to top of the first fluidized bed desulfurization reactor, a part of the desulfurization adsorbent is withdrawn and then passed to the upper part of the second fluidized bed desulfurization reactor under the control of a slide valve, and contacted with the rich gas from the catalytic cracking fractionator or a mixture of the rich gas and the hydrogen donor preheated to a required temperature that is introduced into the second fluidized bed desulfurization reactor from the bottom through a pipeline 607 in a countercurrent manner for adsorption desulfurization reaction.

The reacted rich gas and the desulfurization adsorbent are subjected to oil-adsorbent separation in a settling separation section at the top of the second fluidized bed desulfurization reactor, and the separated desulfurized rich gas is sent to a subsequent absorption stabilization unit for treatment through a pipeline 609. The separated desulfurization adsorbent flows downward, and is introduced into the lower part of the first fluidized bed desulfurization reactor 602 from the bottom of the second fluidized bed desulfurization reactor 608 through a pipeline 606, and mixed with the desulfurization adsorbent entering the lower part of the first fluidized bed desulfurization reactor 602 from the adsorbent reducer 625, and the crude gasoline and hydrogen from the pipeline 601, and then flows upwards. The reaction oil gas and the desulfurization adsorbent are subjected to gas-solid separation at the top of the first fluidized bed desulfurization reactor 602, and the separated reaction oil gas is a mixture of desulfurized crude gasoline and hydrogen and is sent to a subsequent product separation and stabilization system through a pipeline 603.

The separated sulfur-loaded adsorbent is sent to the reactor receiver 605 from the first fluidized bed desulfurization reactor 602 through an adsorbent transferring horizontal pipe 604, and sent to the lock hopper 613 through a pipeline 612 after being stripped in the reactor receiver 605, purged with nitrogen and is changed to a low-pressure inactive atmosphere from a high-pressure hydrogen environment in the lock hopper, and the purged gas is sent to a combustion furnace for burning through a pipeline 614. The sulfur-loaded adsorbent is passed via a pipeline 615 to a regenerator feed tank 616 where it is lifted by a lift gas and passed via a pipeline 617 to an adsorbent regenerator 619. An oxygen-containing gas is introduced into the adsorbent regenerator from the bottom through a pipeline 618, the spent adsorbent is contacted with the oxygen-containing gas in the adsorbent regenerator 619 for sulfur burning and carbon burning to obtain a regenerated adsorbent, the sulfur-containing flue gas is separated from the regenerated adsorbent at the top of the adsorbent regenerator and then is sent to a sulfur production system or is subjected to alkali cleaning to remove SOx through a pipeline 620, the regenerated adsorbent is passed from the adsorbent regenerator to a regenerator receiver 622 through a pipeline 621, lifted by nitrogen and sent to the lock hopper 613 through a pipeline 623, stripped and purged with hydrogen, and is changed to a high-pressure hydrogen environment after a pressure increasing in the lock hopper 613, then sent to the adsorbent reducer 625 through a pipeline 624 for reduction, and the reduced regenerated adsorbent is sent to the first fluidized bed desulfurization reactor 602 through a pipeline 626, so that a continuous adsorption desulfurization reaction is realized.

In a preferred embodiment of the first to sixth embodiments, the hydrogen donor is one selected from hydrogen gas, hydrogen-containing gas and hydrogen-donating reagent, or a mixture of two or more thereof. The hydrogen gas refers to hydrogen gas having various purities, the hydrogen-containing gas is preferably one or a mixture of two or more of the dry gas produced by the method of the present application, catalytic cracking (FCC) dry gas, coking dry gas and thermal cracking dry gas, of which the hydrogen content by volume is preferably more than 20%, and the hydrogen-donating reagent is one selected from tetrahydronaphthalene, decahydronaphthalene and indane, or a mixture of two or more thereof.

In a preferred embodiment of the first to sixth embodiments, the adsorbent regenerator is a fluidized bed reactor, the oxygen-containing gas is introduced into the adsorbent regenerator from the bottom, and the sulfur-loaded spent adsorbent is introduced into the adsorbent regenerator and contacted with the oxygen-containing gas introduced from the lower end of the regenerator for regeneration by calcining under the reaction conditions including a regeneration temperature of 300-800° C., preferably 350-600° C. and a regeneration pressure of 0.1-3.0 MPa, preferably 0.1-1.0 MPa. The oxygen-containing gas may be air or a mixture of air or oxygen with an inert gas, such as nitrogen.

The regenerated desulfurization adsorbent withdrawn from the adsorbent regenerator is stripped to remove adsorbed impurities (such as adsorbed oxygen), and then lifted and sent to the adsorbent reducer.

The regenerated desulfurization adsorbent sent to the adsorbent reducer is contacted with a reducing gas, and the reduction is carried out under the conditions including a reducing temperature of 250-550° C., preferably 300-450° C. and a reducing pressure of 0.2-5.0 MPa, preferably 0.5-3.5 MPa, and a reducing gas of hydrogen or a gas rich in hydrogen.

In a preferred embodiment of the first to sixth types of embodiments, the desulfurized rich gas is introduced into the absorber from the bottom after being cooled, and the desulfurized crude gasoline or the crude gasoline and a part of the stabilized gasoline are introduced into the absorber from the top after heat exchange and contacted with the rich gas in a countercurrent manner for mass transfer, to obtain a desulfurized rich gas with reduced components heavier than C2 (excluding C2) and a desulfurized rich gas with reduced components of C2 and lighter (with increased components heavier than C2). The operating pressure of the absorber is 0.2-3.0 MPa, preferably 0.5-1.6 MPa, and the operating temperature is 20-100° C., preferably 30-70° C. The stabilized gasoline is preferably the desulfurized stabilized gasoline produced by the apparatus of the present application.

The desulfurized rich gas with reduced components heavier than C2 is sent to a reabsorber to contact with a light cycle oil fraction from a catalytic cracking fractionator to obtain a desulfurized dry gas product with further reduced components heavier than C2. The enriched light cycle oil fraction absorbed the components heavier than C2 is returned to the catalytic cracking fractionator. The operating pressure of the reabsorber is 0.1-3.0 MPa, preferably 0.5-2.5 MPa, and the operating temperature is 20-100° C., preferably 30-70° C. The diesel oil fraction from the catalytic cracking fractionator is preferably light cycle oil.

The desulfurized crude gasoline with reduced components of C2 and lighter is sent to a desorber to obtain a desulfurized crude gasoline with further reduced components of C2 and lighter. The overhead gas product of the desorber is mixed with the desulfurized rich gas and then recycled to the absorber. The operating pressure of the desorber is 0.1-3.0 MPa, preferably 0.5-2.5 MPa, and the operating temperature is 20-250° C., preferably 50-200° C.

The desulfurized crude gasoline with further reduced components of C2 and lighter is sent to a stabilizer, and fractionated to obtain the desulfurized liquefied gas and the stabilized catalytic cracking gasoline product. The operating pressure of the stabilizer is 0.1-3.0 MPa, preferably 0.5-2.5 MPa, and the operating temperature is 20-250° C., preferably 50-200° C.

In preferred embodiments of the first to sixth types of embodiments, the desulfurization adsorbent includes one or a mixture of two or more of various supported metal oxide adsorbents, supported metal oxides loaded with a metal promoter, and various sulfur conversion agents and sulfur adsorbents. Preferably, the desulfurization adsorbent comprises an adsorbent carrier and a metal component supported on the adsorbent carrier, wherein the desulfurization adsorbent comprises 70-95 wt % of the carrier, and 5-30 wt % of the metal component, based on the total weight of the desulfurization adsorbent. The adsorbent carrier can be a mixture of zinc oxide, silica and/or alumina, and the metal component can be one or more selected from cobalt, nickel, copper, iron, manganese, molybdenum, tungsten, silver, tin and vanadium. The desulfurization adsorbent is preferably in the form of microspheres having an average particle diameter of 20-200 μm, preferably 40-100 μm, for easy fluidization.

Figure 2:
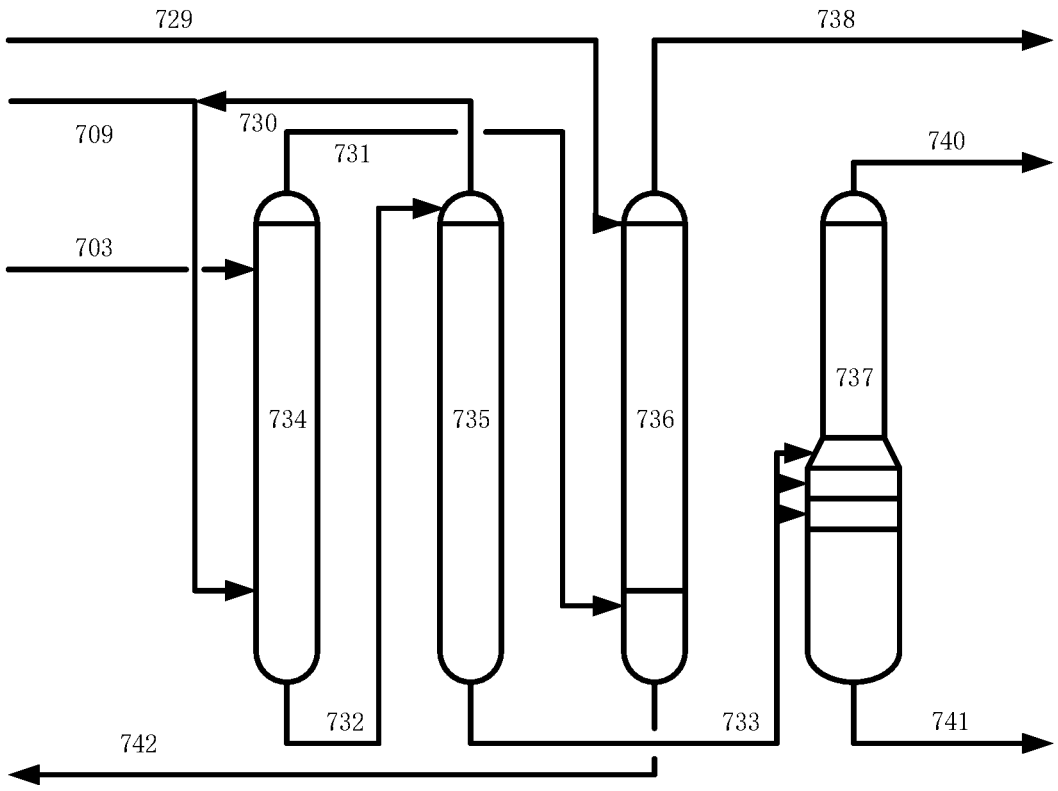
FIG. 2 is a schematic flow diagram of a preferred embodiment of an absorption stabilization unit according to the present application.

FIG. 2 is a schematic flow diagram of a preferred embodiment of an absorption stabilization unit according to the present application. As shown in FIG. 2, the desulfurized rich gas is passed through a pipeline 709, and the desulfurized crude gasoline or the crude gasoline and a part of stabilized gasoline are passed through a pipeline 703 into an absorber 734, they are contacted in a countercurrent manner for mass transfer, to obtain a desulfurized rich gas with a reduced content of components heavier than C2 (excluding C2) and a desulfurized crude gasoline with a reduced content of components of C2 and lighter (with an increased content of components heavier than C2). The desulfurized rich gas with reduced components heavier than C2 is introduced into a reabsorber 736 through a pipeline 731, and contacted with a light cycle oil from a catalytic cracking fractionator introduced through a pipeline 729 for mass transfer, to obtain a desulfurized dry gas with a further reduced content of components heavier than C2, which is discharged from the reabsorber through a pipeline 738, and the enriched light cycle oil absorbed a part of the components heavier than C2 is recycled from the bottom of the reabsorber to the catalytic cracking fractionator through a pipeline 742. The desulfurized crude gasoline with reduced components of C2 and lighter is introduced into a desorber 735 through a pipeline 732 to further remove the components of C2 and lighter, then is introduced into a stabilizer 737 through a pipeline 733, and fractionated in the stabilizer 737 to obtain a desulfurized liquefied gas 740 and a desulfurized stabilized catalytic cracking gasoline 741. The overhead gas product of the desorber 735 is withdrawn via a pipeline 730 and passed to the absorber 734 along with the desulfurized rich gas from the pipeline 709.

In a second aspect, the present application provides a process for producing a low-sulfur light oil by catalytic cracking, comprising the steps of:

i) contacting a catalytic cracking feedstock with a catalytic cracking catalyst for reaction under catalytic cracking conditions, preferably in a riser reactor;

ii) carrying out gas-solid separation on the reaction product obtained in the step i) to obtain a reaction oil gas and a spent catalyst;

iii) fractionating the reaction oil gas obtained in the step ii) in a catalytic cracking fractionator to obtain a catalytic cracking light product, a light cycle oil, a diesel oil and an oil slurry;

iv) desulfurizing and separating the catalytic cracking light product from the catalytic cracking fractionator using the method for desulfurization and separation of catalytic cracking light product according to the present application, to obtain a desulfurized dry gas, a desulfurized liquefied gas and a desulfurized stabilized gasoline; and v) optionally, regenerating the spent catalyst obtained in the step ii) and then recycling the regenerated catalyst to the riser reactor for reuse.

According to the present application, said steps i), ii) and iii) can be carried out under conventional conditions, using conventional feedstocks, catalysts and equipment, which are not strictly limited in the present application and therefore are not described in detail herein.

In a third aspect, the application provides an apparatus for the desulfurization and separation of a catalytic cracking light product, comprising an adsorption desulfurization unit and an absorption stabilization unit communicated in sequence, wherein:

the absorption stabilization unit comprises an absorber, a desorber, a reabsorber and a stabilizer communicated in sequence; and the adsorption desulfurization unit comprises a fluidized bed desulfurization reaction unit, an adsorbent regenerator and a lock hopper connected between them that is used for conducting pressure changing and atmosphere conversion, the fluidized bed desulfurization reaction unit is in communication with a catalytic cracking fractionator to receive a catalytic cracking light product from the catalytic cracking fractionator, and an oil-gas outlet of the fluidized bed desulfurization reaction unit is in communication with the absorber of the absorption stabilization unit or communicated with the absorber of the absorption stabilization unit through a gas-liquid separation tank.

In a preferred embodiment, the adsorption desulfurization unit comprises: a fluidized bed desulfurization reaction unit, a reactor receiver, a lock hopper, a regenerator feed tank, an adsorbent regenerator and a regenerator receiver communicated in sequence, the regenerator receiver is communicated with an adsorbent reductor through the lock hopper, and the adsorbent reductor is in communication with the fluidized bed desulfurization reaction unit.

In some further preferred embodiments, the fluidized bed desulfurization reaction unit comprises a first fluidized bed desulfurization reactor, an optional adsorbent transferring tank and a second fluidized bed desulfurization reactor communicated in sequence, and the adsorbent reducer is in communication with the bottom of the first fluidized bed desulfurization reactor and/or the second fluidized bed desulfurization reactor.

In some further preferred embodiments, the fluidized bed desulfurization reaction unit comprises a first fluidized bed desulfurization reactor and a second fluidized bed desulfurization reactor, wherein the first fluidized bed desulfurization reactor is in communication with the reactor receiver, the adsorbent reducer is in communication with the bottom of the first fluidized bed desulfurization reactor and/or the second fluidized bed desulfurization reactor, the middle-lower part of the first fluidized bed desulfurization reactor is in communication with the bottom of the second fluidized bed desulfurization reactor, and the upper part of the second fluidized bed desulfurization reactor is in communication with the upper part of the first fluidized bed desulfurization reactor;

still further preferably, the first fluidized bed desulfurization reactor is communicated at a position of 20-60% of the height thereof from bottom to top with the bottom of the second fluidized bed desulfurization reactor, the first fluidized bed desulfurization reactor is communicated at a position of 60-90% of the height thereof from bottom to top with the upper part of the second fluidized bed desulfurization reactor, a gas-solid separation equipment is provided in a settling section at the upper part of the first fluidized bed desulfurization reactor, and a gas-solid separation equipment is provided or not provided at the upper part of the second fluidized bed desulfurization reactor.

In some further preferred embodiments, the fluidized bed desulfurization reaction unit comprises a first fluidized bed desulfurization reactor and a second fluidized bed desulfurization reactor, wherein the first fluidized bed desulfurization reactor is in communication with the reactor receiver, the adsorbent reducer is in communication with the bottom of the first fluidized bed desulfurization reactor and/or the second fluidized bed desulfurization reactor, the upper part of the first fluidized bed desulfurization reactor is in communication with the upper part of the second fluidized bed desulfurization reactor, and the bottom of the second fluidized bed desulfurization reactor is in communication with the bottom of the first fluidized bed desulfurization reactor;

still further preferably, the first fluidized bed desulfurization reactor is communicated at a position of 50-90% of the height thereof from bottom to top with the second fluidized bed desulfurization reactor at a position of 80-90% of the height thereof from bottom to top.

In some preferred embodiments, the present application provides the following technical solutions:

A1, a method for the desulfurization and separation of a catalytic cracking light product, characterized in that an overhead oil-gas fraction from the top of a catalytic cracking fractionator is introduced into an adsorption desulfurization reaction unit, and contacted with a desulfurization adsorbent in the presence of hydrogen for desulfurization, and the resulting reaction oil gas is introduced into a gas-liquid separation tank for separation to obtain a desulfurized rich gas and a desulfurized crude gasoline; the desulfurized rich gas is introduced into an absorber from the bottom and is contacted with the desulfurized crude gasoline introduced into the absorber from the top for absorption, the overhead stream of the absorber is introduced into a reabsorber from the bottom and is contact with a light cycle oil from a catalytic cracking fractionator in a countercurrent manner for absorption, a desulfurized dry gas is obtained from the top of the reabsorber, and the enriched light cycle oil obtained at the bottom of the reabsorber is recycled to the catalytic cracking fractionator; and the bottom product of the absorber is sent to a stabilizer after passing through a desorber, fractionated in the stabilizer to obtain a desulfurized liquefied gas and a desulfurized stabilized gasoline, and the overhead gas of the desorber is recycled to the absorber.

A2, the method for the desulfurization and separation of a catalytic cracking light product according to Item A1, wherein the overhead oil-gas fraction of the catalytic cracking fractionator is introduced into a fluidized bed desulfurization reactor from the bottom, contacted with a desulfurization adsorbent introduced into the reactor from the bottom for desulfurization reaction while flowing upwards, and subjected to gas-solid separation at the upper part of the fluidized bed desulfurization reactor, and the separated reaction oil gas is introduced into an absorption stabilization unit; the separated sulfur-loaded adsorbent is introduced into an adsorbent regenerator for regeneration by calcining in the presence of an oxygen-containing gas, and the regenerated desulfurization adsorbent is recycled to the fluidized bed desulfurization reactor after reduction.

A3, the method for the desulfurization and separation of a light catalytic cracking product according to Item A2, wherein the conditions of the fluidized bed desulfurization reactor including an operating temperature of 200-550° C., an absolute pressure of 0.5-5 MPa, a weight hourly space velocity of oil gas feedstock of 0.1-100 $h^{-1}$, and a hydrogen-to-oil molar ratio of 0.01-5.

A4, the method for the desulfurization and separation of a light catalytic cracking product according to Item A3, wherein the conditions of the fluidized bed desulfurization reactor include an operating temperature of 300-500° C., an absolute pressure of 1.0-3.5 MPa, a weight hourly space velocity of oil gas feedstock of 1-10 $h^{-1}$, and a hydrogen-to-oil molar ratio of 0.1-1.

A5, the method for the desulfurization and separation of a light catalytic cracking product according to Item A2, wherein the operating conditions of the adsorbent regenerator include: a regeneration temperature of 300-800° C., and a regeneration pressure of 0.1-3.0 MPa.

A6, the method for the desulfurization and separation of a light catalytic cracking product according to Item A5, wherein the operating conditions of the adsorbent regenerator include: a regeneration temperature of 350-600° C., and a regeneration pressure of 0.1-1.0 MPa.

A7, the method for the desulfurization and separation of a catalytic cracking light product according to Item A1 or A2, wherein the desulfurization adsorbent comprises a desulfurization adsorbent carrier and a metal component supported on the adsorbent carrier, and the content of the desulfurization adsorbent carrier is 70-95 wt % and the content of the metal component is 5-30 wt %, based on the total weight of the desulfurization adsorbent.

A8, the method for the desulfurization and separation of a light catalytic cracking product according to Item A2, wherein the operating conditions of the gas-liquid separation tank include: a pressure of 0.2-4.0 MPa, and a temperature of 20-300° C.; the operating conditions of the absorber include: a pressure of 0.2-3.0 MPa, and a temperature of 20-100° C.; the operating conditions of the desorber include: a pressure of 0.1-3.0 MPa, and a temperature of 20-250° C.; the operating conditions of the reabsorber include: a pressure of 0.1-3.0 MPa, and a temperature of 20-100° C.; the operating conditions of the stabilizer include: a pressure of 0.1-3.0 MPa and a temperature of 20-250° C.

A9, the method for the desulfurization and separation of a light catalytic cracking product according to Item A8, wherein the operating conditions of the gas-liquid separation tank include: a pressure of 0.5-3.0 MPa, and a temperature of 50-200° C.; the operating conditions of the absorber include: a pressure of 0.5-1.6 MPa, and a temperature of 30-70° C.; the operating conditions of the desorber include: a pressure of 0.5-2.5 MPa, and a temperature of 50-200° C.; the operating conditions of the reabsorber include: a pressure of 0.5-2.5 MPa, and a temperature of 30-70° C.; the operating conditions of the stabilizer include: a pressure of 0.5-2.5 MPa and a temperature of 50-200° C.

A10, the method for the desulfurization and separation of a catalytic cracking light product according to Item A1 or A2, wherein the overhead oil-gas fraction of the catalytic cracking fractionator contains hydrocarbon components of C1-C12, and its sulfur content is 30-50000 μg/g.

A11, a process for producing a low-sulfur light oil product by catalytic cracking, characterized in that a catalytic cracking feedstock is introduced into a riser reactor, contacted with a catalytic cracking catalyst for reaction under catalytic cracking conditions, and subjected to gas-solid separation at the top of the riser reactor, the resulting reaction oil gas is introduced into a catalytic cracking fractionator for fractionation to obtain an overhead oil-gas fraction, a light cycle oil, a diesel oil and an oil slurry; the separated catalytic cracking catalyst is regenerated and then recycled to the riser reactor for reuse;

the overhead oil-gas fraction from the catalytic cracking fractionator is introduced into an adsorption desulfurization reaction unit and an absorption stabilization unit, and treated using the method for the desulfurization and separation of catalytic cracking light product defined in Items A1-A10 to obtain a desulfurized dry gas, a desulfurized liquefied gas and a desulfurized stabilized gasoline.

A12, an apparatus for the separation and desulfurization of a catalytic cracking light product, characterized in that the apparatus comprises a catalytic cracking fractionator, an adsorption desulfurization unit and an absorption stabilization unit communicated in sequence; the adsorption desulfurization unit comprises a fluidized bed desulfurization reactor, a lock hopper for isolating the reaction-regeneration system and an adsorbent regenerator, wherein an oil-gas outlet of the fluidized bed desulfurization reactor is in communication with a gas-liquid separation tank; the absorption stabilization unit consists of an absorber, a desorber, a reabsorber and a stabilizer communicated in sequence.

A13, the apparatus for the desulfurization of a catalytic cracking light product according to Item A12, wherein the adsorption desulfurization unit comprises: a fluidized bed desulfurization reactor, a reactor receiver, a lock hopper for isolating the reaction-regeneration system, a regenerator feed tank, an adsorbent regenerator and a regenerator receiver communicated in sequence, wherein the regenerator receiver is communicated with an adsorbent reducer through the lock hopper, and the adsorbent reducer is in communication with the bottom of the fluidized bed desulfurization regenerator.

B1, a method for the desulfurization and separation of a catalytic cracking light product, comprising the steps of:

(1) introducing a crude gasoline from a catalytic cracking fractionator into a fluidized bed desulfurization reactor from the bottom, contacting it with a desulfurization adsorbent in the presence of hydrogen for desulfurization, while flowing upwards, wherein a rich gas is introduced into the fluidized bed desulfurization reactor at a position of 30-80% of the height thereof from bottom to top, mixed with the reaction stream and then contacted with the desulfurization adsorbent for reaction, and a reaction oil gas obtained through gas-solid separation is introduced into a gas-liquid separation tank for separation, to obtain a desulfurized rich gas and a desulfurized crude gasoline; the sulfur-loaded adsorbent is regenerated in an adsorbent regenerator by calcining, and the regenerated desulfurization adsorbent is recycled to the fluidized bed desulfurization reactor for reuse after reduction;

(2) introducing the desulfurized rich gas into an absorber from the bottom and contacting it with the desulfurized crude gasoline introduced into the absorber from the top for absorption, introducing the overhead stream of the absorber into a reabsorber from the bottom and contacting it with a light cycle oil from a catalytic cracking fractionator in a countercurrent manner for absorption, to obtain a desulfurized dry gas from the top of the reabsorber, and recycling the enriched light cycle oil obtained at the bottom of the reabsorber to the catalytic cracking fractionator; and sending the bottom product of the absorber to a stabilizer after passing through a desorber, fractionating it in the stabilizer to obtain a desulfurized liquefied gas and a desulfurized stabilized gasoline, and recycling the overhead gas of the desorber to the absorber.

B2, the method for the desulfurization and separation of a light product through catalytic cracking according to Item B1, wherein the rich gas is introduced into the fluidized bed desulfurization reactor at a position of 40-70% of the height thereof from the bottom.

B3, the method for the desulfurization and separation of a catalytic cracking light product according to Item B1 or B2, wherein the conditions of the fluidized bed desulfurization reactor include an operating temperature of 200-550° C., an absolute pressure of 0.5-5 MPa, a weight hourly space velocity of oil gas feedstock of 0.1-100 $h^{-1}$, and a hydrogen-to-oil molar ratio of 0.01-5.

B4, the method for the desulfurization and separation of a light catalytic cracking product according to Item B3, characterized in that the conditions of the fluidized bed desulfurization reactor include an operating temperature of 300-500° C., an absolute pressure of 1.0-3.5 MPa, a weight hourly space velocity of oil gas feedstock of 1-10 $h^{-1}$, and a hydrogen-to-oil molar ratio of 0.1-1.

B5, the method for the desulfurization and separation of a light product from catalytic cracking according to Item B1 or B2, wherein the sulfur-loaded adsorbent is regenerated by reacting with an oxygen-containing gas in an adsorbent regenerator under the conditions including: a regeneration temperature of 300-800° C., and a regeneration pressure of 0.1-3.0 MPa.

B6, the method for the desulfurization and separation of a catalytic cracking light product according to Item B5, wherein the operating conditions of the adsorbent regenerator include: a regeneration temperature of 350-600° C., and a regeneration pressure of 0.1-1.0 MPa.

B7, the method for the desulfurization and separation of a catalytic cracking light product according to Item B1, wherein the desulfurization adsorbent comprises a desulfurization adsorbent carrier and a metal component supported on the adsorbent carrier, and the content of the desulfurization adsorbent carrier is 70-95 wt % and the content of the metal component is 5-30 wt %, based on the total weight of the desulfurization adsorbent.

B8, the method for the desulfurization and separation of a light catalytic cracking product according to Item B1, wherein the operating conditions of the gas-liquid separation tank include: an operating pressure of 0.2-4.0 MPa, and an operating temperature of 20-300° C.; the operating conditions of the absorber include: an operating pressure of 0.2-3.0 MPa, and an operating temperature of 20-100° C.; the operating conditions of the desorber include: an operating pressure of 0.1-3.0 MPa, and an operating temperature of 20-250° C.; the operating conditions of the reabsorber include: an operating pressure of 0.1-3.0 MPa, and an operating temperature of 20-100° C.; the operating conditions of the stabilizer include: an operating pressure of 0.1-3.0 MPa, and an operating temperature of 20-250° C.

B9, the method for the desulfurization and separation of a light catalytic cracking product according to Item B8, wherein the operating conditions of the gas-liquid separation tank include: an operating pressure of 0.5-3.0 MPa, and an operating temperature of 50-200° C.; the operating conditions of the absorber include: an operating pressure of 0.5-1.6 MPa, and an operating temperature of 30-70° C.; the operating conditions of the desorber include: an operating pressure of 0.5-2.5 MPa, and an operating temperature of 50-200° C.; the operating conditions of the reabsorber include: an operating pressure of 0.5-2.5 MPa, and an operating temperature of 30-70° C.; the operating conditions of the stabilizer include: an operating pressure of 0.5-2.5 MPa, and an operating temperature of 50-200° C.

B10, the method for the desulfurization and separation of a light product from catalytic cracking according to Item B1, wherein the sulfur content in the rich gas and the crude gasoline from the catalytic cracker is more than 30 μg/g, preferably more than 50 μg/g.

B11, a process for producing a low-sulfur light oil product by catalytic cracking, characterized in that a catalytic cracking feedstock is introduced into a riser reactor, contacted with a catalytic cracking catalyst for reaction under catalytic cracking conditions, and subjected to gas-solid separation at the top of the riser reactor, the resulting reaction oil gas is introduced into a catalytic cracking fractionator for fractionation to obtain a rich gas, a crude gasoline, a light cycle oil, a diesel oil and an oil slurry; the separated catalytic cracking catalyst is regenerated and then recycled to the riser reactor for reuse;

the rich gas and the crude gasoline of the catalytic cracking fractionator are desulfurized and separated by the method for the desulfurization and separation of catalytic cracking light product defined in Items B1-B10, to obtain a desulfurized dry gas, a desulfurized liquefied gas and a desulfurized stabilized gasoline.

C1, a method for the desulfurization of a catalytic cracking light product, comprising the steps of:

(1) introducing a crude gasoline from a catalytic cracking fractionator into a first desulfurization reactor from the bottom, and contacting it with a desulfurization adsorbent in the presence of hydrogen for desulfurization while flowing upwards; and subjecting the resultant to gas-solid separation in a settling zone at the upper part, and introducing the separated desulfurization adsorbent partially loaded with sulfur into a second desulfurization reactor, with the separated reaction oil gas being a desulfurized crude gasoline;

(2) introducing a rich gas from a catalytic cracking fractionator into the second desulfurization reactor from the bottom, contacting it with the desulfurization adsorbent for desulfurization while flowing upwards, subjecting the resultant to gas-solid separation in a settling zone at the upper part, with the reaction oil gas obtained by separation being a desulfurized rich gas, passing the separated sulfur-loaded adsorbent to an adsorbent regenerator for regeneration by calcining in the presence of an oxygen-containing gas, and recycling the regenerated desulfurization adsorbent to the bottom of the first desulfurization reactor after reduction;

(3) separately sending the desulfurized rich gas and the desulfurized crude gasoline to an absorption stabilization system for separation, to obtain a desulfurized dry gas, a desulfurized liquefied gas and a desulfurized stabilized gasoline.

C2, the method for the desulfurization of a catalytic cracking light product according to Item C1, wherein in step (3), the desulfurized rich gas is introduced into an absorber from the bottom, and is contacted with the desulfurized crude gasoline introduced into the absorber from the top for absorption, the overhead stream of the absorber is introduced into a reabsorber from the bottom, and is contacted with a light cycle oil from a catalytic cracking fractionator in a countercurrent manner for absorption, a desulfurized dry gas is obtained from the top of the reabsorber, and the enriched light cycle oil obtained at the bottom of the reabsorber is recycled to the catalytic cracking fractionator; and the bottom product of the absorber is sent to a stabilizer after passing through a desorber, fractionated in the stabilizer to obtain a desulfurized liquefied gas and a desulfurized stabilized gasoline, and the overhead gas of the desorber is recycled to the absorber.

C3, the method for the desulfurization of a light catalytic cracking product according to Item C1 or C2, wherein the conditions of the first desulfurization reactor include an operating temperature of 200-550° C., an absolute pressure of 0.5-5 MPa, a weight hourly space velocity of oil gas feedstock of 0.1-100 $h^{-1}$, and a hydrogen-to-oil molar ratio of 0.01-1000.

C4, the method for the desulfurization of a light catalytic cracking product according to Item C3, wherein the conditions of the first desulfurization reactor include an operating temperature of 300-500° C., an absolute pressure of 1.0-3.5 MPa, a weight hourly space velocity of oil gas feedstock of 1-10 $h^{-1}$, and a hydrogen-to-oil molar ratio of 0.05-500.

C5, the method for the desulfurization of a catalytic cracking light product according to Item C1 or C2, wherein the conditions of the second desulfurization reactor include an operating temperature of 300-550° C., an absolute pressure of 0.1-3 MPa, a weight hourly space velocity of oil gas feedstock of 1-100 $h^{-1}$, and a hydrogen-to-oil molar ratio of 0.01-500.

C6, the method for the desulfurization of a light catalytic cracking product according to Item C5, wherein the conditions of the second desulfurization reactor include an operating temperature of 350-500° C., an absolute pressure of 0.2-2.5 MPa, a weight hourly space velocity of oil gas feedstock of 2-20 $h^{-1}$, and a hydrogen-to-oil molar ratio of 0.05-300; the operating pressure of the second desulfurization reactor is 0.5-2.0 MPa lower than that of the first desulfurization reactor.

C7, the method for the desulfurization of a catalytic cracking light product according to Item C1 or C2, wherein the operating conditions of the adsorbent regenerator include: a regeneration temperature of 300-800° C., and a regeneration pressure of 0.1-3.0 MPa.

C8, the method for the desulfurization of a catalytic cracking light product according to Item C7, wherein the operating conditions of the adsorbent regenerator include: a regeneration temperature of 350-600° C., and a regeneration pressure of 0.1-1.0 MPa.

C9, the method for the desulfurization of a catalytic cracking light product according to any one of Items C1 to C8, wherein the desulfurization adsorbent comprises an adsorbent carrier and a metal component supported on the adsorbent carrier, the content of the desulfurization adsorbent carrier is 70-95 wt %, the content of the metal component is 5-30 wt %, based on the total weight of the desulfurization adsorbent, the adsorbent carrier is a mixture of zinc oxide, silica and/or alumina, and the metal component is one or more selected from cobalt, nickel, copper, iron, manganese, molybdenum, tungsten, silver, tin and vanadium.

C10, the method for the desulfurization of a catalytic cracking light product according to Item C2, wherein the operating conditions of the absorber include: a pressure of 0.2-3.0 MPa, and a temperature of 20-100° C.; the operating conditions of the desorber include: a pressure of 0.1-3.0 MPa, and a temperature of 20-250° C.; the operating conditions of the reabsorber include: a pressure of 0.1-3.0 MPa, and a temperature of 20-100° C.; the operating conditions of the stabilizer include: a pressure of 0.1-3.0 MPa and a temperature of 20-250° C.

C11, the method for the desulfurization of a catalytic cracking light product according to Item C10, wherein the operating conditions of the absorber include: a pressure of 0.5-1.6 MPa, and a temperature of 30-70° C.; the operating conditions of the desorber include: a pressure of 0.5-2.5 MPa, and a temperature of 50-200° C.; the operating conditions of the reabsorber include: a pressure of 0.5-2.5 MPa, and a temperature of 30-70° C.; the operating conditions of the stabilizer include: a pressure of 0.5-2.5 MPa and a temperature of 50-200° C.

C12, a process for producing a low-sulfur light oil product by catalytic cracking, characterized in that a catalytic cracking feedstock is introduced into a riser reactor, contacted with a catalytic cracking catalyst for reaction under catalytic cracking conditions, and subjected to gas-solid separation at the top of the riser reactor, the resulting reaction oil gas is introduced into a catalytic cracking fractionator for fractionation to obtain a rich gas, a crude gasoline, a light cycle oil, a diesel oil and an oil slurry; the separated catalytic cracking catalyst is regenerated and then recycled to the riser reactor for reuse;

the crude gasoline and the rich gas from the catalytic cracking fractionator are introduced into a first desulfurization reactor and a second desulfurization reactor of an adsorption desulfurization reaction unit, respectively, and subjected to adsorption desulfurization and absorption stabilization separation performed using the method for the desulfurization of a catalytic cracking light product defined in Items C1-C11, to obtain a desulfurized dry gas, a desulfurized liquefied gas and a stabilized gasoline.

C13, an apparatus for the separation and desulfurization of a catalytic cracking light product, characterized in that the apparatus comprises an adsorption desulfurization unit and an absorption stabilization unit communicated in sequence; the adsorption desulfurization unit comprises a first desulfurization reactor, an adsorbent transferring tank, a second desulfurization reactor, a reactor receiver, a lock hopper, a regenerator feeding tank, an adsorbent regenerator and a regenerator receiver communicated in sequence, wherein the regenerator receiver is communicated with a reducer through the lock hopper, and the reducer is in communication with the bottom of the first desulfurization reactor; and the absorption stabilization unit consists of an absorber, a desorber, a reabsorber and a stabilizer communicated in sequence.

D1, a method for the desulfurization and separation of a catalytic cracking light product, characterized in that a crude gasoline from a catalytic cracking fractionator and a hydrogen donor are introduced into the bottom of a first desulfurization reactor, contacted with a desulfurization adsorbent for desulfurization while flowing upwards; the desulfurization adsorbent partially loaded with sulfur obtained by gas-solid separation at the top of the reactor is introduced into a second desulfurization reactor; a rich gas from a catalytic cracking fractionator and a hydrogen donor are introduced into the bottom of the second desulfurization reactor, contacted with the desulfurization adsorbent for desulfurization, and the reaction oil gas separated from the desulfurization adsorbent after reaction is recycled to the first desulfurization reactor;

the reaction oil gas obtained by gas-solid separation in the first desulfurization reactor is separated into a desulfurized rich gas and a desulfurized crude gasoline, the desulfurized rich gas is introduced into an absorber from the bottom and contacted with the desulfurized crude gasoline introduced into the absorber from the top for absorption, the overhead stream of the absorber is introduced into a reabsorber from the bottom and contacted with a light cycle oil from a catalytic cracking fractionator in a countercurrent manner for absorption, a desulfurized dry gas is obtained at the top of the reabsorber, and the enriched light cycle oil obtained at the bottom of the reabsorber is recycled to the catalytic cracking fractionator; and the bottom product of the absorber is sent to a stabilizer after passing through a desorber, fractionated in the stabilizer to obtain a desulfurized liquefied gas and a desulfurized stabilized gasoline, and the overhead gas of the desorber is recycled to the absorber.

D2, the method for the desulfurization and separation of a light catalytic cracking product according to Item D1, wherein the mixture of the reaction oil gas and the desulfurization adsorbent is subjected to gas-solid separation at the top of the second desulfurization reactor, the sulfur-loaded adsorbent obtained by separation is regenerated by calcining in the presence of an oxygen-containing gas, the regenerated desulfurization adsorbent is recycled to the fluidized bed desulfurization reactor after reduction.

D3, the method for the desulfurization and separation of a light catalytic cracking product according to Item D1 or D2, wherein the conditions of the first desulfurization reactor include an operating temperature of 200-550° C., an absolute pressure of 0.5-5 MPa, a weight hourly space velocity of oil gas feedstock of 0.1-100 $h^{-1}$, and a hydrogen-to-oil molar ratio of 0.01-1000.

D4, the method for the desulfurization and separation of a light catalytic cracking product according to Item D3, wherein the conditions of the first desulfurization reactor include an operating temperature of 300-500° C., an absolute pressure of 1.0-3.5 MPa, a weight hourly space velocity of oil gas feedstock of 1-10 $h^{-1}$, and a hydrogen-oil molar ratio of 0.05-500.

D5, the method for the desulfurization and separation of a light catalytic cracking product according to Item D1 or D2, wherein the conditions of the second desulfurization reactor include an operating temperature of 300-550° C., an absolute pressure of 0.5-5 MPa, a weight hourly space velocity of oil gas feedstock of 1-100 $h^{-1}$, and a hydrogen-to-oil molar ratio of 0.01-500.

D6, the method for the desulfurization and separation of a light catalytic cracking product according to Item D5, wherein the conditions of the second desulfurization reactor include an operating temperature of 350-500° C., an absolute pressure of 1.0-3.5 MPa, a weight hourly space velocity of oil gas feedstock of 2-20 $h^{-1}$, and a hydrogen-oil molar ratio of 0.05-300.

D7, the method for the desulfurization and separation of a light catalytic cracking product according to Item D1 or D2, wherein the operating conditions of the adsorbent regenerator include: a regeneration temperature of 300-800° C., and a regeneration pressure of 0.1-3.0 MPa.

D8, the method for the desulfurization and separation of a light catalytic cracking product according to Item D7, wherein the operating conditions of the adsorbent regenerator include: a regeneration temperature of 350-600° C., and a regeneration pressure of 0.1-1.0 MPa.

D9, the method for the desulfurization and separation of a catalytic cracking light product according to any one of Items D1 to D8, wherein the desulfurization adsorbent comprises an adsorbent carrier and a metal component supported on the adsorbent carrier, the content of the desulfurization adsorbent carrier is 70-95 wt %, the content of the metal component is 5-30 wt %, based on the total weight of the desulfurization adsorbent, the adsorbent carrier is a mixture of zinc oxide, silica and/or alumina, and the metal component is one or more selected from cobalt, nickel, copper, iron, manganese, molybdenum, tungsten, silver, tin and vanadium.

D10, the method for the desulfurization and separation of a catalytic cracking light product according to Item D1 or D2, wherein the operating conditions of the absorber include: a pressure of 0.2-3.0 MPa, and a temperature of 20-100° C.; the operating conditions of the desorber include: a pressure of 0.1-3.0 MPa, and a temperature of 20-250° C.; the operating conditions of the reabsorber include: a pressure of 0.1-3.0 MPa, and a temperature of 20-100° C.; the operating conditions of the stabilizer include: a pressure of 0.1-3.0 MPa and a temperature of 20-250° C.

D11, the method for the desulfurization and separation of a light catalytic cracking product according to Item D10, wherein the operating conditions of the absorber include: a pressure of 0.5-1.6 MPa, and a temperature of 30-70° C.; the operating conditions of the desorber include: a pressure of 0.5-2.5 MPa, and a temperature of 50-200° C.; the operating conditions of the reabsorber include: a pressure of 0.5-2.5 MPa, and a temperature of 30-70° C.; the operating conditions of the stabilizer include: a pressure of 0.5-2.5 MPa and a temperature of 50-200° C.

D12, a process for producing a low-sulfur light oil product by catalytic cracking, characterized in that a catalytic cracking feedstock is introduced into a riser reactor, contacted with a catalytic cracking catalyst for reaction under catalytic cracking conditions, and subjected to gas-solid separation at the top of the riser reactor, the resulting reaction oil gas is introduced into a catalytic cracking fractionator for fractionation to obtain a rich gas, a crude gasoline, a light cycle oil, a diesel oil and an oil slurry; the separated catalytic cracking catalyst is regenerated and then recycled to the riser reactor for reuse;

the rich gas and crude gasoline from the catalytic cracking fractionator are introduced into a first desulfurization reactor and a second desulfurization reactor of an adsorption desulfurization reaction unit, respectively, and subjected to adsorption desulfurization and absorption stabilization separation performed using the method for the desulfurization and separation of a catalytic cracking light product defined in Items D1-D11, to obtain a desulfurized dry gas, a desulfurized liquefied gas and a stabilized gasoline.

D13, an apparatus for the separation and desulfurization of a catalytic cracking light product, characterized in that the apparatus comprises an adsorption desulfurization unit and an absorption stabilization unit communicated in sequence; the adsorption desulfurization unit comprises a first desulfurization reactor, a second desulfurization reactor, a reactor receiver, a lock hopper, a regenerator feed tank, an adsorbent regenerator and a regenerator receiver communicated in sequence, wherein the regenerator receiver is communicated sequentially with the lock hopper and an adsorbent reducer, and the adsorption reducer is in communication with the bottom of the first desulfurization reactor; the absorption stabilization unit consists of an absorber, a desorber, a reabsorber and a stabilizer communicated in sequence.

E1, a method for the desulfurization of a catalytic cracking light product, comprising the steps of:

(1) introducing a crude gasoline from a catalytic cracking fractionator into a first desulfurization reactor from the bottom, contacting it with a desulfurization adsorbent for desulfurization while flowing upwards; introducing a part of the desulfurization adsorbent into a second desulfurization reactor under the control of a slide valve, contacting it with a catalytic cracking rich gas preheated to a required temperature for desulfurization reaction, recycling the reacted rich gas and the desulfurization adsorbent to the first desulfurization reactor, and subjecting it to gas-solid separation in a settling zone at the upper part of the first desulfurization reactor;

(2) regenerating the separated spent desulfurization adsorbent by calcining in the presence of an oxygen-containing gas in an adsorbent regenerator, and recycling the regenerated desulfurization adsorbent to the bottom of the first desulfurization reactor for reuse after reduction;

(3) subjecting the separated reaction oil gas to a separation in a gas-liquid separation tank to obtain a desulfurized rich gas and a desulfurized crude gasoline, and separately sending them to an absorption stabilization system for further separation to obtain a desulfurized dry gas, a desulfurized liquefied gas and a desulfurized stabilized gasoline.

E2, the method for the desulfurization of a catalytic cracking light product according to Item E1, characterized in that a settling zone and a gas-solid separator are provided at the upper part of the second desulfurization reactor, the reaction oil gas and the desulfurization adsorbent in the second desulfurization reactor are subjected to gas-solid separation, the separated reaction oil gas is directly sent to an absorption stabilization system for further separation, and the desulfurization adsorbent is returned to the first desulfurization reactor.

E3, the method for the desulfurization of a catalytic cracking light product according to Item E1 or E2, wherein the desulfurized rich gas is introduced into an absorber from the bottom, and contacted with the desulfurized crude gasoline introduced into the absorber from the top for absorption, the overhead stream of the absorber is introduced into a reabsorber from the bottom, and contacted with a light cycle oil from a catalytic cracking fractionator in a countercurrent manner for absorption, a desulfurized dry gas is obtained from the top of the reabsorber, and the enriched light cycle oil from the bottom of the reabsorber is recycled to the catalytic cracking fractionator; and the bottom product of the absorber is sent to a stabilizer after passing through a desorber, fractionated in the stabilizer to obtain the desulfurized liquefied gas and the desulfurized stabilized gasoline, and the overhead gas of the desorber is recycled to the absorber.

E4, the method for the desulfurization of a catalytic cracking light product according to Item E1 or E2, wherein the conditions of the first desulfurization reactor include an operating temperature of 200-550° C., an absolute pressure of 0.5-5 MPa, a weight hourly space velocity of oil gas feedstock of 0.1-100 $h^{-1}$, and a hydrogen-to-oil molar ratio of 0.01-1000.

E5, the method for the desulfurization of a light catalytic cracking product according to Item E4, wherein the conditions of the first desulfurization reactor include an operating temperature of 300-500° C., an absolute pressure of 1.0-3.5 MPa, a weight hourly space velocity of oil gas feedstock of 1-10 $h^{-1}$, and a hydrogen-oil molar ratio of 0.05-500.

E6, the method for the desulfurization of a catalytic cracking light product according to Item E1 or E2, wherein the conditions of the second desulfurization reactor include an operating temperature of 250-550° C., an absolute pressure of 0.5-5 MPa, a weight hourly space velocity of oil gas feedstock of 0.1-100 $h^{-1}$, and a hydrogen-to-oil molar ratio of 0.01-1000.

E7, the method for the desulfurization of a light catalytic cracking product according to Item E6, wherein the conditions of the second desulfurization reactor include an operating temperature of 350-500° C., an absolute pressure of 1.0-3.5 MPa, a weight hourly space velocity of oil gas feedstock of 1-20 $h^{-1}$, and a hydrogen-oil molar ratio of 0.05-300.

E8, the method for the desulfurization of a catalytic cracking light product according to Item E1 or E2, wherein the operating conditions of the adsorbent regenerator include: a regeneration temperature of 300-800° C., and a regeneration pressure of 0.1-3.0 MPa.

E9, the method for the desulfurization of a catalytic cracking light product according to Item E8, wherein the operating conditions of the adsorbent regenerator include: a regeneration temperature of 350-600° C., and a regeneration pressure of 0.1-1.0 MPa.

E10, the method for the desulfurization of a catalytic cracking light product according to any one of Items E1-E9, wherein the desulfurization adsorbent comprises an adsorbent carrier and a metal component loaded on the adsorbent carrier, the content of the desulfurization adsorbent carrier is 70-95 wt %, the content of the metal component is 5-30 wt %, based on the total weight of the desulfurization adsorbent, the adsorbent carrier is a mixture of zinc oxide, silica and/or alumina, and the metal component is one or more selected from cobalt, nickel, copper, iron, manganese, molybdenum, tungsten, silver, tin and vanadium.

E11, the method for the desulfurization of a catalytic cracking light product according to Item E3, wherein the operating conditions of the absorber include: a pressure of 0.2-3.0 MPa, and a temperature of 20-100° C.; the operating conditions of the desorber include: a pressure of 0.1-3.0 MPa, and a temperature of 20-250° C.; the operating conditions of the reabsorber include: a pressure of 0.1-3.0 MPa, and a temperature of 20-100° C.; the operating conditions of the stabilizer include: a pressure of 0.1-3.0 MPa and a temperature of 20-250° C.

E12, the method for the desulfurization of a catalytic cracking light product according to Item E11, characterized in that the operating conditions of the absorber include: a pressure of 0.5-1.6 MPa, and a temperature of 30-70° C.; the operating conditions of the desorber include: a pressure of 0.5-2.5 MPa, and a temperature of 50-200° C.; the operating conditions of the reabsorber include: a pressure of 0.5-2.5 MPa, and a temperature of 30-70° C.; the operating conditions of the stabilizer include: a pressure of 0.5-2.5 MPa and a temperature of 50-200° C.

E13, a process for producing a low-sulfur light oil product by catalytic cracking, characterized in that a catalytic cracking feedstock is introduced into a riser reactor, contacted with a catalytic cracking catalyst for reaction under catalytic cracking conditions, and subjected to gas-solid separation at the top of the riser reactor, the resulting reaction oil gas is introduced into a catalytic cracking fractionator for fractionation to obtain a rich gas, a crude gasoline, a light cycle oil, a diesel oil and an oil slurry; the separated catalytic cracking catalyst is regenerated and then recycled to the riser reactor for reuse;

the crude gasoline and rich gas from the catalytic cracking fractionator are introduced into a first desulfurization reactor and a second desulfurization reactor, respectively, and subjected to adsorption desulfurization and absorption stabilization separation performed using the method defined in Items E1-E12 to obtain a desulfurized dry gas, a desulfurized liquefied gas and a desulfurized stabilized gasoline.

E14, an apparatus for the separation and desulfurization of a catalytic cracking light product, characterized in that the apparatus comprises an adsorption desulfurization unit and an absorption stabilization unit communicated in sequence; the adsorption desulfurization unit comprises a first desulfurization reactor, a reactor receiver, a lock hopper, a regenerator feed tank, an adsorbent regenerator and a regenerator receiver communicated in sequence, wherein the regenerator receiver is communicated with an adsorbent reducer through the lock hopper, the adsorbent reducer is in communication with the bottom of the first desulfurization reactor, the middle-lower part of the first desulfurization reactor is in communication with a second desulfurization reactor, and the top of the second desulfurization reactor is in communication with the upper part of the first desulfurization reactor; the absorption stabilization unit consists of an absorber, a desorber, a reabsorber and a stabilizer communicated in sequence.

E15, the apparatus for the separation and desulfurization of a catalytic cracking light product according to Item E14, characterized in that the first desulfurization reactor is communicated at a position of 20-60% of the height thereof from bottom to top with the bottom of the second desulfurization reactor, the first desulfurization reactor is communicated at a position of 60-90% of the height thereof from bottom to top with the top of the second desulfurization reactor, a gas-solid separation equipment is provided in a settling section at the upper part of the first desulfurization reactor, and a gas-solid separation equipment is provided or not provided at the upper part of the second desulfurization reactor.

F1, a method for the desulfurization of a catalytic cracking light product, comprising the steps of:

(1) introducing a crude gasoline from a catalytic cracking fractionator into a first desulfurization reactor from the bottom, and contacting it with a desulfurization adsorbent desulfurization in the presence of hydrogen while flowing upwards in a concurrent manner; subjecting the reaction oil gas and the desulfurization adsorbent to gas-solid separation in a settling zone at the upper part of the first desulfurization reactor, introducing a part of the sulfur-loaded adsorbent into an upper part of a second desulfurization reactor from the top of the adsorbent bed layer through a slide valve, regenerating another part of the sulfur-loaded adsorbent in an adsorbent regenerator by calcining, and recycling the regenerated desulfurization adsorbent to the bottom of the first desulfurization reactor for reuse after reduction;

(2) introducing the rich gas from the catalytic cracking fractionator into a second desulfurization reactor from the bottom, and contacting it with the desulfurization adsorbent in a countercurrent manner for adsorption desulfurization reaction, and recycling the desulfurization adsorbent from the bottom of the second desulfurization reactor to the first desulfurization reactor after the reaction;

(3) separately sending the desulfurized crude gasoline obtained from the top of the first desulfurization reactor and the desulfurized rich gas obtained from the top of the second desulfurization reactor to an absorption stabilization unit for further separation to obtain a desulfurized dry gas, a desulfurized liquefied gas and a desulfurized stabilized gasoline.

F2, the method for the desulfurization of a catalytic cracking light product according to Item F1, wherein the desulfurized rich gas is introduced into an absorber from the bottom, and contacted with the desulfurized crude gasoline introduced into the absorber from the top for absorption, the overhead stream of the absorber is introduced into a reabsorber from the bottom, and contacted with a light cycle oil from a catalytic cracking fractionator in a countercurrent manner for absorption, a desulfurized dry gas is obtained from the top of the reabsorber, and the enriched light cycle oil obtained at the bottom of the reabsorber is recycled to the catalytic cracking fractionator; and the bottom product of the absorber is sent to a stabilizer after passing through a desorber, fractionated in the stabilizer to obtain a desulfurized liquefied gas and a desulfurized stabilized gasoline, and the overhead gas of the desorber is recycled to the absorber.

F3, the method for the desulfurization and separation of a catalytic cracking light product according to Item F1 or F2, wherein the feed gas velocity of the first desulfurization reactor is 0.25-10 m/s and the feed gas velocity of the second desulfurization reactor is 0.05-1.5 m/s; the first desulfurization reactor and the second desulfurization reactor are fluidized bed reactors.

F4, the method for the desulfurization of a catalytic cracking light product according to Item F1 or F2, wherein the conditions of the first desulfurization reactor include an operating temperature of 200-550° C., an absolute pressure of 0.5-5 MPa, a weight hourly space velocity of oil gas feedstock of 0.1-100 $h^{-1}$, and a hydrogen-to-oil molar ratio of 0.01-1000.

F5, the method for the desulfurization of a light catalytic cracking product according to Item F4, wherein the conditions of the first desulfurization reactor include an operating temperature of 300-500° C., an absolute pressure of 1.0-3.5 MPa, a weight hourly space velocity of oil gas feedstock of 1-10 $h^{-1}$, and a hydrogen-to-oil molar ratio of 0.05-500.

F6, the method for the desulfurization of a catalytic cracking light product according to Item F1 or F2, wherein the conditions of the second desulfurization reactor include an operating temperature of 300-550° C., an absolute pressure of 0.5-5 MPa, a weight hourly space velocity of oil gas feedstock of 0.1-100 $h^{-1}$, and a hydrogen-to-oil molar ratio of 0.01-500.

F7, the method for the desulfurization of a light catalytic cracking product according to Item F6, wherein the conditions of the second desulfurization reactor include an operating temperature of 350-500° C., an absolute pressure of 1.0-3.5 MPa, a weight hourly space velocity of oil gas feedstock of 1-20 $h^{-1}$, and a hydrogen-to-oil molar ratio of 0.05-300.

F8, the method for the desulfurization of a catalytic cracking light product according to Item F1 or F2, wherein the operating conditions of the adsorbent regenerator include: a regeneration temperature of 300-800° C., and a regeneration pressure of 0.1-3.0 MPa.

F9, the method for the desulfurization of a catalytic cracking light product according to Item F8, wherein the operating conditions of the adsorbent regenerator include: a regeneration temperature of 350-600° C., and a regeneration pressure of 0.1-1.0 MPa.

F10, the method for the desulfurization of a catalytic cracking light product according to any one of Items F1-F9, wherein the desulfurization adsorbent comprises a desulfurization adsorbent carrier and a metal component supported on the adsorbent carrier, and the content of the desulfurization adsorbent carrier is 70-95 wt % and the content of the metal component is 5-30 wt %, based on the total weight of the desulfurization adsorbent.

F11, the method for the desulfurization of a catalytic cracking light product according to Item F2, wherein the operating conditions of the absorber include: a pressure of 0.2-3.0 MPa, and a temperature of 20-100° C.; the operating conditions of the desorber include: a pressure of 0.1-3.0 MPa, and a temperature of 20-250° C.; the operating conditions of the reabsorber include: a pressure of 0.1-3.0 MPa, and a temperature of 20-100° C.; the operating conditions of the stabilizer include: a pressure of 0.1-3.0 MPa and a temperature of 20-250° C.

F12, the method for the desulfurization of a catalytic cracking light product according to Item F11, characterized in that the operating conditions of the absorber include: a pressure of 0.5-1.6 MPa, and a temperature of 30-70° C.; the operating conditions of the desorber include: a pressure of 0.5-2.5 MPa, and a temperature of 50-200° C.; the operating conditions of the reabsorber include: a pressure of 0.5-2.5 MPa, and a temperature of 30-70° C.; the operating conditions of the stabilizer include: a pressure of 0.5-2.5 MPa and a temperature of 50-200° C.

F13, a process for producing a low-sulfur light oil product by catalytic cracking, characterized in that a catalytic cracking feedstock is introduced into a riser reactor, contacted with a catalytic cracking catalyst for reaction under catalytic cracking conditions, and subjected to gas-solid separation at the top of the riser reactor, the resulting reaction oil gas is introduced into a catalytic cracking fractionator for fractionation to obtain a rich gas, a crude gasoline, a light cycle oil, a diesel oil and an oil slurry; the separated catalytic cracking catalyst is regenerated and then recycled to the riser reactor for reuse; and the crude gasoline and the rich gas are introduced into a first desulfurization reactor and a second desulfurization reactor, respectively, and subjected to adsorption desulfurization and absorption stabilization separation performed using the method for the desulfurization of a catalytic cracking light product defined in Items F1-F12 to obtain a desulfurized dry gas, a desulfurized liquefied gas and a desulfurized stabilized gasoline.

F14, an apparatus for the desulfurization of a catalytic cracking light product, characterized in that the apparatus comprises an adsorption desulfurization unit and an absorption stabilization unit communicated in sequence; the adsorption desulfurization unit comprises a first desulfurization reactor, a reactor receiver, a lock hopper, a regenerator feed tank and an adsorbent regenerator communicated in sequence, the adsorbent regenerator is communicated sequentially with a regenerator receiver, the lock hopper, an adsorbent reducer and the bottom of the first desulfurization reactor, the upper part of the first desulfurization reactor is in communication with the upper part of a second desulfurization reactor, and the bottom of the second desulfurization reactor is in communication with the bottom of the first desulfurization reactor; the absorption stabilization unit consists of an absorber, a desorber, a reabsorber and a stabilizer communicated in sequence.

F15, the apparatus for the desulfurization of a catalytic cracking light product according to Item F14, wherein the first desulfurization reactor is communicated at a position of 50-90% of the height thereof from bottom to top with the second desulfurization reactor at a position of 80-90% of the height thereof from bottom to top.

EXAMPLES

The following examples are provided for further illustrating the present application but are not intended to be limiting in any manner. The feedstock rich gas and crude gasoline used in the examples were obtained from a catalytic cracking unit of Yanshan Division of China Petroleum & Chemical Corporation. The desulfurization adsorbent is available from Nanjing Catalyst Branch of China Petroleum & Chemical Corporation, under a trade name of FCAS, which comprises zinc oxide, silica and alumina as a carrier, and Ni as a promoter, of which the properties are listed in Table 1.

TABLE 1

| Properties of the desulfurization adsorbent | |
|---|---|
| Elemental composition, wt % | |
| ZnO | 58.5 |
| NiO | 20.1 |
| $Al_2O_3$ | 12.6 |
| $SiO_2$ | 8.8 |
| Specific surface area, $m^2/g$ | 28 |
| Pore volume, $cm^3/g$ | 0.21 |

In each of the examples and comparative examples, the sulfur content in dry gas and liquefied gas was analyzed by GC-SCD on Agilent GC-7890A gas chromatograph. The sulfur content in gasoline was analyzed by a ZSX100X X-ray fluorescence spectrometer manufactured by Rigaku Corporation. The hydrocarbon composition of dry gas, liquefied gas and gasoline was analyzed and determined by gas chromatography.

The method for calculating the ethylene saturation rate, the propylene saturation rate and the olefin saturation rate in the gasoline is as follows: the mass fractions of ethylene in dry gas, propylene in liquefied gas and olefins in gasoline obtained after adsorption desulfurization and absorption stabilization separation in Comparative Example 2 and various examples are determined by taking the mass contents of ethylene in the dry gas, propylene in the liquefied gas and olefins in the gasoline that have not been desulfurized in the Comparative Example 1 as references, and the mass percentage of the difference between the reference value and the value determined after desulfurization relative to the reference value is taken as the saturation rate of the corresponding olefin.

Ethylene saturation rate=((mass fraction of ethylene in Comparative Example 1−mass fraction of ethylene after desulfurization)/mass fraction of ethylene in Comparative Example 1)×100%;

Propylene saturation rate=((mass fraction of propylene in Comparative Example 1−mass fraction of propylene after desulfurization)/mass fraction of propylene in Comparative Example 1)×100%;

Gasoline olefin saturation rate=((mass fraction of olefins in gasoline in Comparative Example 1−mass fraction of olefins in gasoline after desulfurization)/mass fraction of olefins in gasoline in Comparative Example 1)×100%.

Comparative Example 1

Taking the catalytic cracking unit of Yanshan Division as an example, the rich gas and crude gasoline produced by a catalytic cracking fractionator were introduced into an absorption stabilization unit of the catalytic cracking unit separately, the rich gas was introduced into an absorber from the bottom and contacted with the crude gasoline introduced into the absorber from the top for mass transfer, the overhead stream of the absorber was introduced into a reabsorber from the bottom and contacted with a light cycle oil from the catalytic cracking fractionator in a countercurrent manner for mass transfer, a dry gas was obtained at the top of the reabsorber, and the enriched light cycle oil obtained at the bottom of the reabsorber was recycled to the catalytic cracking fractionator; and the bottom product of the absorber was sent to a stabilizer after passing through a desorber, fractionated in the stabilizer to obtain a liquefied gas and a stabilized gasoline, and the overhead gas of the desorber was recycled to the absorber.

The properties of the non-desulfurized dry gas, liquefied gas and stabilized gasoline obtained are shown in Table 2.

Comparative Example 2

The stabilized gasoline obtained in the Comparative Example 1 was used as a feedstock, and introduced into a gasoline fluidized bed desulfurization reactor to contact with a desulfurization adsorbent for adsorption desulfurization reaction, the reaction oil gas and the sulfur-loaded adsorbent were subjected to gas-solid separation at the top of the adsorption desulfurization reactor, and the separated reaction oil gas was cooled to obtain a desulfurized stabilized gasoline. The separated sulfur-loaded adsorbent was introduced into an adsorbent regenerator, and regenerated by reacting and calcining in the presence of an oxygen-containing gas under regeneration conditions, and the regenerated desulfurization adsorbent was introduced into an adsorbent reducer to react with a reducing gas under reduction conditions to obtain a reduced desulfurization adsorbent, which was recycled to the adsorption desulfurization reactor for reuse.

The desulfurization adsorbent used was FCAS, of which the properties are shown in Table 1, the adsorption desulfurization reaction was carried out under the reaction conditions including a reaction temperature of 400° C., a reaction pressure of 2.0 MPa, a weight hourly space velocity of 5 $h^{-1}$ and a hydrogen-to-oil volume ratio of 45, and the results are shown in Table 2. The sulfur content of the desulfurized stabilized gasoline was 2.6 ppm, the octane number loss was 0.8 unit, and the yield of the refined gasoline was reduced by 0.6%.

TABLE 2

Results of Comparative Examples 1-2

| Item | Comparative Example 1 | Comparative Example 2 |
|---|---|---|
| Dry gas | | |
| Yield, wt % | 1.7 | — |
| Sulfur content, ppm | 2126 | — |
| Ethylene saturation rate, % | Reference | — |
| Liquefied gas | | |
| Yield, wt % | 11.3 | — |
| Sulfur content, ppm | 6351 | — |
| Propylene saturation rate, % | Reference | — |

TABLE 2-continued

Results of Comparative Examples 1-2

| Item | Comparative Example 1 | Comparative Example 2 |
|---|---|---|
| Stabilized gasoline | | |
| Density (20° C.), kg/m$^3$ | 731.2 | 731.5 |
| Yield, wt % | 45.7 | 45.1 |
| Sulfur content, ppm | 256 | 2.6 |
| Olefin saturation rate, % | Reference | 16.08 |
| RON | Reference | −0.8 |

Example I-1

The effect of adsorption desulfurization on the whole overhead light fraction of the catalytic cracking fractionator is evaluated on a small fixed fluidized bed reactor.

A mixture of rich gas and crude gasoline from the catalytic cracking fractionator was used as a feedstock, which was firstly introduced into an adsorption desulfurization reaction unit for desulfurization, and then introduced into an absorption stabilization unit for separation. The process flow of the adsorption desulfurization unit shown in FIG. 1A was adopted, in which a mixture of the rich gas and crude gasoline was introduced into a fluidized bed desulfurization reactor from the bottom, reacted under the reaction conditions including a reaction temperature of 400° C., a reaction pressure of 2.0 MPa, a weight hourly space velocity of 5 $h^{-1}$ and a hydrogen-to-oil volume ratio 45 in the presence of FCAS as a desulfurization adsorbent, the oil gas obtained after the reaction was separated from the desulfurization adsorbent, and then passed into a gas-liquid separation tank for cooling and separation to obtain a desulfurized rich gas and a desulfurized crude gasoline. The process flow of the absorption stabilization unit shown in FIG. 2 was adopted, in which the desulfurized rich gas separated from the gas-liquid separation tank was introduced into an absorber from the bottom, the pressure at the top of the absorber was 1.405 MPa, the temperature at the top of the absorber was 34.5° C., and the temperature at the bottom of the absorber was 43.3° C.; the desulfurized crude gasoline separated from the gas-liquid separation tank was introduced into the absorber from the upper part, contacted with the rich gas in a countercurrent manner for mass transfer, the overhead stream of the absorber was introduced into a reabsorber from the bottom, contacted with a light cycle oil from the catalytic cracking fractionator in a countercurrent manner for mass transfer, wherein the pressure at the top of the reabsorber was 1.370 MPa, the temperature at the top of the reabsorber was 34.3° C., the temperature at the bottom of the reabsorber was 41.8° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.477 MPa, the temperature at the top of the desorber was 76.5° C., the temperature at the bottom of the desorber was 131.9° C., the bottom product of the desorber was sent to a stabilizer, the pressure at the top of the stabilizer was 0.889 MPa, the temperature at the top of the stabilizer was 57.8° C., the temperature at the bottom of the stabilizer was 167.6° C., the bottom product was fractionated in the stabilizer to obtain a desulfurized liquefied gas and a desulfurized stabilized gasoline, and the overhead gas of the desorber was recycled to the absorber.

The properties of the resulting desulfurized dry gas, desulfurized liquefied gas, and desulfurized stabilized gasoline are shown in Table I-3.

Example I-2

An experiment was carried out using a mixture of the rich gas and crude gasoline obtained from the catalytic cracking fractionator as the feedstock, using the same reaction procedure and desulfurization adsorbent as in Example I-1, except that the reaction oil gas and the desulfurization adsorbent were contacted and reacted in the fluidized bed desulfurization reactor under reaction conditions including a reaction temperature of 430° C., a reaction pressure of 1.4 MPa, a weight hourly space velocity of 8 $h^{-1}$, and a hydrogen-to-oil volume ratio of 100, and the oil gas was separated from the desulfurization adsorbent after the reaction, and was cooled and separated in a gas-liquid separation tank to obtain a desulfurized rich gas and a desulfurized crude gasoline. The rich gas separated from the gas-liquid separation tank was introduced into an absorber from the bottom, the pressure at the top of the absorber was 1.432 MPa, the temperature at the top of the absorber was 33.8° C., and the temperature at the bottom of the absorber was 45.6° C.; the crude gasoline separated from the gas-liquid separation tank was introduced into the absorber from the upper part and contacted with the rich gas in a countercurrent manner for mass transfer, the overhead stream of the absorber was introduced into a reabsorber from the bottom and contacted with a light cycle oil from the catalytic cracking fractionator in a countercurrent manner for mass transfer, the pressure at the top of the reabsorber was 1.395 MPa, the temperature at the top of the reabsorber was 35.9° C., the temperature at the bottom of the reabsorber was 45.1° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.562 MPa, the temperature at the top of the desorber was 80.9° C., the temperature at the bottom of the desorber was 143.5° C., the bottom product of the desorber was sent to a stabilizer, the pressure at the top of the stabilizer was 0.912 MPa, the temperature at the top of the stabilizer was 59.8° C., the temperature at the bottom of the stabilizer was 172.3° C., the bottom product was fractionated in the stabilizer to obtain a desulfurized liquefied gas and a desulfurized stabilized gasoline, and the overhead gas of the desorber was recycled to the absorber. The properties of the resulting desulfurized dry gas, desulfurized liquefied gas, and desulfurized stabilized gasoline are shown in Table I-3.

TABLE I-3

Comparison of the results of Comparative Example 1-2 and Examples I-1 to I-2

| Item | Comparative Example 1 | Comparative Example 2 | Example I-1 | Example I-2 |
|---|---|---|---|---|
| Dry gas | | | | |
| Yield, wt % | 1.7 | — | 1.8 | 1.8 |
| Sulfur content, ppm | 2126 | — | 0.69 | 0.58 |
| Ethylene saturation rate, % | Reference | — | 28.9 | 30.3 |
| Liquefied gas | | | | |
| Yield, wt % | 11.3 | — | 11.3 | 11.4 |
| Sulfur content, ppm | 6351 | — | 1.6 | 1.1 |
| Propylene saturation rate, % | Reference | — | 17.12 | 17.98 |
| Stabilized gasoline | | | | |
| Density (20° C.), kg/m³ | 731.2 | 731.5 | 731.1 | 731.4 |
| Yield, wt % | 45.7 | 45.1 | 45.6 | 45.5 |
| Sulfur content, ppm | 256 | 2.6 | 1.9 | 1.4 |
| Olefin saturation rate, % | Reference | 16.08 | 14.93 | 15.21 |
| RON | Reference | −0.8 | −0.7 | −0.7 |

As can be seen from the results in Table I-3, the method for the desulfurization and separation of catalytic cracking light product according to the present application can realize the desulfurization of dry gas and liquefied gas at the same time, the yield of the dry gas and the yield of the liquefied gas are respectively increased by 0.1%, the yield of stabilized gasoline is increased by 0.4-0.5%, the sulfur content of the stabilized gasoline is reduced, and the octane number loss is reduced.

Example II-1

Example II-1 is provided to show the effect of subjecting the rich gas and crude gasoline to adsorption desulfurization at the same time. The rich gas and the crude gasoline from the catalytic cracking fractionator were used as feedstocks, and were firstly introduced into an adsorption desulfurization reaction unit for desulfurization in accordance with the process flow shown in FIG. 1B, and then introduced into an absorption stabilization unit for separation in accordance with the process flow shown in FIG. 2. The crude gasoline from the catalytic cracking fractionator was introduced into a fluidized bed desulfurization reactor from the bottom, reacted in the presence of FCAS as a desulfurization adsorbent under the reaction conditions including a reaction temperature of 400° C., a reaction pressure of 2.0 MPa, a weight hourly space velocity of 5 $h^{-1}$ and a hydrogen-to-oil volume ratio of 45, the rich gas from the catalytic cracking fractionator was introduced into the fluidized bed desulfurization reactor at a position of 60% of the height thereof from bottom to top, the height of the desulfurization adsorbent bed layer through which the rich gas passed was controlled to be 20% of the total height of the adsorbent bed layer in the reactor, the sulfur-containing rich gas was mixed with the reaction oil gas and the desulfurization adsorbent for adsorption desulfurization reaction, and the oil gas obtained after the reaction was introduced into a gas-liquid separation tank for cooling and separation to obtain a desulfurized rich gas and a desulfurized crude gasoline. The rich gas separated from the gas-liquid separation tank was introduced into an absorber from the bottom, the pressure at the top of the absorber was 1.758 MPa, the temperature at the top of the absorber was 43.6° C., and the temperature at the bottom of the absorber was 52.7° C.; the crude gasoline separated from the gas-liquid separation tank was introduced into the absorber from the upper part and contacted with the rich gas in a countercurrent manner for mass transfer, the overhead stream of the absorber was introduced into a reabsorber from the bottom and contacted with a light cycle oil from the catalytic cracking fractionator in a countercurrent manner for mass transfer, the pressure at the top of the reabsorber was 1.632 MPa, the temperature at the top of the reabsorber was 42.5° C., the temperature at the bottom of the reabsorber was 54.1° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.853 MPa, the temperature at the top of the desorber was 84.9° C., the temperature at the bottom of the desorber was 156.8° C., the bottom product of the absorber was sent to a stabilizer, the pressure at the top of the stabilizer was 1.056 MPa, the temperature at the top of the stabilizer was 63.8° C., the temperature at the bottom of the stabilizer was 174.5° C., the bottom product was fractionated in the stabilizer to obtain a desulfurized liquefied gas and a desulfurized stabilized gasoline, and the overhead gas of the desorber was recycled to the absorber.

The properties of the resulting desulfurized dry gas, desulfurized liquefied gas and desulfurized gasoline are shown in Table II-3.

Example II-2

An experiment was carried out using the rich gas and crude gasoline from the catalytic cracking fractionator as feedstocks as described in Example II-1, except that the reaction temperature in the fluidized bed desulfurization reactor was 430° C., the reaction pressure was 1.4 MPa, the weight hourly space velocity was 8 $h^{-1}$, and the hydrogen-to-oil volume ratio was 100, the rich gas was preheated to 430° C. and then introduced into the fluidized bed desulfurization reactor at a position of 40% of the height thereof from bottom to top, and the adsorbent bed through which the rich gas passed was controlled to be 30% of the total height of the adsorbent bed in the reactor. The oil gas obtained after the reaction was cooled and separated in a gas-liquid separation tank to obtain a desulfurized rich gas and a desulfurized crude gasoline. The desulfurized rich gas was introduced into an absorber from the bottom, the pressure at the top of the absorber was 1.772 MPa, the temperature at the top of the absorber was 42.3° C., and the temperature at the bottom of the absorber was 49.8° C.; the desulfurized crude gasoline was introduced into the absorber from the upper part, contacted with the rich gas in a countercurrent manner for mass transfer, the overhead stream of the absorber was introduced into a reabsorber from the bottom, contacted with a light cycle oil from the catalytic cracking fractionator in a countercurrent manner for mass transfer, wherein the pressure at the top of the reabsorber was 1.598 MPa, the temperature at the top of the reabsorber was 43.5° C., the temperature at the bottom of the reabsorber was 47.6° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.918 MPa, the temperature at the top of the desorber was 85.3° C., the temperature at the bottom of the desorber was 155.2° C., the bottom product of the desorber was sent to a stabilizer, the pressure at the top of the stabilizer was 0.919 MPa, the temperature at the top of the stabilizer was 59.5° C., the temperature at the bottom of the stabilizer was 169.7° C., the bottom product was fractionated in the stabilizer to obtain a desulfurized liquefied gas and a desulfurized stabilized gasoline, and the overhead gas of the desorber was recycled to the absorber.

The properties of the resulting desulfurized dry gas, desulfurized liquefied gas, and desulfurized stabilized gasoline are shown in Table II-3.

TABLE II-3

Comparison of the results of Comparative Example 1-2 and Examples II-1 to II-2

| Item | Comparative Example 1 | Comparative Example 2 | Example II-1 | Example II-2 |
|---|---|---|---|---|
| Dry gas | | | | |
| Yield, % | 1.7 | — | 1.8 | 1.8 |
| Sulfur content, ppm | 2126 | — | 0.8 | 1.5 |
| Ethylene saturation rate, % | Reference | — | 18.5 | 16.1 |
| Liquefied gas | | | | |
| Yield, % | 11.3 | — | 11.3 | 11.4 |
| Sulfur content, ppm | 6351 | — | 1.3 | 1.6 |
| Propylene saturation rate, % | Reference | — | 11.2 | 9.8 |
| Stabilized gasoline | | | | |
| Density (20° C.), $kg/m^3$ | 731.2 | 731.5 | 731.1 | 731.2 |
| Yield, % | 45.7 | 45.1 | 45.6 | 45.5 |
| Sulfur content, ppm | 256 | 2.6 | 2.1 | 1.3 |
| Olefin saturation rate, % | Reference | 16.08 | 14.3 | 13.2 |
| RON | Reference | −0.8 | −0.7 | −0.7 |

As can be seen from the results in Table II-3, the method for the desulfurization and separation of catalytic cracking light product according to the present application can realize the desulfurization of dry gas and liquefied gas at the same time, the yield of the dry gas and the yield of the liquefied gas are respectively increased by 0.1%, the yield of stabilized gasoline is increased by 0.4-0.5%, the sulfur content of the stabilized gasoline is reduced, and the octane number loss is reduced.

Example III-1

The process flow of the adsorption desulfurization unit shown in FIG. 1C was adopted, the first fluidized bed desulfurization reactor was a fixed fluidized bed reactor, the desulfurization adsorbent was introduced into the first fluidized bed desulfurization reactor from the bottom, the crude gasoline from the catalytic cracking fractionator and hydrogen were introduced into the first fluidized bed desulfurization reactor from the bottom, and contacted with the desulfurization adsorbent for adsorption desulfurization, and the reaction was performed under the reaction conditions including a reaction temperature of 400° C., a reaction pressure of 2.2 MPa, a weight hourly space velocity of 5 $h^{-1}$, and a hydrogen-to-oil volume ratio of 45. A mixture of a desulfurized crude gasoline and hydrogen was obtained after the reaction. The second fluidized bed desulfurization reactor was a fixed fluidized bed reactor, the desulfurization adsorbent from the first fluidized bed desulfurization reactor was introduced into the bottom of the second fluidized bed desulfurization reactor through an adsorbent transferring tank, the rich gas from the catalytic cracking fractionator was preheated to 400° C. and then was introduced into the second fluidized bed reactor, the reaction temperature was 400° C., the reaction pressure was 1.0 MPa, the weight hourly space velocity was 10 $h^{-1}$, and a desulfurized rich gas was obtained after the reaction. The desulfurized rich gas was introduced into an absorber from the bottom, the desulfurized crude gasoline was introduced into the absorber from the upper part and contacted with the rich gas in a countercurrent manner for mass transfer, the pressure at the top of the absorber was 1.214 MPa, the temperature at the top of the absorber was 30.1° C., and the temperature at the bottom of the absorber was 50.6° C.; the overhead stream of the absorber was introduced into a reabsorber from the bottom and contacted with a light cycle oil from the catalytic cracking fractionator in a countercurrent manner for mass transfer, the pressure at the top of the reabsorber was 1.158 MPa, the temperature at the top of the reabsorber was 32.3° C., the temperature at the bottom of the reabsorber was 48.9° C., a desulfurized dry gas was obtained at the top of the reabsorber, and the enriched light cycle oil obtained at the bottom of the reabsorber was recycled to the catalytic cracking fractionator; and the bottom product of the absorber is desorbed in a desorber, wherein the pressure at the top of the desorber was 1.582 MPa, the temperature at the top of the desorber was 68.4° C., the temperature at the bottom of the desorber was 159.6° C., the bottom product of the desorber was sent to a stabilizer, the pressure at the top of the stabilizer was 1.025 MPa, the temperature at the top of the stabilizer was 68.9° C., the temperature at the bottom of the stabilizer was 178.3° C., the bottom product was fractionated in the stabilizer to obtain a desulfurized liquefied gas and a desulfurized stabilized gasoline, and the overhead gas of the desorber was recycled to the absorber. The results are shown in Table III-3.

Example III-2

An experiment was carried out using the same reaction scheme, feedstocks and desulfurization adsorbent as in Example III-1, except that the first fluidized bed desulfurization reactor was operated under the reaction conditions including a reaction temperature of 440° C., a reaction pressure of 1.4 MPa, a weight hourly space velocity of 8 $h^{-1}$, and a hydrogen-to-oil volume ratio of 100, to obtain a desulfurized crude gasoline. The reaction conditions of the second fluidized bed desulfurization reactor included: a reaction temperature of 430° C., a reaction pressure of 0.5 MPa, a weight hourly space velocity of 12 $h^{-1}$, and a desulfurized rich gas was obtained. The desulfurized rich gas was introduced into the absorber from the bottom, the desulfurized crude gasoline was introduced into the absorber from the upper part and contacted with the rich gas in a countercurrent manner for mass transfer, the pressure at the top of the absorber was 1.255 MPa, the temperature at the top of the absorber was 40.5° C., and the temperature at the bottom of the absorber was 50.2° C.; the overhead stream of the absorber was introduced into a reabsorber from the bottom and contacted with a light cycle oil from the catalytic cracking fractionator in a countercurrent manner for mass transfer, the pressure at the top of the reabsorber was 1.189 MPa, the temperature at the top of the reabsorber was 41.8° C., the temperature at the bottom of the tower was 48.6° C., a desulfurized dry gas was obtained at the top of the reabsorber, and the enriched light cycle oil obtained at the bottom of the reabsorber was recycled to the catalytic cracking fractionator; and the bottom product of the absorber is desorbed in a desorber, wherein the pressure at the top of the desorber was 1.251 MPa, the temperature at the top of the desorber was 56.2° C., the temperature at the bottom of the desorber was 118.9° C., the bottom product was introduced into a stabilizer, the pressure at the top of the stabilizer was 0.812 MPa, the temperature at the top of the stabilizer was 53.1° C., the temperature at the bottom of the stabilizer was 159.8° C., the bottom product was fractionated in the stabilizer to obtain a desulfurized liquefied gas and a desulfurized stabilized gasoline, and the overhead gas of the desorber was recycled to the absorber. The results are shown in Table III-3.

TABLE III-3

Comparison of the results of Comparative Example 1-2 and Examples III-1 to III-2

| Components | Item | Comparative Example 1 | Comparative Example 2 | Example III-1 | Example III-2 |
|---|---|---|---|---|---|
| Dry gas | Yield, % | 1.7 | — | 1.8 | 1.8 |
| | Sulfur content, ppm | 2126 | — | 2.6 | 1.7 |
| | Ethylene saturation rate, % | Reference | — | 7.9 | 4.5 |
| Liquefied gas | Yield, % | 11.3 | — | 11.3 | 11.4 |
| | Sulfur content, ppm | 6351 | — | 2.9 | 3.1 |
| | Propylene saturation rate, % | Reference | — | 3.5 | 1.2 |
| Stabilized gasoline | Density (20° C.), $kg/m^3$ | 731.2 | 731.5 | 731.1 | 731.3 |
| | Yield, % | 45.7 | 45.1 | 45.6 | 45.5 |
| | Sulfur content, ppm | 256 | 2.6 | 2.2 | 1.8 |
| | Olefin saturation rate, % | Reference | 16.08 | 13.8 | 9.8 |
| | RON | Reference | −0.8 | −0.7 | −0.5 |

As can be seen from the Table III-3, the method for the desulfurization of catalytic cracking light product according to the present application can realize the desulfurization of dry gas and liquefied gas at the same time, the yield of the liquefied gas is increased by 0.1%, and the saturation rate of light olefins is low; the yield of the stabilized gasoline is increased by 0.4-0.5%, the olefin saturation rate of the stabilized gasoline is reduced by 3-6%, and the Research Octane Number (RON) loss is smaller.

Example IV-1

The sulfur-containing rich gas and crude gasoline from the catalytic cracking fractionator were treated using the process flow of the adsorption desulfurization unit as shown in FIG. 1D. The desulfurization adsorbent from a adsorbent reducer was introduced into a first fluidized bed desulfurization reactor from the bottom, the sulfur-containing crude gasoline was used as a feedstock and was introduced into the first fluidized bed desulfurization reactor from the bottom, and the reaction was carried out under the reaction conditions including a reaction temperature of 380° C., a reaction pressure of 2.0 MPa, a weight hourly space velocity of 5 $h^{-1}$ and a hydrogen-to-oil volume ratio of 60. The sulfur-containing rich gas was introduced into a second fluidized bed desulfurization reactor from the bottom, contacted with the desulfurization adsorbent from the first fluidized bed desulfurization reactor that had been reacted with the crude gasoline for desulfurization reaction, wherein the reaction temperature was 420° C., the reaction pressure was 2.0 MPa, and the weight hourly space velocity the 5 $h^{-1}$, a desulfurized rich gas was separated from the desulfurization adsorbent, and returned to the first fluidized bed desulfurization reactor, and the mixed desulfurized crude gasoline and rich gas products were further separated from the adsorbent in the first fluidized bed desulfurization reactor, and was passed to an absorption and stabilization unit. The process flow of the absorption and stabilization unit was shown in FIG. 2, in which the desulfurized rich gas was introduced into an absorber from the bottom, the pressure at the top of the absorber was 1.447 MPa, the temperature at the top of the absorber was 38.5° C., and the temperature at the bottom of the absorber was 44.6° C.; the desulfurized crude gasoline was introduced into the absorber from the upper part, contacted with the rich gas in a countercurrent manner for mass transfer, the overhead stream of the absorber was introduced into a reabsorber from the bottom, contacted with a light cycle oil from the catalytic cracking fractionator in a countercurrent manner for mass transfer, wherein the pressure at the top of the reabsorber was 1.394 MPa, the temperature at the top of the reabsorber was 36.8° C., the temperature at the bottom of the reabsorber was 45.4° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.536 MPa, the temperature at the top of the desorber was 78.9° C., the temperature at the bottom of the tower was 137.5° C., the bottom product of the desorber was sent to a stabilizer, the pressure at the top of the stabilizer was 0.872 MPa, the temperature at the top of the stabilizer was 55.3° C., the temperature at the bottom of the stabilizer was 160.7° C., the bottom product was fractionated in the stabilizer to obtain a desulfurized liquefied gas and a desulfurized stabilized gasoline, and the overhead gas of the desorber was recycled to the absorber. The properties of the resulting desulfurized dry gas, desulfurized liquefied gas, and desulfurized stabilized gasoline are shown in Table IV-3.

Example IV-2

The process flow of the adsorption desulfurization unit and the absorption stabilization unit shown in FIGS. 1D and 2 were adopted, in which the desulfurization adsorbent from an adsorbent reducer was introduced into the first fluidized bed desulfurization reactor from the bottom, the sulfur-containing crude gasoline feedstock was introduced into a first fluidized bed desulfurization reactor from the bottom, and reacted under the reaction conditions including a reaction temperature of 430° C., a reaction pressure of 1.4 MPa, a weight hourly space velocity of 8 $h^{-1}$ and a hydrogen-to-oil volume ratio of 100, the sulfur-containing rich gas was introduced into a second fluidized bed desulfurization reactor from the bottom, contacted with the desulfurization adsorbent from the first fluidized bed desulfurization reactor that had been reacted with the crude gasoline for desulfurization reaction, the reaction temperature was 445° C., the reaction pressure was 1.4 MPa, the weight hourly space velocity was 12 $h^{-1}$, a desulfurized rich gas was separated from the desulfurization adsorbent and returned to the first fluidized bed desulfurization reactor, the mixed desulfurized crude gasoline and rich gas products were further separated from the adsorbent in the first fluidized bed desulfurization reactor and then sent to an absorption stabilization unit. The desulfurized rich gas was introduced into an absorber from the bottom, the pressure at the top of the absorber was 1.658 MPa, the temperature at the top of the absorber was 45.1° C., and the temperature at the bottom of the absorber was 52.6° C.; the desulfurized crude gasoline was introduced into the absorber from the upper part, contacted with the rich gas in a countercurrent manner for mass transfer, the overhead stream of the absorber was introduced into a reabsorber from the bottom, contacted with a light cycle oil from the catalytic cracking fractionator in a countercurrent manner for mass transfer, wherein the pressure at the top of the reabsorber was 1.556 MPa, the temperature at the top of the reabsorber was 38.9° C., the temperature at the bottom of the reabsorber was 45.7° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.728 MPa, the temperature at the top of the desorber was 80.9° C., the temperature at the bottom of the desorber was 142.5° C., the bottom product of the tower was sent to a stabilizer, the pressure at the top of the stabilizer was 0.806 MPa, the temperature at the top of the stabilizer was 55.4° C., the temperature at the bottom of the stabilizer was 159.7° C., the bottom product was fractionated in the stabilizer to obtain a desulfurized liquefied gas and a desulfurized stabilized gasoline, and the overhead gas of the desorber was recycled to the absorber. The properties of the resulting desulfurized dry gas, desulfurized liquefied gas, and desulfurized stabilized gasoline are shown in Table IV-3.

TABLE IV-3

Comparison of the results of Comparative Example 1-2 and Examples IV-1 to IV-2

| Components | Item | Comparative Example 1 | Comparative Example 2 | Example IV-1 | Example IV-2 |
|---|---|---|---|---|---|
| Dry gas | Yield, % | 1.7 | — | 1.7 | 1.8 |
| | Sulfur content, ppm | 2126 | — | 0.7 | 1.4 |
| | Ethylene saturation rate, % | Reference | — | 15.3 | 13.0 |

TABLE IV-3-continued

Comparison of the results of Comparative Example 1-2 and Examples IV-1 to IV-2

| Components | Item | Comparative Example 1 | Comparative Example 2 | Example IV-1 | Example IV-2 |
|---|---|---|---|---|---|
| Liquefied gas | Yield, % | 11.3 | — | 11.3 | 11.4 |
| | Sulfur content, ppm | 6351 | — | 1.1 | 1.7 |
| | Propylene saturation rate, % | Reference | — | 10.1 | 7.8 |
| Stabilized gasoline | Density (20° C.), kg/m$^3$ | 731.2 | 731.5 | 731.1 | 731.2 |
| | Yield, % | 45.7 | 45.1 | 45.7 | 45.5 |
| | Sulfur content, ppm | 256 | 2.6 | 1.9 | 2.0 |
| | Olefin saturation rate, % | Reference | 16.08 | 14.0 | 13.5 |
| | RON | Reference | −0.8 | −0.8 | −0.7 |

The results in Table IV-3 show that the method for the desulfurization and separation of catalytic cracking light product according to the application can realize the desulfurization of dry gas and liquefied gas at the same time, the yield of the liquefied gas is increased by 0.1%, the yield of stabilized gasoline is increased by 0.4-0.6%, the sulfur content of the stabilized gasoline is reduced, the olefin saturation rate in the gasoline is reduced, and the octane number loss is reduced.

Example V-1

The process flow of the adsorption desulfurization unit shown in FIG. 1Ea was adopted, and the first fluidized bed desulfurization reactor and the second fluidized bed desulfurization reactor were fixed fluidized bed reactors. The desulfurization adsorbent was introduced into a first fluidized bed desulfurization reactor from the bottom, the crude gasoline from the catalytic cracking fractionator and hydrogen were introduced into the first fluidized bed desulfurization reactor from the bottom, contacted with the desulfurization adsorbent for adsorption desulfurization, and the reaction was carried out under the conditions including a reaction temperature of 410° C., a reaction pressure of 2.3 MPa, a weight hourly space velocity of 5 h$^{-1}$, and a hydrogen-to-oil volume ratio of 40. A part of the sulfur-loaded adsorbent was introduced into a second fluidized bed desulfurization reactor from the first fluidized bed desulfurization reactor at a position of 20% of the height thereof from bottom to top, the rich gas from the catalytic cracking fractionator was introduced into the second fluidized bed desulfurization reactor from the bottom, contacted with the desulfurization adsorbent for adsorption desulfurization, and the desulfurization reaction was carried out under the conditions including a reaction temperature of 430° C., a reaction pressure of 2.3 MPa, and a weight hourly space velocity of 8 h$^{-1}$. The reacted rich gas and the desulfurization adsorbent were returned to the first fluidized bed desulfurization reactor at a position of 70% of the height thereof from bottom to top. The reaction oil gas and the desulfurization adsorbent were separated in the first reactor. The reacted oil gas was separated in a gas-liquid separation tank to obtain a desulfurized rich gas and a desulfurized crude gasoline component, wherein the operating conditions of the gas-liquid separation tank included: a pressure of 1.926 MPa, and a temperature of 86° C.

The process flow of the absorption and stabilization unit was shown in FIG. 2, in which the desulfurized rich gas was introduced into an absorber from the bottom, the pressure at the top of the absorber was 1.853 MPa, the temperature at the top of the absorber was 55.6° C., and the temperature at the bottom of the absorber was 68.2° C.; the desulfurized crude gasoline was introduced into the absorber from the upper part, contacted with the rich gas in a countercurrent manner for mass transfer, the overhead stream of the absorber was introduced into a reabsorber from the bottom, contacted with a light cycle oil from the catalytic cracking fractionator in a countercurrent manner for mass transfer, wherein the pressure at the top of the reabsorber was 1.730 MPa, the temperature at the top of the reabsorber was 51.2° C., the temperature at the bottom of the reabsorber was 62.8° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.890 MPa, the temperature at the top of the desorber was 88.5° C., the temperature at the bottom of the desorber was 162.7° C., the bottom product of the absorber was sent to a stabilizer, the pressure at the top of the stabilizer was 1.251 MPa, the temperature at the top of the stabilizer was 68.7° C., the temperature at the bottom of the stabilizer was 189.6° C., the bottom product was fractionated in the stabilizer to obtain a desulfurized liquefied gas and a desulfurized stabilized gasoline, and the overhead gas of the desorber was recycled to the absorber. The properties of the resulting desulfurized dry gas, desulfurized liquefied gas and desulfurized stabilized gasoline are shown in Table V-3.

Example V-2

An experiment was carried out using the same desulfurization adsorbent and reaction scheme as in Example V-1, except that: the first fluidized bed desulfurization reactor was operated at a reaction temperature of 430° C., a reaction pressure of 1.4 MPa, a weight hourly space velocity of 8 h$^{-1}$, and a hydrogen-to-oil volume ratio of 100. A part of the sulfur-loaded adsorbent was passed to a second fluidized bed desulfurization reactor from the first fluidized bed desulfurization reactor at a position of 50% of the height thereof from bottom to top, a desulfurization reaction was carried out in the second fluidized bed desulfurization reactor under the conditions including a reaction temperature of 430° C., a reaction pressure of 1.4 MPa and a weight hourly space velocity of 12 h$^{-1}$, the reacted rich gas and the desulfurization adsorbent were returned to the first fluidized bed desulfurization reactor at a position of 90% of the height thereof from bottom to top.

The pressure at the top of the absorber was 1.806 MPa, the temperature at the top of the absorber was 55.2° C., and the temperature at the bottom of the absorber was 67.5° C.; the pressure at the top of the reabsorber was 1.711 MPa, the temperature at the top of the reabsorber was 50.5° C., the temperature at the bottom of the reabsorber was 62.1° C., and a desulfurized dry gas was obtained at the top of the reabsorber; the pressure at the top of the desorber was 1.838 MPa, the temperature at the top of the desorber was 85.1° C., the temperature at the bottom of the desorber was 160.4° C., the bottom product was sent to a stabilizer, the pressure at the top of the stabilizer was 1.202 MPa, the temperature at the top of the stabilizer was 65.3° C., the temperature at the bottom of the stabilizer was 185.2° C., and a desulfurized liquefied gas and a desulfurized stabilized gasoline were obtained after fractionation in the stabilizer. The properties of the resulting desulfurized dry gas, desulfurized liquefied gas and desulfurized stabilized gasoline are shown in Table V-3.

Example V-3

An experiment was carried out using the same desulfurization adsorbent and reaction scheme as in Example V-1, except that: the adsorption desulfurization unit was shown in FIG. 1Eb, and the operating conditions of the first fluidized bed desulfurization reactor included: a reaction temperature of 380° C., a reaction pressure of 2.5 MPa, a weight hourly space velocity of 7 $h^{-1}$, and a hydrogen-to-oil volume ratio of 60. A part of the sulfur-loaded adsorbent was introduced into a second fluidized bed desulfurization reactor from the first fluidized bed desulfurization reactor at a position of 60% of the height thereof from bottom to top; the operating conditions of the second fluidized bed desulfurization reactor included a reaction temperature of 445° C., a reaction pressure of 1.0 MPa, and a weight hourly space velocity of 5 $h^{-1}$. The reacted rich gas and the desulfurization adsorbent were separated in the second fluidized bed desulfurization reactor, the desulfurized rich gas was sent to an absorption stabilization system, and the desulfurization adsorbent was recycled to the first fluidized bed desulfurization reactor at a position of 90% of the height thereof from bottom to top. The desulfurized crude gasoline was separated from the adsorbent in the first reactor.

The desulfurized rich gas was introduced into an absorber from the bottom, the pressure at the top of the absorber was 1.453 MPa, the temperature at the top of the absorber was 33.6° C., and the temperature at the bottom of the absorber was 45.1° C.; the desulfurized crude gasoline was introduced into the absorber from the upper part, contacted with the rich gas in a countercurrent manner for mass transfer, the overhead stream of the absorber was introduced into a reabsorber from the bottom, contacted with a light cycle oil from the catalytic cracking fractionator in a countercurrent manner for mass transfer, wherein the pressure at the top of the reabsorber was 1.389 MPa, the temperature at the top of the reabsorber was 35.6° C., the temperature at the bottom of the reabsorber was 45.7° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.623 MPa, the temperature at the top of the desorber was 63.9° C., the temperature at the bottom of the desorber was 145.4° C., the bottom product of the desorber was sent to a stabilizer, the pressure at the top of the stabilizer was 0.935 MPa, the temperature at the top of the stabilizer was 52.4° C., the temperature at the bottom of the stabilizer was 173.1° C., the bottom product was fractionated in the stabilizer to obtain a desulfurized liquefied gas and a desulfurized stabilized gasoline, and the overhead gas of the desorber was recycled to the absorber. The properties of the resulting desulfurized dry gas, desulfurized liquefied gas and desulfurized stabilized gasoline are shown in Table V-3.

Example V-4

An experiment was carried out using the same desulfurization adsorbent and reaction scheme as in Example V-3, except that: the operating conditions of the first fluidized bed desulfurization reactor included a reaction temperature of 430° C., a reaction pressure of 1.4 MPa, a weight hourly space velocity of 8 $h^{-1}$, and a hydrogen-to-oil volume ratio of 200. A part of the sulfur-loaded adsorbent was introduced into a second fluidized bed desulfurization reactor from the first fluidized bed desulfurization reactor at a position of 30% of the height thereof from bottom to top; the operating conditions of the second fluidized bed desulfurization reactor included: a reaction temperature of 380° C., a reaction pressure of 0.5 MPa, a weight hourly space velocity of 1 $h^{-1}$, the reacted rich gas and the desulfurization adsorbent were separated in the second fluidized bed desulfurization reactor, the desulfurized rich gas was sent to an absorption stabilization system, the desulfurization adsorbent was recycled to the first fluidized bed desulfurization reactor at a position of 80% of the height thereof from bottom to top.

The pressure at the top of the absorber was 1.286 MPa, the temperature at the top of the absorber was 30.5° C., and the temperature at the bottom of the absorber was 40.2° C.; the pressure at the top of the reabsorber was 1.175 MPa, the temperature at the top of the reabsorber was 31.8° C., the temperature at the bottom of the reabsorber was 41.4° C., and a desulfurized dry gas was obtained at the top of the reabsorber; the pressure at the top of the desorber was 1.539 MPa, the temperature at the top of the tower was 58.6° C., the temperature at the bottom of the tower was 137.8° C., the bottom product was sent to a stabilizer, the pressure at the top of the stabilizer was 0.783 MPa, the temperature at the top of the stabilizer was 45.1° C., the temperature at the bottom of the stabilizer was 153.3° C., and a desulfurized liquefied gas and a stabilized gasoline were obtained by fractionation in the stabilizer. The properties of the resulting desulfurized dry gas, desulfurized liquefied gas and desulfurized stabilized gasoline are shown in Table V-3.

TABLE V-3

Comparison of the results of Comparative Example 1-2 and Examples V-1 to V-4

| Components | Item | Comp. Ex. 1 | Comp. Ex. 2 | Example 1 | Example 2 | Example 3 | Example 4 |
|---|---|---|---|---|---|---|---|
| Dry gas | Yield, % | 1.7 | — | 1.8 | 1.8 | 1.8 | 1.8 |
| | Sulfur content, ppm | 2126 | — | 0.7 | 1.4 | 1.4 | 1.7 |
| | Ethylene saturation rate, % | Reference | — | 15.3 | 13.0 | 10.8 | 6.4 |
| Liquefied gas | Yield, % | 11.3 | — | 11.3 | 11.4 | 11.3 | 11.4 |
| | Sulfur content, ppm | 6351 | — | 1.1 | 1.7 | 2.1 | 2.5 |
| | Propylene saturation rate, % | Reference | — | 10.1 | 7.8 | 7.6 | 4.3 |

TABLE V-3-continued

Comparison of the results of Comparative Example 1-2 and Examples V-1 to V-4

| Components | Item | Comp. Ex. 1 | Comp. Ex. 2 | Example 1 | Example 2 | Example 3 | Example 4 |
|---|---|---|---|---|---|---|---|
| Stabilized gasoline | Density (20 ° C.), kg/m$^3$ | 731.2 | 731.5 | 731.2 | 731.3 | 731.1 | 731.4 |
| | Yield, % | 45.7 | 45.1 | 45.6 | 45.5 | 45.6 | 45.5 |
| | Sulfur content, ppm | 256 | 2.6 | 2.5 | 2.2 | 2.7 | 2.0 |
| | Olefin saturation rate, % | Reference | 16.08 | 14.2 | 13.6 | 14.0 | 10.5 |
| | RON | Reference | −0.8 | −0.7 | −0.6 | −0.7 | −0.5 |

As can be seen from the Table V-3, the method for the desulfurization of catalytic cracking light product according to the present application can realize the desulfurization of dry gas and liquefied gas at the same time, the yield of the liquefied gas is increased by 0.1%, and the saturation rate of light olefins is low; the yield of the stabilized gasoline is increased by 0.4-0.5%, the olefin saturation rate of the stabilized gasoline is reduced by 1.8-5%, and the Research Octane Number (RON) loss is smaller.

Example VI-1

The rich gas and the crude gasoline from the catalytic cracking fractionator were used as feedstocks, and firstly introduced into an adsorption desulfurization reaction unit for desulfurization and then introduced into an absorption stabilization unit for separation. The process flow of the adsorption desulfurization unit was shown in FIG. 1F, and the process flow of the absorption stabilization unit was shown in FIG. 2, the first fluidized bed desulfurization reactor was a small fixed fluidized bed reactor, the second fluidized bed desulfurization reactor was a countercurrent reactor, and the desulfurization adsorbent was FCAS. The desulfurization adsorbent from a reducer was introduced into a first fluidized bed desulfurization reactor from the bottom, the crude gasoline from the catalytic cracking fractionator and hydrogen were introduced into the first fluidized bed desulfurization reactor from the bottom to contact with the desulfurization adsorbent for adsorption desulfurization, the reaction oil gas and the desulfurization adsorbent were separated after the reaction to obtain a mixture of a desulfurized crude gasoline and hydrogen; a part of the desulfurization adsorbent at the top of the adsorbent bed was introduced into a reactor receiver and another part was introduced into the upper part of a second fluidized bed desulfurization reactor. The first fluidized bed desulfurization reactor was communicated at a position of 80% of the height thereof from bottom to top with the second fluidized bed desulfurization reactor at a position of 90% of the height thereof from bottom to top. The rich gas from the catalytic cracking fractionator was introduced into the second fluidized bed desulfurization reactor from the bottom, contacted with the desulfurization adsorbent in a countercurrent manner for adsorption desulfurization, and separated at the upper part of the second fluidized bed desulfurization reactor to obtain a desulfurized rich gas. The operating conditions of the first fluidized bed desulfurization reactor included a reaction temperature of 400° C., a reaction pressure of 1.8 MPa, a weight hourly space velocity of 7 $h^{-1}$, and a hydrogen-to-oil volume ratio of 75, and the operating conditions of the second fluidized bed desulfurization reactor included a reaction temperature of 430° C., a reaction pressure was 2.0 MPa, and a weight hourly space velocity of 10 $h^{-1}$. The desulfurized rich gas was introduced into an absorber from the bottom, the pressure at the top of the absorber was 1.428 MPa, the temperature at the top of the absorber was 30.6° C., and the temperature at the bottom of the absorber was 45.1° C.; the desulfurized crude gasoline was introduced into the absorber from the upper part, contacted with the rich gas in a countercurrent manner for mass transfer, the overhead stream of the absorber was introduced into a reabsorber from the bottom, contacted with a light cycle oil from the catalytic cracking fractionator in a countercurrent manner for mass transfer, wherein the pressure at the top of the reabsorber was 1.220 MPa, the temperature at the top of the reabsorber was 31.2° C., the temperature at the bottom of the reabsorber was 56.3° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.621 MPa, the temperature at the top of the desorber was 85.1° C., the temperature at the bottom of the desorber was 153.6° C., the bottom product of the desorber was sent to a stabilizer, the pressure at the top of the stabilizer was 0.901 MPa, the temperature at the top of the stabilizer was 62.1° C., the temperature at the bottom of the stabilizer was 143.2° C., the bottom product was fractionated in the stabilizer to obtain a desulfurized liquefied gas and a desulfurized stabilized gasoline, and the overhead gas of the desorber was recycled to the absorber. The properties of the resulting desulfurized dry gas, desulfurized liquefied gas, and desulfurized stabilized gasoline are shown in Table VI-3.

Example VI-2

An experiment was carried out using the same reaction scheme and desulfurization adsorbent as in Example VI-1, except that the first fluidized-bed desulfurization reactor was operated under reaction conditions including a reaction temperature of 430° C., a reaction pressure of 1.4 MPa, a weight hourly space velocity of 8 $h^{-1}$, and a hydrogen-to-oil volume ratio of 100. The rich gas from the catalytic cracking fractionator was preheated to 430° C., and then introduced into a second fluidized bed desulfurization reactor for reaction under the reaction conditions including a reaction temperature of 445° C., a reaction pressure of 0.5 MPa and a weight hourly space velocity of 12 $h^{-1}$, to obtain a desulfurized crude gasoline and hydrogen in the first fluidized bed desulfurization reactor, and a desulfurized rich gas in the second fluidized bed desulfurization reactor. The first fluidized bed desulfurization reactor was communicated at a position of 60% of the height thereof from bottom to top with the second fluidized bed desulfurization reactor at a position of 80% of the height thereof from bottom to top. The desulfurized rich gas was introduced into an absorber from the bottom, the pressure at the top of the absorber was 1.425 MPa, the temperature at the top of the absorber was 31.6° C., and the temperature at the bottom of the absorber was 42.1° C.; the desulfurized crude gasoline was introduced into the absorber from the upper part, contacted with the rich gas in a countercurrent manner for mass transfer, the overhead stream of the absorber was introduced into a reabsorber from the bottom, contacted with a light cycle oil from the catalytic cracking fractionator in a countercurrent manner for mass transfer, wherein the pressure at the top of the reabsorber was 1.119 MPa, the temperature at the top of the reabsorber was 33.6° C., the temperature at the bottom of the reabsorber was 46.5° C., a desulfurized dry gas was obtained at the top of the reabsorber, and the enriched light cycle oil obtained at the bottom of the reabsorber was recycled to the catalytic cracking fractionator; and the bottom product of the absorber was desorbed in a desorber, wherein the pressure at the top of the desorber was 1.521 MPa, the temperature at the top of the desorber was 71.6° C., the temperature at the bottom of the desorber was 138.4° C., the bottom product of the desorber was sent to a stabilizer, the pressure at the top of the stabilizer was 0.786 MPa, the temperature at the top of the stabilizer was 61.3° C., the temperature at the bottom of the stabilizer was 140.6° C., the bottom product was fractionated in the stabilizer to obtain a desulfurized liquefied gas and a desulfurized stabilized gasoline, and the overhead gas of the desorber was recycled to the absorber. The properties of the resulting desulfurized dry gas, desulfurized liquefied gas, and desulfurized stabilized gasoline are shown in Table VI-3.

TABLE VI-3

Comparison of the results of Comparative Example 1-2 and Examples VI-1 to VI-2

| Components | Item | Comparative Example 1 | Comparative Example 2 | Example VI-1 | Example VI-2 |
|---|---|---|---|---|---|
| Dry gas | Yield, % | 1.7 | — | 1.8 | 1.8 |
| | Sulfur content, ppm | 2126 | — | 2.2 | 3.6 |
| | Ethylene saturation rate, % | Reference | — | 8.9 | 4.3 |
| Liquefied gas | Yield, % | 11.3 | — | 11.3 | 11.4 |
| | Sulfur content, ppm | 6351 | — | 3.1 | 3.9 |
| | Propylene saturation rate, % | Reference | — | 5.7 | 2.1 |
| Stabilized gasoline | Density (20° C.), kg/m$^3$ | 731.2 | 731.5 | 731.1 | 731.2 |
| | Yield, % | 45.7 | 45.1 | 45.6 | 45.5 |
| | Sulfur content, ppm | 256 | 2.6 | 2.2 | 2.5 |
| | Olefin saturation rate, % | Reference | 16.08 | 14.0 | 11.4 |
| | RON | Reference | −0.8 | −0.8 | −0.5 |

As can be seen from the results in Table VI-3, the method of the application can realize the desulfurization of gasoline, dry gas and liquefied gas at the same time, the yield of the liquefied gas is increased by 0.1%, and the saturation rates of ethylene and propylene are lower. The yield of the stabilized gasoline is increased by 0.4-0.5%, the olefin saturation rate in the gasoline is reduced, and the octane number loss is reduced.

The present application is illustrated in detail hereinabove with reference to preferred embodiments, but is not intended to be limited to those embodiments. Various modifications may be made following the inventive concept of the present application, and these modifications shall be within the scope of the present application.

It should be noted that the various technical features described in the above embodiments may be combined in any suitable manner without contradiction, and in order to avoid unnecessary repetition, various possible combinations are not described in the present application, but such combinations shall also be within the scope of the present application.

In addition, the various embodiments of the present application can be arbitrarily combined as long as the combination does not depart from the spirit of the present application, and such combined embodiments should be considered as the disclosure of the present application.

The invention claimed is:

1. A method for the desulfurization and separation of a catalytic cracking light product, comprising the steps of:

1) Contacting a crude gasoline from a catalytic cracking fractionator with a desulfurization adsorbent in a first fluidized bed desulfurization reactor in the presence of hydrogen for desulfurization to generate a first reaction mixture comprising a desulfurized crude gasoline and the desulfurization adsorbent;

separating the desulfurization adsorbent in the first fluidized bed desulfurization reactor into a first desulfurization adsorbent stream and a second desulfurization adsorbent stream;

sending the first desulfurization adsorbent stream from the first fluidized bed desulfurization reactor to a second fluidized bed desulfurization reactor;

contacting a rich gas from the catalytic cracking fractionator with the first desulfurization adsorbent stream in the second fluidized bed desulfurization reactor in the presence of hydrogen for desulfurization to generate a second reaction mixture comprising a desulfurized rich gas and a spent desulfurization adsorbent;

sending the spent desulfurization adsorbent from the second fluidized bed desulfurization reactor directly to the first fluidized bed desulfurization reactor;

sending the second desulfurization adsorbent stream from the first fluidized bed desulfurization reactor to an adsorbent regenerator for regeneration without entering the second fluidized desulfurization reactor, wherein the regeneration is carried out by calcining in the presence of an oxygen-containing gas, and recycling the regenerated desulfurization adsorbent to the first fluidized bed desulfurization reactor after reduction; and 2) Introducing the desulfurized rich gas and the desulfurized crude gasoline obtained in the step 1) to a catalytic cracking absorption stabilization system at two separate locations, respectively, and outputting a desulfurized dry gas, a desulfurized liquefied gas, and a desulfurized stabilized gasoline from the catalytic cracking absorption stabilization system, wherein the rich gas comprises C1-C4 hydrocarbons and the crude gasoline comprises C4-C12 hydrocarbons.

2. The method according to claim 1, wherein the catalytic cracking absorption stabilization system comprises an absorber, a reabsorber, a desorber, and a stabilizer, and the step 2) further comprises:

2a) introducing the desulfurized rich gas into an absorber from the bottom and the desulfurized crude gasoline into the absorber from the top, wherein the desulfurized rich gas and the desulfurized crude gasoline come in contact in a countercurrent manner, to obtain an overhead stream and a bottom stream;

2b) introducing the overhead stream of the absorber into a reabsorber from the bottom and introducing a light cycle oil from the catalytic cracking fractionator into the reabsorber from the top, wherein the overhead stream and the light cycle oil come in contact in a countercurrent manner, to obtain the desulfurized dry gas at the top of the reabsorber and an enriched light cycle oil at the bottom of the reabsorber, and recycling the enriched light cycle oil to the catalytic cracking fractionator;

2c) desorbing the bottom stream from the absorber in the desorber to obtain an overhead gas and a bottom product, and recycling the overhead gas to the absorber; and 2d) fractionating the bottom product of the desorber in the stabilizer to obtain the desulfurized liquefied gas and the desulfurized stabilized gasoline.

3. The method according to claim 1, wherein the step 1) further comprises:

sending the second reaction mixture to the first fluidized bed desulfurization reactor so that the first reaction mixture and the second reaction mixture are combined to form a combined reaction mixture;

separating a gas phase from the combined reaction mixture; and separating the gas phase to obtain the desulfurized rich gas and the desulfurized crude gasoline.

4. The method according to claim 3, wherein:

operating conditions of the first fluidized bed desulfurization reactor include: a temperature of 200-550° C., an absolute pressure of 0.5-5 MPa, a weight hourly space velocity of oil gas feedstock of 0.1-100 $h^{-1}$, and a hydrogen-to-oil molar ratio of 0.01-1000, and operating conditions of the second fluidized bed desulfurization reactor include: a temperature of 250-550° C., an absolute pressure of 0.5-5 MPa, a weight hourly space velocity of oil gas feedstock of 0.1-100 $h^{-1}$, and a hydrogen-to-oil molar ratio of 0.01-1000.

5. The method according to claim 1, wherein the step 1) further comprises:

separating the desulfurized crude gasoline from the first reaction mixture; and separating the desulfurized rich gas from the second reaction mixture.

6. The method according to claim 5, wherein a feed gas velocity in the first fluidized bed desulfurization reactor is 0.25-10 m/s and a feed gas velocity in the second fluidized bed desulfurization reactor is 0.05-1.5 m/s.

7. The method according to claim 5, wherein:

operating conditions of the first fluidized bed desulfurization reactor include: a temperature of 200-550° C., an absolute pressure of 0.5-5 MPa, a weight hourly space velocity of oil gas feedstock of 0.1-100 $h^{-1}$, and a hydrogen-to-oil molar ratio of 0.01-1000, and operating conditions of the second fluidized bed desulfurization reactor include: a temperature of 300-550° C., an absolute pressure of 0.5-5 MPa, a weight hourly space velocity of oil gas feedstock of 0.1-100 $h^{-1}$, and a hydrogen-to-oil molar ratio of 0.01-500.

8. The method according to claim 1, wherein the desulfurization adsorbent comprises a desulfurization adsorbent carrier and a metal component loaded on the adsorbent carrier, the content of the desulfurization adsorbent carrier is 70-95 wt %, the content of the metal component is 5-30 wt %, based on the total weight of the desulfurization adsorbent, wherein the adsorbent carrier is selected from zinc oxide, silica, alumina or a mixture thereof, and the metal component is selected from cobalt, nickel, copper, iron, manganese, molybdenum, tungsten, silver, tin, vanadium, or a combination thereof.

9. A process for producing a low-sulfur light oil product by catalytic cracking, comprising the steps of:

i) contacting a catalytic cracking feedstock with a catalytic cracking catalyst for reaction under catalytic cracking conditions;

ii) carrying out gas-solid separation on the reaction product obtained in the step i) to obtain a reaction oil gas and a spent catalyst;

iii) fractionating the reaction oil gas obtained in the step ii) in a catalytic cracking fractionator to obtain a catalytic cracking light product, a light cycle oil, a diesel oil and an oil slurry;

iv) desulfurizing and separating the catalytic cracking light product from the catalytic cracking fractionator according to the method according to claim 5 to obtain the desulfurized crude gasoline and the desulfurized rich gas.

10. The process of claim 9, further comprising reabsorbing the desulfurized rich gas to obtain the desulfurized dry gas.

11. The process of claim 9, further comprising fractionating the desulfurized crude gasoline to obtain the desulfurized liquefied gas and the desulfurized stabilized gasoline.

* * * * *